US009653088B2

(12) United States Patent
Rajendran et al.

(10) Patent No.: US 9,653,088 B2
(45) Date of Patent: May 16, 2017

(54) SYSTEMS, METHODS, AND APPARATUS FOR SIGNAL ENCODING USING PITCH-REGULARIZING AND NON-PITCH-REGULARIZING CODING

(75) Inventors: Vivek Rajendran, San Diego, CA (US); Ananthapadmanabhan A. Kandhadai, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1350 days.

(21) Appl. No.: 12/137,700

(22) Filed: Jun. 12, 2008

(65) Prior Publication Data

US 2008/0312914 A1 Dec. 18, 2008

Related U.S. Application Data

(60) Provisional application No. 60/943,558, filed on Jun. 13, 2007.

(51) Int. Cl.
*G10L 19/18* (2013.01)
*G10L 19/022* (2013.01)
*G10L 19/08* (2013.01)

(52) U.S. Cl.
CPC ..... *G10L 19/18* (2013.01); *G10L 19/022* (2013.01); *G10L 19/08* (2013.01)

(58) Field of Classification Search
CPC ..... G10L 19/12; G10L 19/125; G10L 19/20; G10L 19/008; G10L 19/032; G10L 19/04; G10L 19/0204; G10L 19/167; G10L 19/24; G10L 25/27; G10L 19/022; G10L 19/08; G10L 19/18
USPC ..... 704/214, 16, 500–504, 208
See application file for complete search history.

(56) References Cited

U.S. PATENT DOCUMENTS

| | | | | |
|---|---|---|---|---|
| 5,357,594 | A | 10/1994 | Fielder | |
| 5,363,096 | A | 11/1994 | Duhamel et al. | |
| 5,384,891 | A | 1/1995 | Asakawa et al. | |
| 5,394,473 | A | 2/1995 | Davidson | |
| 5,455,888 | A | 10/1995 | Iyengar et al. | |
| 5,704,003 | A | 12/1997 | Kleijn | |
| 5,884,251 | A * | 3/1999 | Kim | G10L 19/12 704/219 |
| 5,911,128 | A | 6/1999 | DeJaco | |
| 5,978,759 | A | 11/1999 | Tsushima et al. | |
| 6,134,518 | A | 10/2000 | Cohen et al. | |

(Continued)

FOREIGN PATENT DOCUMENTS

| | | | |
|---|---|---|---|
| EP | 1089258 | A2 | 4/2001 |
| EP | 1271471 | A2 | 1/2003 |

(Continued)

OTHER PUBLICATIONS

Kleijn, W.B., et al., "The RCELP Speech-Coding Algorithm," European Transaction on Telecommunications and Related Technologies, vol. 5, No. 5, Sep.-Oct. 1994, pp. 573-582.

(Continued)

*Primary Examiner* — Abdelali Serrou
(74) *Attorney, Agent, or Firm* — Heejong Yoo

(57) ABSTRACT

A time shift calculated during a pitch-regularizing (PR) encoding of a frame of an audio signal is used to time-shift a segment of another frame during a non-PR encoding.

73 Claims, 27 Drawing Sheets

(56) References Cited

U.S. PATENT DOCUMENTS

| | | | | |
|---|---|---|---|---|
| 6,169,970 | B1 | 1/2001 | Kleijn | |
| 6,233,550 | B1 * | 5/2001 | Gersho et al. | 704/208 |
| 6,330,532 | B1 | 12/2001 | Manjunath | |
| 6,449,590 | B1 | 9/2002 | Gao | |
| 6,654,716 | B2 | 11/2003 | Bruhn et al. | |
| 6,691,084 | B2 | 2/2004 | Manjunath | |
| 6,754,630 | B2 * | 6/2004 | Das | G10L 19/0204 704/258 |
| 6,879,955 | B2 | 4/2005 | Rao | |
| 7,116,745 | B2 | 10/2006 | Fanson et al. | |
| 7,136,418 | B2 | 11/2006 | Atlas et al. | |
| 7,386,444 | B2 | 6/2008 | Stachurski | |
| 7,461,002 | B2 | 12/2008 | Crockett et al. | |
| 7,516,064 | B2 | 4/2009 | Vinton et al. | |
| 8,126,707 | B2 * | 2/2012 | Ertan et al. | 704/219 |
| 8,239,190 | B2 * | 8/2012 | Kapoor et al. | 704/203 |
| 8,280,724 | B2 * | 10/2012 | Chazan et al. | 704/206 |
| 2001/0023396 | A1 * | 9/2001 | Gersho et al. | 704/220 |
| 2001/0028317 | A1 * | 10/2001 | Tsutsui | G10L 19/20 341/50 |
| 2001/0051873 | A1 * | 12/2001 | Das | G10L 19/0204 704/268 |
| 2002/0016711 | A1 * | 2/2002 | Manjunath | G10L 19/097 704/258 |
| 2002/0099548 | A1 * | 7/2002 | Manjunath | G10L 19/20 704/266 |
| 2002/0161576 | A1 * | 10/2002 | Benyassine | G10L 19/18 704/229 |
| 2003/0009325 | A1 * | 1/2003 | Kirchherr et al. | 704/211 |
| 2003/0167165 | A1 | 9/2003 | Schroder et al. | |
| 2004/0030548 | A1 * | 2/2004 | El-Maleh | G10L 19/002 704/230 |
| 2004/0098255 | A1 | 5/2004 | Kovesi | |
| 2005/0055201 | A1 * | 3/2005 | Florencio | G10L 25/87 704/214 |
| 2005/0065782 | A1 * | 3/2005 | Stachurski | G01R 23/20 704/205 |
| 2005/0143980 | A1 * | 6/2005 | Huang | G10L 19/083 704/208 |
| 2005/0192798 | A1 * | 9/2005 | Vainio | G10L 19/20 704/223 |
| 2005/0254783 | A1 * | 11/2005 | Chen | G11B 20/00007 386/344 |
| 2005/0256701 | A1 * | 11/2005 | Makinen | G10L 19/22 704/223 |
| 2005/0267742 | A1 * | 12/2005 | Makinen | G10L 19/022 704/219 |
| 2006/0173675 | A1 * | 8/2006 | Ojanpera | 704/203 |
| 2006/0271356 | A1 | 11/2006 | Vos | |
| 2006/0277038 | A1 | 12/2006 | Vos et al. | |
| 2006/0277042 | A1 | 12/2006 | Vos et al. | |
| 2006/0282263 | A1 | 12/2006 | Vos | |
| 2007/0088541 | A1 | 4/2007 | Vos et al. | |
| 2007/0088542 | A1 | 4/2007 | Vos | |
| 2007/0088558 | A1 | 4/2007 | Vos et al. | |
| 2007/0094015 | A1 * | 4/2007 | Samake | 704/212 |
| 2007/0107584 | A1 * | 5/2007 | Kim et al. | 84/612 |
| 2007/0147518 | A1 * | 6/2007 | Bessette | G10L 19/0212 375/243 |
| 2007/0150271 | A1 | 6/2007 | Virette et al. | |
| 2007/0171931 | A1 | 7/2007 | Manjunath | |
| 2007/0174274 | A1 * | 7/2007 | Kim | G06F 17/30743 |
| 2007/0192087 | A1 * | 8/2007 | Kim | G06F 17/30743 704/200.1 |
| 2007/0223660 | A1 | 9/2007 | Dei et al. | |
| 2008/0027719 | A1 | 1/2008 | Kirshnan | |
| 2008/0052065 | A1 | 2/2008 | Kapoor | |
| 2008/0312914 | A1 * | 12/2008 | Rajendran et al. | 704/207 |

FOREIGN PATENT DOCUMENTS

| | | | |
|---|---|---|---|
| EP | 1278184 | A2 | 1/2003 |
| EP | 1420391 | A1 | 5/2004 |
| EP | 1126620 | B1 | 12/2005 |
| EP | 1758101 | A1 | 2/2007 |
| EP | 1793372 | | 6/2007 |
| JP | 06268608 | | 9/1994 |
| JP | 9185398 | A | 7/1997 |
| JP | 2003044097 | A | 2/2003 |
| RU | 2005104122 | | 8/2005 |
| RU | 2364958 | | 8/2009 |
| TW | 200638336 | | 11/2006 |
| TW | 200643897 | | 12/2006 |
| TW | 200710826 | | 3/2007 |
| TW | 200719319 | | 5/2007 |
| WO | 9910719 | | 3/1999 |
| WO | 9910719 | A1 | 3/1999 |
| WO | WO2004008437 | A2 | 1/2004 |
| WO | WO2005099243 | A1 | 10/2005 |
| WO | WO2006046546 | | 5/2006 |

OTHER PUBLICATIONS

Krishnan, V., et al., "EVCR-Wideband: The New 3GPP2 Wideband Vocoder Standard," IEEE International Conference on Acoustics, Speech and Signal Processing, 2007 ("ICASSP 2007"), vol. 2, Apr. 15-20, 2007, pp. II-333 to II-336.

Lee, W., et al., "Improvement of Tandemless Transcoding from AMR to EVRC," Feb. 18, 2003, pp. 1-5 Last accessed May 23, 2008 at http://mmp.kaist.ac.kr/paperdata/Improvement%20of %20tandemless%20trandcoding%20from%20AMR%20to %20EVRC.pdf.

Lee, S., et al., "A Novel Transcoding Algorithm for AMR and EVRC Speech Codecs via Direct Parameter Transformation," IEEE International Conference on Acoustics, Speech, and Signal Processing, 2003 ("ICASSP '03"), vol. 2, Apr. 6-10, 2003, pp. II-177-80.

Li, C., et al., "Robust Closed-loop Pitch Estimation for Harmonic Coders by Time Scale Modification," IEEE International Conference on Acoustics, Speech, and Signal Processing, 1999 ("ICASSP '99"), vol. 1, Mar. 15-19, 1999, pp. 257-260.

Mittal, U., et al., "Low Complexity Factorial Pulse Coding of MDCT Coefficients using Approximation of Combinatorial Fuctions," IEEE International Conference on Acoustics, Speech and Signal Processing, 2007 ("ICASSP 2007"), vol. 1, Apr. 15-20, 2007, pp. 1-289 to 1-292.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 1-3, pp. 1-1 to 1-4, 2-1 to 2-19, 3-1 to 3-3.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 4, pp. 4-1 to 4-181.

3rd Generation Partnership Project 2 ("3GPP2"), "Enhanced Variable Rate Codec, Speech Service Options 3, 68, and 70 for Wideband Spread Spectrum Digital Systems," 3GPP2 C.S0014-C, Version 1.0, Jan. 2007, ch. 5, pp. 5-1 to 5-42.

3rd Generation Partnership Project 2 ("3GPP2"), "Selectable Mode Vocoder (SMV) Service Option for Wideband Spread Spectrum Communication Systems," 3GPP2 C.S0030-0, Version 3.0, Jan. 2004, ch. 1-3, pp. title to 12.

3rd Generation Partnership Project 2 ("3GPP2"), "Selectable Mode Vocoder (SMV) Service Option for Wideband Spread Spectrum Communication Systems," 3GPP2 C.S0030-0, Version 3.0, Jan. 2004, ch. 4, pp. 13-42.

3rd Generation Partnership Project 2 ("3GPP2"), "Selectable Mode Vocoder (SMV) Service Option for Wideband Spread Spectrum Communication Systems," 3GPP2 C.S0030-0, Version 3.0, Jan. 2004, ch. 5, pp. 43-188.

3rd Generation Partnership Project 2 ("3GPP2"), "Selectable Mode Vocoder (SMV) Service Option for Wideband Spread Spectrum Communication Systems," 3GPP2 C.S0030-0, Version 3.0, Jan. 2004, ch. 6, pp. 189-203.

Joint Technical Committee ISO/IEC JTC 1, Information technology, Subcommittee SC 29, Coding of audio, picture, multimedia and

(56) References Cited

OTHER PUBLICATIONS hypermedia information, "Information technology—Coding of audio-visual objects—Part 3: Audio," ISO/IEC 14496-3, Third edition, Dec. 1, 2005, ch. 4.6.1 to 4.6.9, pp. 124-161.
Joint Technical Committee ISO/IEC JTC 1, Information technology, Subcommittee SC 29, Coding of audio, picture, multimedia and hypermedia information, "Information technology—Coding of audio-visual objects—Part 3: Audio," ISO/IEC 14496-3, Third edition, Dec. 1, 2005, ch. 4.6.10 to 4.6.17, pp. 161-201.
European Telecommunications Standards Institute ("ETSI"), "Digital cellular telecommunications system (Phase 2+); Universal Mobile Telecommunications System (UMTS); AMR speech Codec; comfort noise for AMR Speech Traffic Channels," (3GPP TS 26.092 version 6.0.0 Release 6), ETSI TS 126 092 V6.0.0 (Dec. 2004), pp. 1-13.
European Telecommunications Standards Institute ("ETSI"), "Digital cellular telecommunications system (Phase 2+); Universal Mobile Telecommunications System (UMTS); Mandatory Speech Codec speech processing functions AMR Wideband Speech Codec; Comfort noise aspects," (3GPP TS 26.192 version 6.0.0 Release 6), ETSI TS 126 192 V6.0.0 (Dec. 2004), pp. 1-14.
Cheng, M. et al., "Fast IMDCT and MDCT Algorithms—A Matrix Approach," IEEE Transactions on Signal Processing, [see also IEEE Transactions on Acoustics, Speech, and Signal-Processing,] vol. 51, No. 1, Jan. 2003, pp. 221-229.
Princen, J. et al., "Analysis/Synthesis Filter Bank Design Based on Time Domain Aliasing Cancellation," IEEE Transactions on Acoustics, Speech, and Signal Processing [see also IEEE Transactions on Signal Processing], vol. 34, No. 5, Oct. 1986, pp. 1153-1161.
Princen, J. et al., "Subband/Transform Coding Using Filter Bank Designs Based on Time Domain Aliasing Cancellation," IEEE International Conference on Acoustics, Speech, and Signal Processing ("ICASSP '87"), vol. 12, Apr. 1987, pp. 2161-2164.
Rao, K.R. et al., "Discrete Cosine Transform Algorithms, Advantages, Applications," Academic Press, Inc., San Diego, CA, 1990, ch. 2, pp. 7-25.
Nahumi, D. and Kleijn, W.B., "An Improved 8 KB/S RCELP Coder," 1995 IEEE Workshop on Speech Coding for Telecommunications, Sep. 20-22, 1995, pp. 39-40.
Ashley, J.P. and Mittel, U., Closed Loop Dynamic Bit Allocation for Excitation Parameters in Analysis-by-Synthesis Speech Codec, IEEE International Conference on Acoustics, Speech and Signal Processing, 2007 ("ICASSP 2007"), vol. 4, Apr. 15-20, 2007, pp. IV-1109-IV-1112.
International Search Report—PCT/US08/066840—International Search Authority, European Patent Office—Sep. 30, 2008.
Written Opinion—PCT/US08/066840—International Search Authority, European Patent Office—Sep. 30, 2008.
Transactions on Speech and Audio Processing, IEEE Service Center, New York, NY, US, vol. 11, No. 6, Nov. 2003 (2003-II), pp. 520-531, XP011104739.
Bessette, B., Salami, R., Lefebvre, R., Jelinek, M., Rotola-Pukkila, J., Vainio, J., Mikkola, H., Jarvinen, K., "The Adaptive Multirate Wideband Speech Codec (AMR-WB)," IEEE Tr. on Speech and Audio Processing, vol. 10, No. 8, Nov. 2002, pp. 620-636.
Chen, T. "Multimedia Systems, Standards, and Networks." Marcell Dekker, Inc. New York, 2000. p. 137-138.
Iwadare, M., et al., "A 128 KB/s Hi-Fi Audio Codec Based on Adaptive Transform Coding With Adaptive Block Size MDCT" IEEE Journal on Selected Areas in Communications, IEEE Service Center, Piscataway, NJ, US, vol. 10, No. 1, Jan. 1992 (Jan. 1992), pp. 138-144, XP000462072.
Knagenhjelm, P. H. and Kleijn, W. B., "Spectral dynamics is more important than spectral distortion," Proc. IEEE Int. Conf. on Acoustic Speech and Signal Processing, 1995, pp. 732-735.
Makhoul, J. and Berouti, M.. "High Frequency Regeneration in Speech Coding Systems," Proc. IEEE Int. Conf. on Acoustic Speech and Signal Processing, Washington, 1979, pp. 428-431.
McCree, A., "A 14 kb/s Wideband Speech Coder With a Parametric Highband Model," Int. Conf. on Acoustic Speech and Signal Processing, Turkey, 2000, pp. 1153-1156.
Nilsson, M., Andersen, S.V., Kleijn, W.B., "Gaussian Mixture Model based Mutual Information Estimation between Frequency Based in Speech," Proc. IEEE Int. Conf. on Acoustic Speech and Signal Processing, Florida, 2002, pp. 525-528.
Valin, J.-M., Lefebvre, R., "Bandwidth Extension of Narrowband Speech for Low Bit-Rate Wideband Coding," Proc. IEEE Speech Coding Workshop (SCW), 2000, pp. 130-132.
Kandhadai A, "List of Changes to EVRC-WB Floating Point C-Code since EVRC-WB Characterization Test," 3GPP2 Draft; C11-20070613-009_Qualcomm_Motorola_EVRC_WB_floating_point_c_code, Jun. 13, 2007 3rd Generation Partnership Project 2, 3GPP2, 2500 Wilson Boulevard, Suite 300, Arlington, Virginia 22201 ; USA, vol. TSGC, Jun. 13, 2007, pp. 1-4, XP062067572.
"Taiwan Search Report—TW097122276—TIPO—Jul. 15, 2012".

* cited by examiner

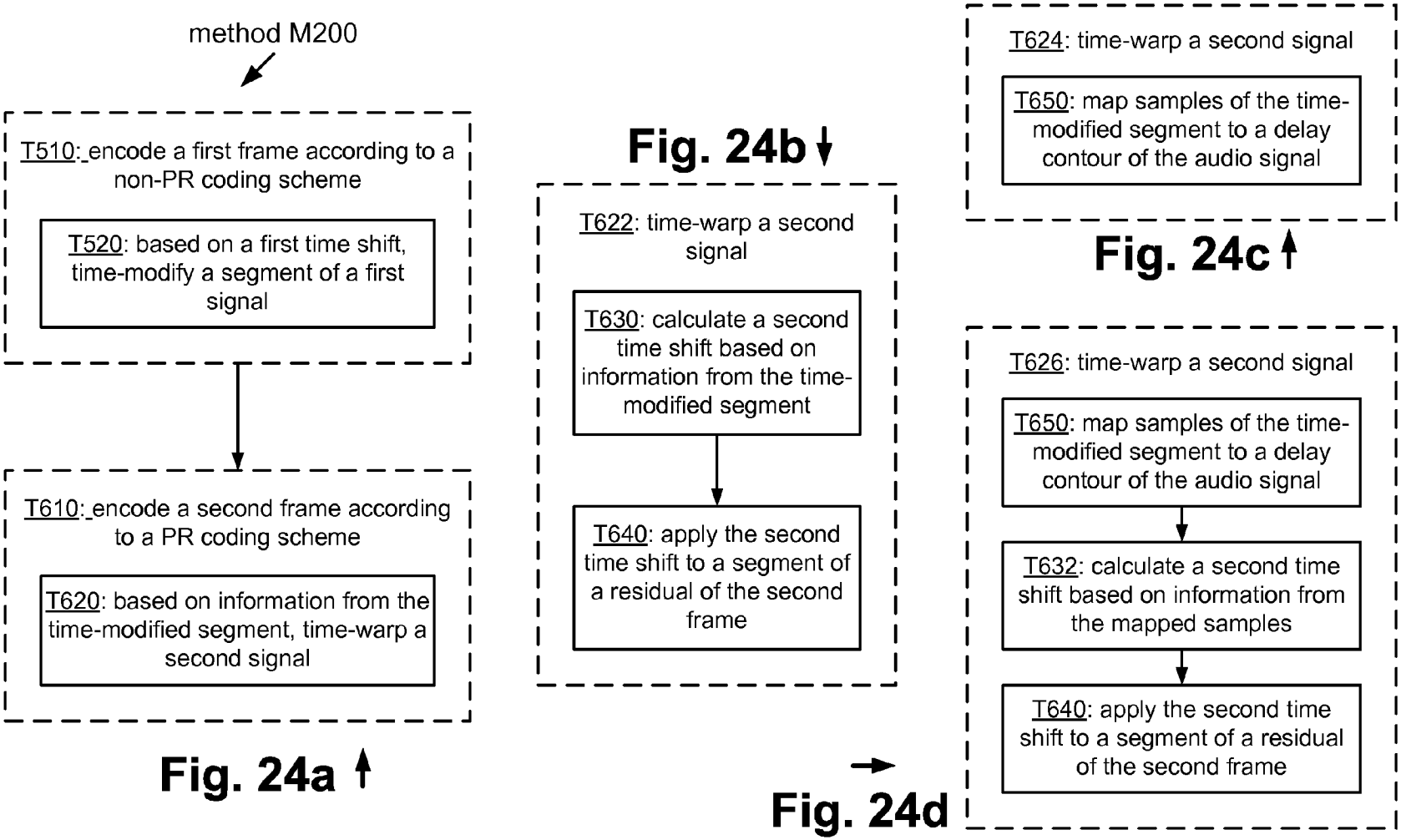
method M200
T510: encode a first frame according to a non-PR coding scheme
T520: based on a first time shift, time-modify a segment of a first signal
T610: encode a second frame according to a PR coding scheme
T620: based on information from the time-modified segment, time-warp a second signal
Fig. 24a
T622: time-warp a second signal
T630: calculate a second time shift based on information from the time-modified segment
T640: apply the second time shift to a segment of a residual of the second frame
Fig. 24b
T624: time-warp a second signal
T650: map samples of the time-modified segment to a delay contour of the audio signal
Fig. 24c
T626: time-warp a second signal
T650: map samples of the time-modified segment to a delay contour of the audio signal
T632: calculate a second time shift based on information from the mapped samples
T640: apply the second time shift to a segment of a residual of the second frame
Fig. 24d

SYSTEMS, METHODS, AND APPARATUS FOR SIGNAL ENCODING USING PITCH-REGULARIZING AND NON-PITCH-REGULARIZING CODING

CLAIM OF PRIORITY UNDER 35 U.S.C. §119

The present Application for Patent claims priority to Provisional Application No. 60/943,558 entitled "METHOD AND APPARATUS FOR MODE SELECTION IN A GENERALIZED AUDIO CODING SYSTEM INCLUDING MULTIPLE CODING MODES," filed Jun. 13, 2007, and assigned to the assignee hereof.

REFERENCE TO CO-PENDING APPLICATIONS FOR PATENT

The present Application for Patent is related to the following co-pending U.S. patent applications:

U.S. patent application Ser. No. 11/674,745, entitled "SYSTEMS AND METHODS FOR MODIFYING A WINDOW WITH A FRAME ASSOCIATED WITH AN AUDIO SIGNAL" by Krishnan et al., and assigned to the assignee hereof.

BACKGROUND

Field

This disclosure relates to encoding of audio signals.

Background

Transmission of audio information, such as speech and/or music, by digital techniques has become widespread, particularly in long distance telephony, packet-switched telephony such as Voice over IP (also called VoIP, where IP denotes Internet Protocol), and digital radio telephony such as cellular telephony. Such proliferation has created interest in reducing the amount of information used to transfer a voice communication over a transmission channel while maintaining the perceived quality of the reconstructed speech. For example, it is desirable to make efficient use of available system bandwidth (especially in wireless systems). One way to use system bandwidth efficiently is to employ signal compression techniques. For systems that carry speech signals, speech compression (or "speech coding") techniques are commonly employed for this purpose.

Devices that are configured to compress speech by extracting parameters that relate to a model of human speech generation are often called audio coders, voice coders, codecs, vocoders, or speech coders, and the description that follows uses these terms interchangeably. An audio coder generally includes an encoder and a decoder. The encoder typically receives a digital audio signal as a series of blocks of samples called "frames," analyzes each frame to extract certain relevant parameters, and quantizes the parameters to produce a corresponding series of encoded frames. The encoded frames are transmitted over a transmission channel (i.e., a wired or wireless network connection) to a receiver that includes a decoder. Alternatively, the encoded audio signal may be stored for retrieval and decoding at a later time. The decoder receives and processes encoded frames, dequantizes them to produce the parameters, and recreates speech frames using the dequantized parameters.

Code-excited linear prediction (CELP) is a coding scheme that attempts to match the waveform of the original audio signal. It may be desirable to encode frames of a speech signal, especially voiced frames, using a variant of CELP that is called relaxed CELP ("RCELP"). In an RCELP coding scheme, the waveform-matching constraints are relaxed. An RCELP coding scheme is a pitch-regularizing (PR) coding scheme, in that the variation among pitch periods of the signal (also called the "delay contour") is regularized, typically by changing the relative positions of the pitch pulses to match or approximate a smoother, synthetic delay contour. Pitch regularization typically allows the pitch information to be encoded in fewer bits with little to no decrease in perceptual quality. Typically, no information specifying the regularization amounts is transmitted to the decoder. The following documents describe coding systems that include an RCELP coding scheme: the Third Generation Partnership Project 2 (3GPP2) document C.S0030-0, v3.0, entitled "Selectable Mode Vocoder (SMV) Service Option for Wideband Spread Spectrum Communication Systems," January 2004; and the 3GPP2 document C.S0014-C, v1.0, entitled "Enhanced Variable Rate Codec, Speech Service Options 3, 68, and 70 for Wideband Spread Spectrum Digital Systems," January 2007. Other coding schemes for voiced frames, including prototype waveform interpolation (PWI) schemes such as prototype pitch period (PPP), may also be implemented as PR (e.g., as described in part 4.2.4.3 of the 3GPP2 document C.S0014-C referenced above). Common ranges of pitch frequency for male speakers include 50 or 70 to 150 or 200 Hz, and common ranges of pitch frequency for female speakers include 120 or 140 to 300 or 400 Hz.*

Audio communications over the public switched telephone network ("PSTN") have traditionally been limited in bandwidth to the frequency range of 300-3400 kilohertz (kHz). More recent networks for audio communications, such as networks that use cellular telephony and/or VoIP, may not have the same bandwidth limits, and it may be desirable for apparatus using such networks to have the ability to transmit and receive audio communications that include a wideband frequency range. For example, it may be desirable for such apparatus to support an audio frequency range that extends down to 50 Hz and/or up to 7 or 8 kHz. It may also be desirable for such apparatus to support other applications, such as high-quality audio or audio/video conferencing, delivery of multimedia services such as music and/or television, etc., that may have audio speech content in ranges outside the traditional PSTN limits.

Extension of the range supported by a speech coder into higher frequencies may improve intelligibility. For example, the information in a speech signal that differentiates fricatives such as 's' and 'f' is largely in the high frequencies. Highband extension may also improve other qualities of the decoded speech signal, such as presence. For example, even a voiced vowel may have spectral energy far above the PSTN frequency range.

SUMMARY

A method of processing frames of an audio signal according to a general configuration includes encoding a first frame of the audio signal according to a pitch-regularizing ("PR") coding scheme; and encoding a second frame of the audio signal according to a non-PR coding scheme. In this method, the second frame follows and is consecutive to the first frame in the audio signal, and encoding a first frame includes time-modifying, based on a time shift, a segment of a first signal that is based on the first frame, where time-modifying includes one among (A) time-shifting the segment of the first frame according to the time shift and (B) time-warping the segment of the first signal based on the time shift. In this method, time-modifying a segment of a first signal includes changing a position of a pitch pulse of the segment relative to another pitch pulse of the first signal. In this method, encoding a second frame includes time-modifying, based on the time shift, a segment of a second signal that is based on the second frame, where time-modifying includes one among (A) time-shifting the segment of the second frame according to the time shift and (B) time-warping the segment of the second signal based on the time shift. Computer-readable media having instructions for processing frames of an audio signal in such manner, as well as apparatus and systems for processing frames of an audio signal in a similar manner, are also described.

A method of processing frames of an audio signal according to another general configuration includes encoding a first frame of the audio signal according to a first coding scheme; and encoding a second frame of the audio signal according to a PR coding scheme. In this method, the second frame follows and is consecutive to the first frame in the audio signal, and the first coding scheme is a non-PR coding scheme. In this method, encoding a first frame includes time-modifying, based on a first time shift, a segment of a first signal that is based on the first frame, where time-modifying includes one among (A) time-shifting the segment of the first signal according to the first time shift and (B) time-warping the segment of the first signal based on the first time shift. In this method, encoding a second frame includes time-modifying, based on a second time shift, a segment of a second signal that is based on the second frame, where time-modifying includes one among (A) time-shifting the segment of the second signal according to the second time shift and (B) time-warping the segment of the second signal based on the second time shift. In this method, time-modifying a segment of a second signal includes changing a position of a pitch pulse of the segment relative to another pitch pulse of the second signal, and the second time shift is based on information from the time-modified segment of the first signal. Computer-readable media having instructions for processing frames of an audio signal in such manner, as well as apparatus and systems for processing frames of an audio signal in a similar manner, are also described.

BRIEF DESCRIPTION OF THE DRAWINGS

FIG. 24*a* illustrates a flowchart of a method M200 of processing frames of an audio signal according to a general configuration.

FIG. 24*b* illustrates a flowchart of an implementation T622 of task T620.

FIG. 24*c* illustrates a flowchart of an implementation T624 of task T620.

FIG. 24*d* illustrates a flowchart of an implementation T626 of tasks T622 and T624.

DETAILED DESCRIPTION

Figure 1:
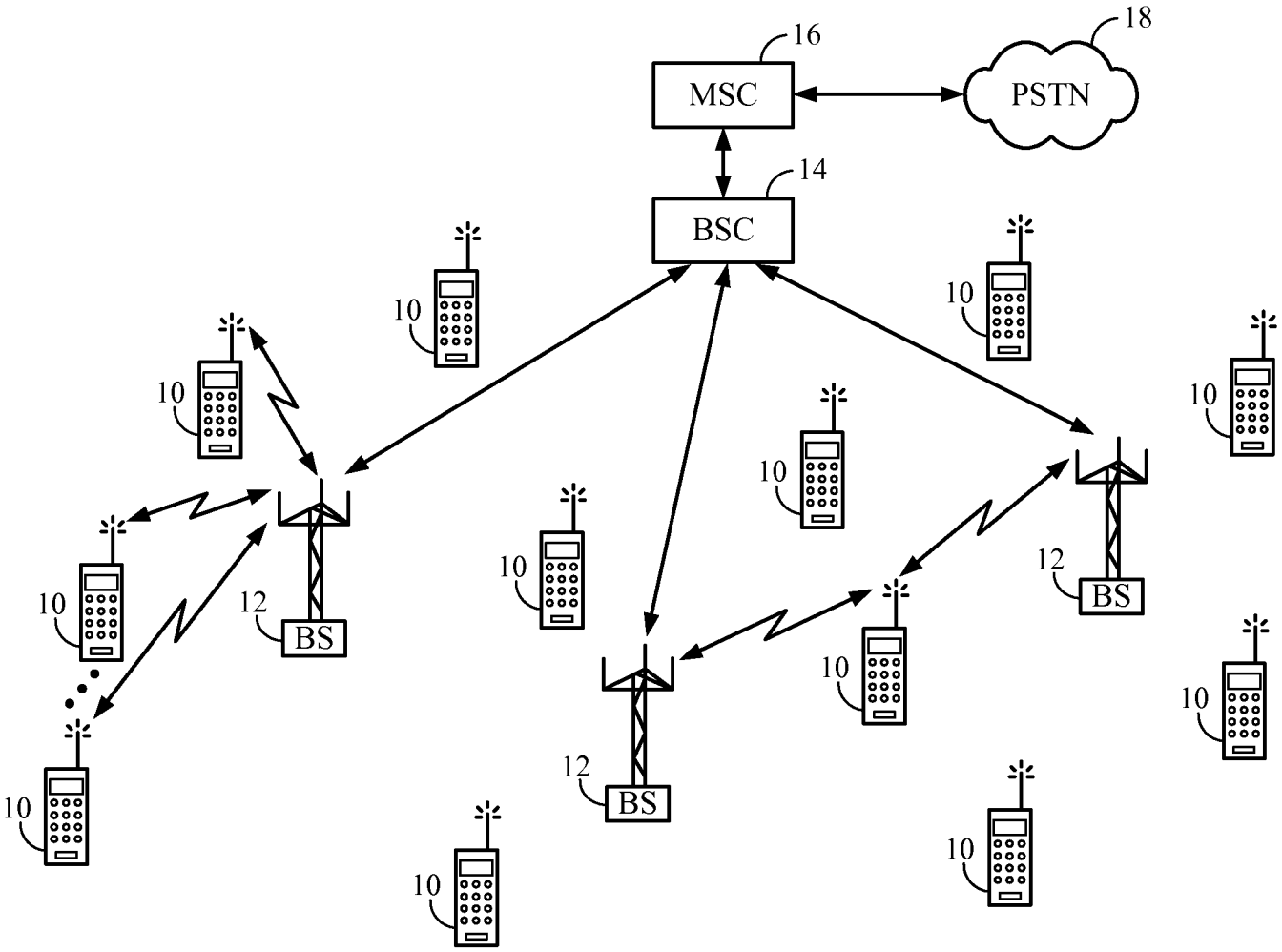
FIG. 1 illustrates an example of a wireless telephone system.

Systems, methods, and apparatus as described herein may be used to support increased perceptual quality during transitions between PR and non-PR coding schemes in a multi-mode audio coding system, especially for coding systems that include an overlap-and-add non-PR coding scheme such as a modified discrete cosine transform ("MDCT") coding scheme. The configurations described below reside in a wireless telephony communication system configured to employ a code-division multiple-access ("CDMA") over-the-air interface. Nevertheless, it would be understood by those skilled in the art that a method and apparatus having features as described herein may reside in any of the various communication systems employing a wide range of technologies known to those of skill in the art, such as systems employing Voice over IP ("VoIP") over wired and/or wireless (e.g., CDMA, TDMA, FDMA, and/or TD-SCDMA) transmission channels.

It is expressly contemplated and hereby disclosed that the configurations disclosed herein may be adapted for use in networks that are packet-switched (for example, wired and/or wireless networks arranged to carry audio transmissions according to protocols such as VoIP) and/or circuit-switched. It is also expressly contemplated and hereby disclosed that the configurations disclosed herein may be adapted for use in narrowband coding systems (e.g., systems that encode an audio frequency range of about four or five kilohertz) and for use in wideband coding systems (e.g., systems that encode audio frequencies greater than five kilohertz), including whole-band wideband coding systems and split-band wideband coding systems.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "A is based on B" is used to indicate any of its ordinary meanings, including the cases (i) "A is based on at least B" and (ii) "A is equal to B" (if appropriate in the particular context).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). For example, unless indicated otherwise, any disclosure of an audio encoder having a particular feature is also expressly intended to disclose a method of audio encoding having an analogous feature (and vice versa), and any disclosure of an audio encoder according to a particular configuration is also expressly intended to disclose a method of audio encoding according to an analogous configuration (and vice versa).

Any incorporation by reference of a portion of a document shall also be understood to incorporate definitions of terms or variables that are referenced within the portion, where such definitions appear elsewhere in the document.

The terms "coder," "codec," and "coding system" are used interchangeably to denote a system that includes at least one encoder configured to receive a frame of an audio signal (possibly after one or more pre-processing operations, such as a perceptual weighting and/or other filtering operation) and a corresponding decoder configured to produce a decoded representation of the frame.

As illustrated in FIG. 1, a wireless telephone system (e.g., a CDMA, TDMA, FDMA, and/or TD-SCDMA system) generally includes a plurality of mobile subscriber units 10 configured to communicate wirelessly with a radio access network that includes a plurality of base stations (BS) 12 and one or more base station controllers (BSCs) 14. Such a system also generally includes a mobile switching center (MSC) 16, coupled to the BSCs 14, that is configured to interface the radio access network with a conventional public switched telephone network (PSTN) 18. To support this interface, the MSC may include or otherwise communicate with a media gateway, which acts as a translation unit between the networks. A media gateway is configured to convert between different formats, such as different transmission and/or coding techniques (e.g., to convert between time-division-multiplexed ("TDM") voice and VoIP), and may also be configured to perform media streaming functions such as echo cancellation, dual-time multifrequency ("DTMF"), and tone sending. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. The collection of base stations 12, BSCs 14, MSC 16, and media gateways if any, is also referred to as "infrastructure."

Each base station 12 advantageously includes at least one sector (not shown), each sector comprising an omnidirectional antenna or an antenna pointed in a particular direction radially away from the base station 12. Alternatively, each sector may comprise two or more antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 typically include cellular and/or Personal Communications Service ("PCS") telephones, personal digital assistants ("PDAs"), and/or other devices having mobile telephonic capability. Such a unit 10 may include an internal speaker and microphone, a tethered handset or headset that includes a speaker and microphone (e.g., a USB handset), or a wireless headset that includes a speaker and microphone (e.g., a headset that communicates audio information to the unit using a version of the Bluetooth protocol as promulgated by the Bluetooth Special Interest Group, Bellevue, Wash.). Such a system may be configured for use in accordance with one or more versions of the IS-95 standard (e.g., IS-95, IS-95A, IS-95B, cdma2000; as published by the Telecommunications Industry Alliance, Arlington, Va.).

A typical operation of the cellular telephone system is now described. The base stations 12 receive sets of reverse link signals from sets of mobile subscriber units 10. The mobile subscriber units 10 are conducting telephone calls or other communications. Each reverse link signal received by a given base station 12 is processed within that base station 12, and the resulting data is forwarded to a BSC 14. The BSC 14 provides call resource allocation and mobility management functionality, including the orchestration of soft handoffs between base stations 12. The BSC 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile subscriber units 10.

Figure 2:
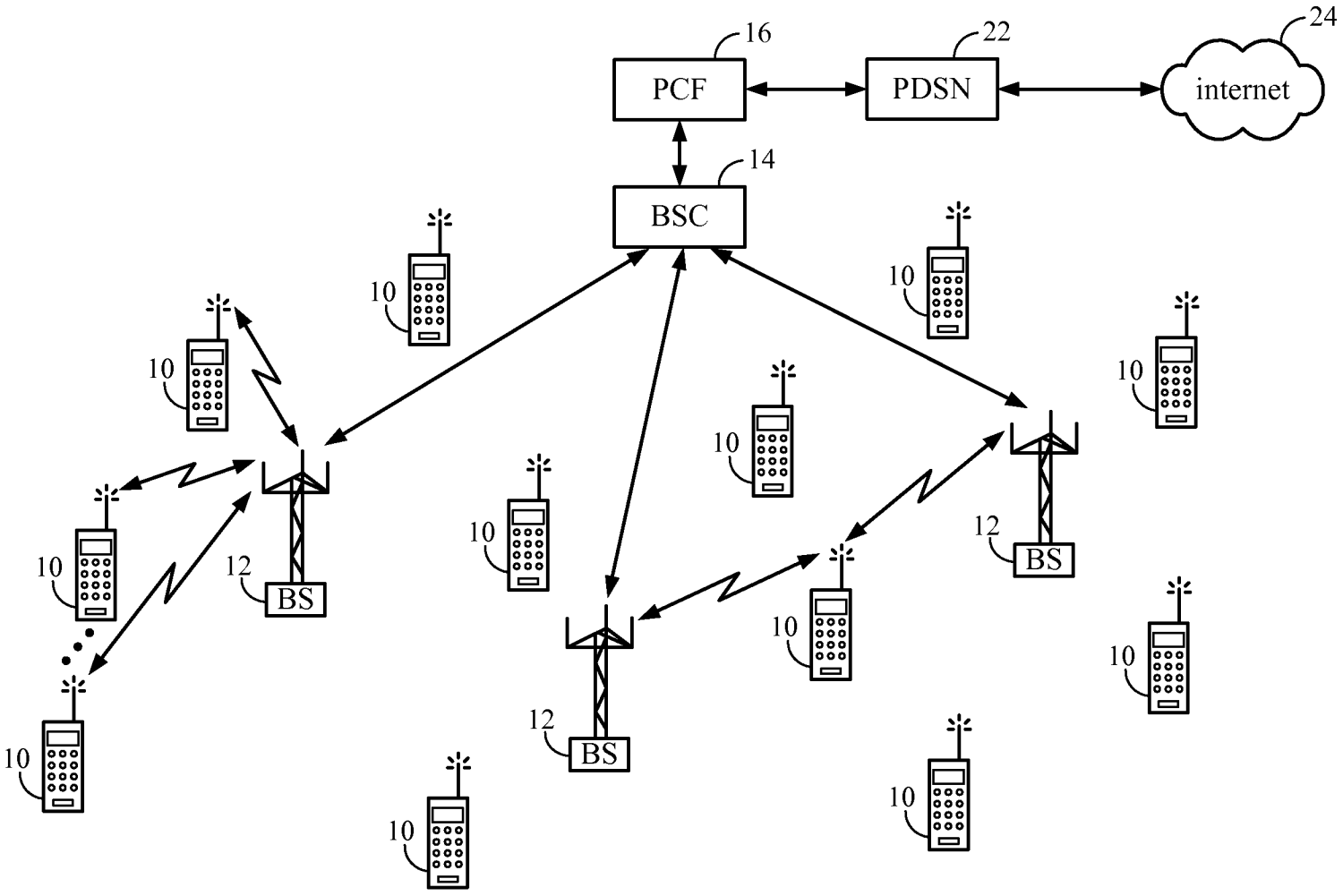
FIG. 2 illustrates an example of a cellular telephony system that is configured to support packet-switched data communications.

Elements of a cellular telephony system as shown in FIG. 1 may also be configured to support packet-switched data communications. As shown in FIG. 2, packet data traffic is generally routed between mobile subscriber units 10 and an external packet data network 24 (e.g., a public network such as the Internet) using a packet data serving node (PDSN) 22 that is coupled to a gateway router connected to the packet data network. The PDSN 22 in turn routes data to one or more packet control functions (PCFs) 20, which each serve one or more BSCs 14 and act as a link between the packet data network and the radio access network. Packet data network 24 may also be implemented to include a local area network ("LAN"), a campus area network ("CAN"), a metropolitan area network ("MAN"), a wide area network ("WAN"), a ring network, a star network, a token ring network, etc. A user terminal connected to network 24 may be a PDA, a laptop computer, a personal computer, a gaming device (examples of such a device include the XBOX and XBOX 360 (Microsoft Corp., Redmond, Wash.), the Playstation 3 and Playstation Portable (Sony Corp., Tokyo, JP), and the Wii and DS (Nintendo, Kyoto, JP)), and/or any device having audio processing capability and may be configured to support a telephone call or other communication using one or more protocols such as VoIP. Such a terminal may include an internal speaker and microphone, a tethered handset that includes a speaker and microphone (e.g., a USB handset), or a wireless headset that includes a speaker and microphone (e.g., a headset that communicates audio information to the terminal using a version of the Bluetooth protocol as promulgated by the Bluetooth Special Interest Group, Bellevue, Wash.). Such a system may be configured to carry a telephone call or other communication as packet data traffic between mobile subscriber units on different radio access networks (e.g., via one or more protocols such as VoIP), between a mobile subscriber unit and a non-mobile user terminal, or between two non-mobile user terminals, without ever entering the PSTN. A mobile subscriber unit 10 or other user terminal may also be referred to as an "access terminal."

Figure 3A:
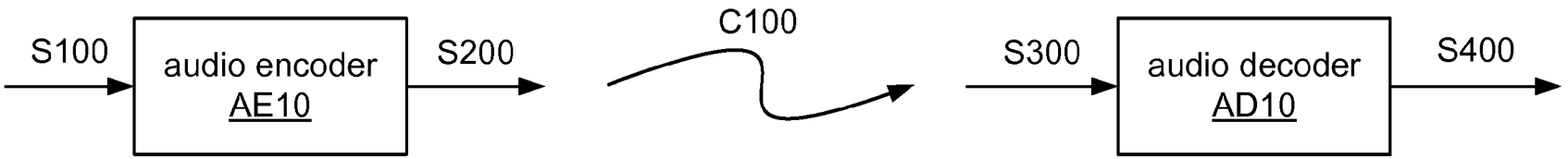
FIG. 3*a* illustrates a block diagram of a coding system that includes an audio encoder AE10 and an audio decoder AD10.

FIG. 3*a* illustrates an audio encoder AE10 that is arranged to receive a digitized audio signal S100 (e.g., as a series of frames) and to produce a corresponding encoded signal S200 (e.g., as a series of corresponding encoded frames) for transmission on a communication channel C100 (e.g., a wired, optical, and/or wireless communications link) to an audio decoder AD10. Audio decoder AD10 is arranged to decode a received version S300 of encoded audio signal S200 and to synthesize a corresponding output speech signal S400.

Audio signal S100 represents an analog signal (e.g., as captured by a microphone) that has been digitized and quantized in accordance with any of various methods known in the art, such as pulse code modulation ("PCM"), companded mu-law, or A-law. The signal may also have undergone other pre-processing operations in the analog and/or digital domain, such as noise suppression, perceptual weighting, and/or other filtering operations. Additionally or alternatively, such operations may be performed within audio encoder AE10. An instance of audio signal S100 may also represent a combination of analog signals (e.g., as captured by an array of microphones) that have been digitized and quantized.

Figure 3B:
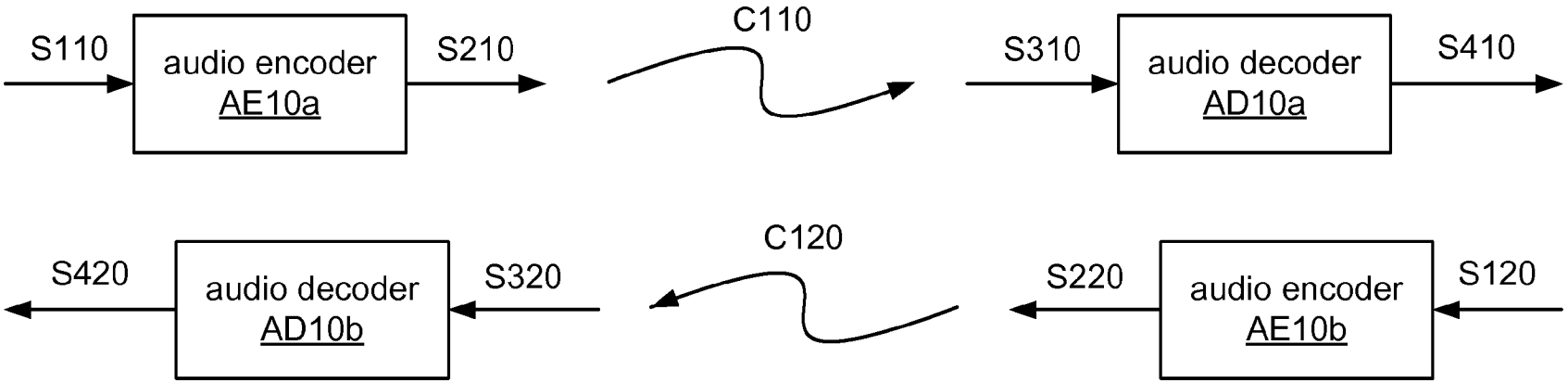
FIG. 3*b* illustrates a block diagram of a pair of coding systems.

FIG. 3*b* illustrates a first instance AE10*a* of an audio encoder AE10 that is arranged to receive a first instance S110 of digitized audio signal S100 and to produce a corresponding instance S210 of encoded signal S200 for transmission on a first instance C110 of communication channel C100 to a first instance AD10*a* of audio decoder AD10. Audio decoder AD10*a* is arranged to decode a received version S310 of encoded audio signal S210 and to synthesize a corresponding instance S410 of output speech signal S400.

FIG. 3*b* also illustrates a second instance AE10*b* of an audio encoder AE10 that is arranged to receive a second instance S120 of digitized audio signal S100 and to produce a corresponding instance S220 of encoded signal S200 for transmission on a second instance C120 of communication channel C100 to a second instance AD10*b* of audio decoder AD10. Audio decoder AD10*b* is arranged to decode a received version S320 of encoded audio signal S220 and to synthesize a corresponding instance S420 of output speech signal S400.

Audio encoder AE10*a* and audio decoder AD10*b* (similarly, audio encoder AE10*b* and audio decoder AD10*a*) may be used together in any communication device for transmitting and receiving speech signals, including, for example, the subscriber units, user terminals, media gateways, BTSs, or BSCs described above with reference to FIGS. 1 and 2. As described herein, audio encoder AE10 may be implemented in many different ways, and audio encoders AE10*a* and AE10*b* may be instances of different implementations of audio encoder AE10. Likewise, audio decoder AD10 may be implemented in many different ways, and audio decoders AD10*a* and AD10*b* may be instances of different implementations of audio decoder AD10.

An audio encoder (e.g., audio encoder AE10) processes the digital samples of an audio signal as a series of frames of input data, wherein each frame comprises a predetermined number of samples. This series is usually implemented as a nonoverlapping series, although an operation of processing a frame or a segment of a frame (also called a subframe) may also include segments of one or more neighboring frames in its input. The frames of an audio signal are typically short enough that the spectral envelope of the signal may be expected to remain relatively stationary over the frame. A frame typically corresponds to between five and thirty-five milliseconds of the audio signal (or about forty to two hundred samples), with twenty milliseconds being a common frame size for telephony applications. Other examples of a common frame size include ten and thirty milliseconds. Typically all frames of an audio signal have the same length, and a uniform frame length is assumed in the particular examples described herein. However, it is also expressly contemplated and hereby disclosed that non-uniform frame lengths may be used.

A frame length of twenty milliseconds corresponds to 140 samples at a sampling rate of seven kilohertz (kHz), 160 samples at a sampling rate of eight kHz (one typical sampling rate for a narrowband coding system), and 320 samples at a sampling rate of 16 kHz (one typical sampling rate for a wideband coding system), although any sampling rate deemed suitable for the particular application may be used. Another example of a sampling rate that may be used for speech coding is 12.8 kHz, and further examples include other rates in the range of from 12.8 kHz to 38.4 kHz.

In a typical audio communications session, such as a telephone call, each speaker is silent for about sixty percent of the time. An audio encoder for such an application will usually be configured to distinguish frames of the audio signal that contain speech or other information ("active frames") from frames of the audio signal that contain only background noise or silence ("inactive frames"). It may be desirable to implement audio encoder AE10 to use different coding modes and/or bit rates to encode active frames and inactive frames. For example, audio encoder AE10 may be implemented to use fewer bits (i.e., a lower bit rate) to encode an inactive frame than to encode an active frame. It may also be desirable for audio encoder AE10 to use different bit rates to encode different types of active frames. In such cases, lower bit rates may be selectively employed for frames containing relatively less speech information. Examples of bit rates commonly used to encode active frames include 171 bits per frame, eighty bits per frame, and forty bits per frame; and examples of bit rates commonly used to encode inactive frames include sixteen bits per frame. In the context of cellular telephony systems (especially systems that are compliant with Interim Standard (IS)-95 as promulgated by the Telecommunications Industry Association, Arlington, Va., or a similar industry standard), these four bit rates are also referred to as "full rate," "half rate," "quarter rate," and "eighth rate," respectively.

It may be desirable for audio encoder AE10 to classify each active frame of an audio signal as one of several different types. These different types may include frames of voiced speech (e.g., speech representing a vowel sound), transitional frames (e.g., frames that represent the beginning or end of a word), frames of unvoiced speech (e.g., speech representing a fricative sound), and frames of non-speech information (e.g., music, such as singing and/or musical instruments, or other audio content). It may be desirable to implement audio encoder AE10 to use different coding modes to encode different types of frames. For example, frames of voiced speech tend to have a periodic structure that is long-term (i.e., that continues for more than one frame period) and is related to pitch, and it is typically more efficient to encode a voiced frame (or a sequence of voiced frames) using a coding mode that encodes a description of this long-term spectral feature. Examples of such coding modes include code-excited linear prediction ("CELP"), prototype waveform interpolation ("PWI"), and prototype pitch period ("PPP"). Unvoiced frames and inactive frames, on the other hand, usually lack any significant long-term spectral feature, and an audio encoder may be configured to encode these frames using a coding mode that does not attempt to describe such a feature. Noise-excited linear prediction ("NELP") is one example of such a coding mode. Frames of music usually contain mixtures of different tones, and an audio encoder may be configured to encode these frames (or residuals of LPC analysis operations on these frames) using a method based on a sinusoidal decomposition such as a Fourier or cosine transform. One such example is a coding mode based on the modified discrete cosine transform ("MDCT").

Audio encoder AE10, or a corresponding method of audio encoding, may be implemented to select among different combinations of bit rates and coding modes (also called "coding schemes"). For example, audio encoder AE10 may be implemented to use a full-rate CELP scheme for frames containing voiced speech and for transitional frames, a half-rate NELP scheme for frames containing unvoiced speech, an eighth-rate NELP scheme for inactive frames, and a full-rate MDCT scheme for generic audio frames (e.g., including frames containing music). Alternatively, such an implementation of audio encoder AE10 may be configured to use a full-rate PPP scheme for at least some frames containing voiced speech, especially for highly voiced frames.

Audio encoder AE10 may also be implemented to support multiple bit rates for each of one or more coding schemes, such as full-rate and half-rate CELP schemes and/or full-rate and quarter-rate PPP schemes. Frames in a series that includes a period of stable voiced speech tend to be largely redundant, for example, such that at least some of them may be encoded at less than full rate without a noticeable loss of perceptual quality.

Multi-mode audio coders (including audio coders that support multiple bit rates and/or coding modes) typically provide efficient audio coding at low bit rates. Skilled artisans will recognize that increasing the number of coding schemes will allow greater flexibility when choosing a coding scheme, which can result in a lower average bit rate. However, an increase in the number of coding schemes will correspondingly increase the complexity within the overall system. The particular combination of available schemes used in any given system will be dictated by the available system resources and the specific signal environment. Examples of multi-mode coding techniques are described in, for example, U.S. Pat. No. 6,691,084, entitled "VARIABLE RATE SPEECH CODING," and in U.S. Publication No. 2007/0171931, entitled "ARBITRARY AVERAGE DATA RATES FOR VARIABLE RATE CODERS."

Figure 4A:
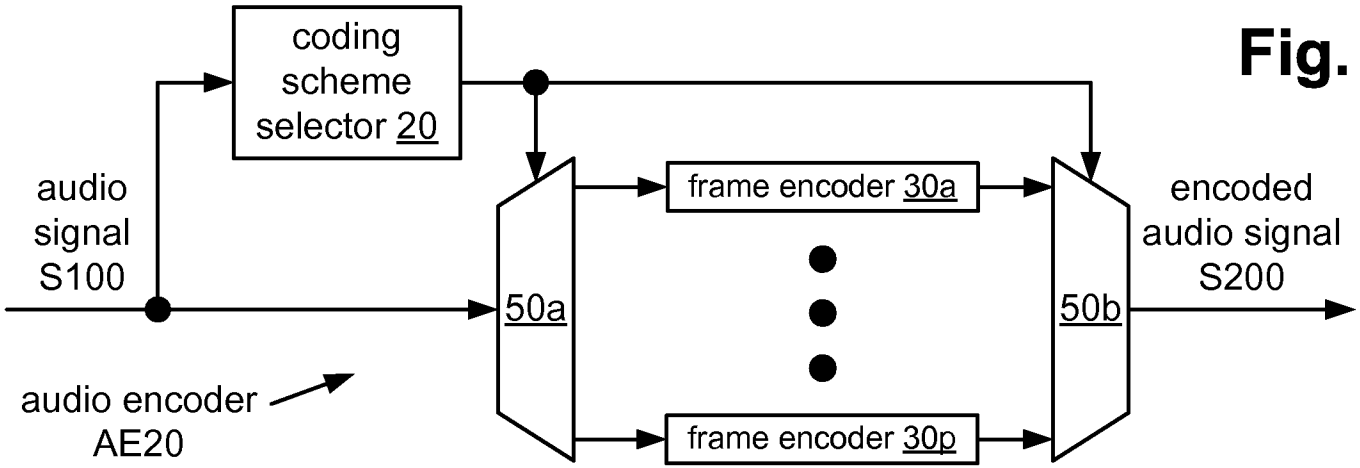
FIG. 4*a* illustrates a block diagram of a multi-mode implementation AE20 of audio encoder AE10.

FIG. 4*a* illustrates a block diagram of a multi-mode implementation AE20 of audio encoder AE10. Encoder AE20 includes a coding scheme selector 20 and a plurality p of frame encoders 30*a*-30*p*. Each of the p frame encoders is configured to encode a frame according to a respective coding mode, and a coding scheme selection signal produced by coding scheme selector 20 is used to control a pair of selectors 50*a* and 50*b* of audio encoder AE20 to select the desired coding mode for the current frame. Coding scheme selector 20 may also be configured to control the selected frame encoder to encode the current frame at a selected bit rate. It is noted that a software or firmware implementation of audio encoder AE20 may use the coding scheme indication to direct the flow of execution to one or another of the frame decoders, and that such an implementation may not include an analog for selector 50*a* and/or for selector 50*b*. Two or more (possibly all) of the frame encoders 30*a*-30*p* may share common structure, such as a calculator of LPC coefficient values (possibly configured to produce a result having a different order for different coding schemes, such as a higher order for speech and non-speech frames than for inactive frames) and/or an LPC residual generator.

Coding scheme selector 20 typically includes an open-loop decision module that examines the input audio frame and makes a decision regarding which coding mode or scheme to apply to the frame. This module is typically configured to classify frames as active or inactive and may also be configured to classify an active frame as one of two or more different types, such as voiced, unvoiced, transitional, or generic audio. The frame classification may be based on one or more characteristics of the current frame, and/or of one or more previous frames, such as overall frame energy, frame energy in each of two or more different frequency bands, signal-to-noise ratio ("SNR"), periodicity, and zero-crossing rate. Coding scheme selector 20 may be implemented to calculate values of such characteristics, to receive values of such characteristics from one or more other modules of audio encoder AE20, and/or to receive values of such characteristics from one or more other modules of a device that includes audio encoder AE20 (e.g., a cellular telephone). The frame classification may include comparing a value or magnitude of such a characteristic to a threshold value and/or comparing the magnitude of a change in such a value to a threshold value.

The open-loop decision module may be configured to select a bit rate at which to encode a particular frame according to the type of speech the frame contains. Such operation is called "variable-rate coding." For example, it may be desirable to configure audio encoder AD20 to encode a transitional frame at a higher bit rate (e.g., full rate), to encode an unvoiced frame at a lower bit rate (e.g., quarter rate), and to encode a voiced frame at an intermediate bit rate (e.g., half rate) or at a higher bit rate (e.g., full rate). The bit rate selected for a particular frame may also depend on such criteria as a desired average bit rate, a desired pattern of bit rates over a series of frames (which may be used to support a desired average bit rate), and/or the bit rate selected for a previous frame.

Coding scheme selector 20 may also be implemented to perform a closed-loop coding decision, in which one or more measures of encoding performance are obtained after full or partial encoding using the open-loop selected coding scheme. Performance measures that may be considered in the closed-loop test include, for example, SNR, SNR prediction in encoding schemes such as the PPP speech encoder, prediction error quantization SNR, phase quantization SNR, amplitude quantization SNR, perceptual SNR, and normalized cross-correlation between current and past frames as a measure of stationarity. Coding scheme selector 20 may be implemented to calculate values of such characteristics, to receive values of such characteristics from one or more other modules of audio encoder AE20, and/or to receive values of such characteristics from one or more other modules of a device that includes audio encoder AE20 (e.g., a cellular telephone). If the performance measure falls below a threshold value, the bit rate and/or coding mode may be changed to one that is expected to give better quality. Examples of closed-loop classification schemes that may be used to maintain the quality of a variable-rate multi-mode audio coder are described in U.S. Pat. No. 6,330,532 entitled "METHOD AND APPARATUS FOR MAINTAINING A TARGET BIT RATE IN A SPEECH CODER," and in U.S. Pat. No. 5,911,128 entitled "METHOD AND APPARATUS FOR PERFORMING SPEECH FRAME ENCODING MODE SELECTION IN A VARIABLE RATE ENCODING SYSTEM."

Figure 4B:
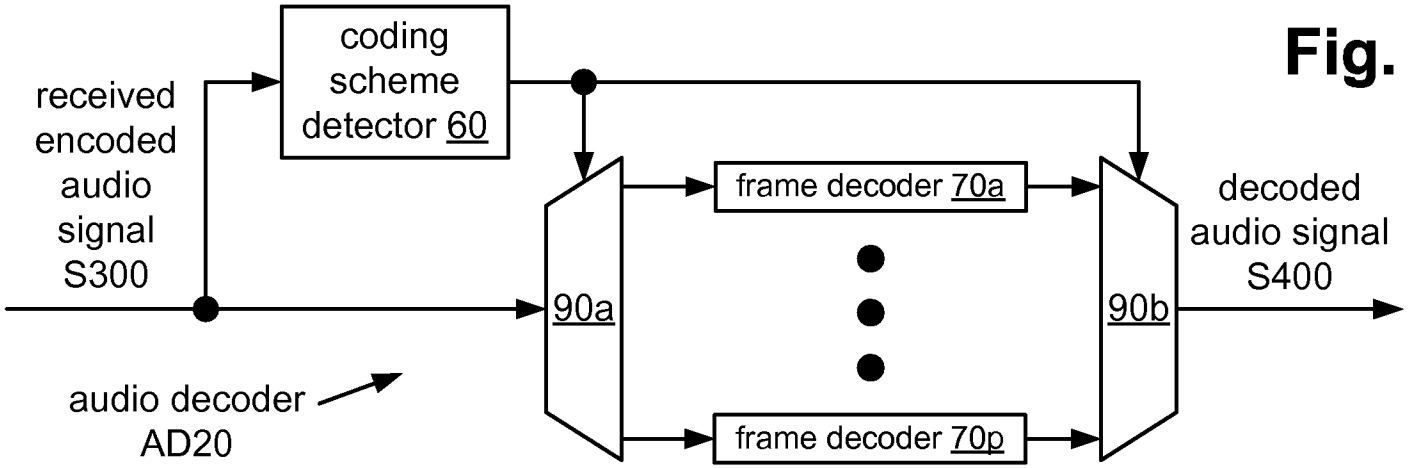
FIG. 4*b* illustrates a block diagram of a multi-mode implementation AD20 of audio decoder AD10.

FIG. 4*b* illustrates a block diagram of an implementation AD20 of audio decoder AD10 that is configured to process received encoded audio signal S300 to produce a corresponding decoded audio signal S400. Audio decoder AD20 includes a coding scheme detector 60 and a plurality p of frame decoders 70*a*-70*p*. Decoders 70*a*-70*p* may be configured to correspond to the encoders of audio encoder AE20 as described above, such that frame decoder 70*a* is configured to decode frames that have been encoded by frame encoder 30*a*, and so on. Two or more (possibly all) of the frame decoders 70*a*-70*p* may share common structure, such as a synthesis filter configurable according to a set of decoded LPC coefficient values. In such case, the frame decoders may differ primarily in the techniques they use to generate the excitation signal that excites the synthesis filter to produce the decoded audio signal. Audio decoder AD20 typically also includes a postfilter that is configured to process decoded audio signal S400 to reduce quantization noise (e.g., by emphasizing formant frequencies and/or attenuating spectral valleys) and may also include adaptive gain control. A device that includes audio decoder AD20 (e.g., a cellular telephone) may include a digital-to-analog converter ("DAC") configured and arranged to produce an analog signal from decoded audio signal S400 for output to an earpiece, speaker, or other audio transducer, and/or an audio output jack located within a housing of the device. Such a device may also be configured to perform one or more analog processing operations on the analog signal (e.g., filtering, equalization, and/or amplification) before it is applied to the jack and/or transducer.

Coding scheme detector 60 is configured to indicate a coding scheme that corresponds to the current frame of received encoded audio signal S300. The appropriate coding bit rate and/or coding mode may be indicated by a format of the frame. Coding scheme detector 60 may be configured to perform rate detection or to receive a rate indication from another part of an apparatus within which audio decoder AD20 is embedded, such as a multiplex sublayer. For example, coding scheme detector 60 may be configured to receive, from the multiplex sublayer, a packet type indicator that indicates the bit rate. Alternatively, coding scheme detector 60 may be configured to determine the bit rate of an encoded frame from one or more parameters such as frame energy. In some applications, the coding system is configured to use only one coding mode for a particular bit rate, such that the bit rate of the encoded frame also indicates the coding mode. In other cases, the encoded frame may include information, such as a set of one or more bits, that identifies the coding mode according to which the frame is encoded. Such information (also called a "coding index") may indicate the coding mode explicitly or implicitly (e.g., by indicating a value that is invalid for other possible coding modes).

FIG. 4*b* illustrates an example in which a coding scheme indication produced by coding scheme detector 60 is used to control a pair of selectors 90*a* and 90*b* of audio decoder AD20 to select one among frame decoders 70*a*-70*p*. It is noted that a software or firmware implementation of audio decoder AD20 may use the coding scheme indication to direct the flow of execution to one or another of the frame decoders, and that such an implementation may not include an analog for selector 90*a* and/or for selector 90*b*.

Figure 5A:
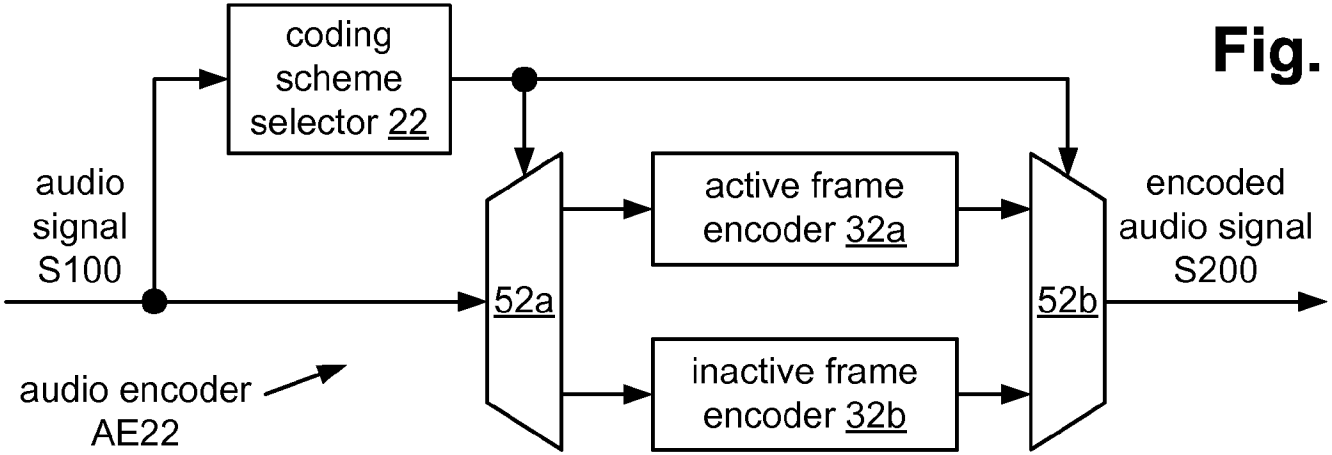
FIG. 5*a* illustrates a block diagram of an implementation AE22 of audio encoder AE20.

FIG. 5*a* illustrates a block diagram of an implementation AE22 of multi-mode audio encoder AE20 that includes implementations 32*a*, 32*b* of frame encoders 30*a*, 30*b*. In this example, an implementation 22 of coding scheme selector 20 is configured to distinguish active frames of audio signal S100 from inactive frames. Such an operation is also called "voice activity detection," and coding scheme selector 22 may be implemented to include a voice activity detector. For example, coding scheme selector 22 may be configured to output a binary-valued coding scheme selection signal that is high for active frames (indicating selection of active frame encoder 32*a*) and low for inactive frames (indicating selection of inactive frame encoder 32*b*), or vice versa. In this example, the coding scheme selection signal produced by coding scheme selector 22 is used to control implementations 52*a*, 52*b* of selectors 50*a*, 50*b* such that each frame of audio signal S100 is encoded by the selected one among active frame encoder 32*a* (e.g., a CELP encoder) and inactive frame encoder 32*b* (e.g., a NELP encoder).

Coding scheme selector 22 may be configured to perform voice activity detection based on one or more characteristics of the energy and/or spectral content of the frame such as frame energy, signal-to-noise ratio ("SNR"), periodicity, spectral distribution (e.g., spectral tilt), and/or zero-crossing rate. Coding scheme selector 22 may be implemented to calculate values of such characteristics, to receive values of such characteristics from one or more other modules of audio encoder AE22, and/or to receive values of such characteristics from one or more other modules of a device that includes audio encoder AE22 (e.g., a cellular telephone). Such detection may include comparing a value or magnitude of such a characteristic to a threshold value and/or comparing the magnitude of a change in such a characteristic (e.g., relative to the preceding frame) to a threshold value. For example, coding scheme selector 22 may be configured to evaluate the energy of the current frame and to classify the frame as inactive if the energy value is less than (alternatively, not greater than) a threshold value. Such a selector may be configured to calculate the frame energy as a sum of the squares of the frame samples.

Another implementation of coding scheme selector 22 is configured to evaluate the energy of the current frame in each of a low-frequency band (e.g., 300 Hz to 2 kHz) and a high-frequency band (e.g., 2 kHz to 4 kHz) and to indicate that the frame is inactive if the energy value for each band is less than (alternatively, not greater than) a respective threshold value. Such a selector may be configured to calculate the frame energy in a band by applying a passband filter to the frame and calculating a sum of the squares of the samples of the filtered frame. One example of such a voice activity detection operation is described in section 4.7 of the Third Generation Partnership Project 2 (3GPP2) standards document C.S0014-C, v1.0.

Additionally or in the alternative, the voice activity detection operation may be based on information from one or more previous frames and/or one or more subsequent frames. For example, it may be desirable to configure coding scheme selector 22 to classify a frame as active or inactive based on a value of a frame characteristic that is averaged over two or more frames. It may be desirable to configure coding scheme selector 22 to classify a frame using a threshold value that is based on information from a previous frame (e.g., background noise level, SNR). It may also be desirable to configure coding scheme selector 22 to classify as active one or more of the first frames that follow a transition in audio signal S100 from active frames to inactive frames. The act of continuing a previous classification state in such manner after a transition is also called a "hangover."

Figure 5B:
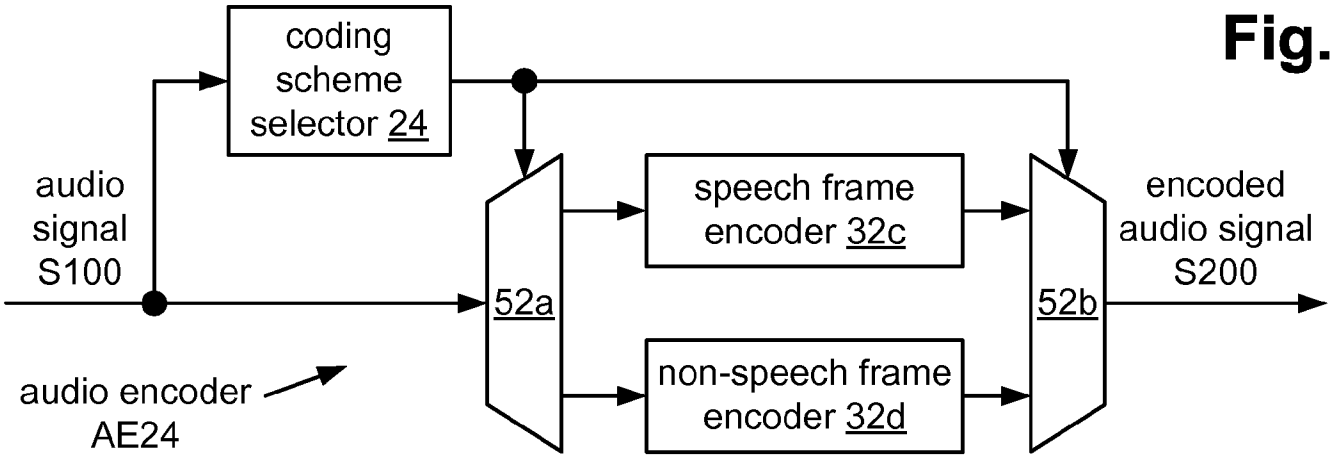
FIG. 5*b* illustrates a block diagram of an implementation AE24 of audio encoder AE20.

FIG. 5*b* illustrates a block diagram of an implementation AE24 of multi-mode audio encoder AE20 that includes implementations 32*c*, 32*d* of frame encoders 30*c*, 30*d*. In this example, an implementation 24 of coding scheme selector 20 is configured to distinguish speech frames of audio signal S100 from non-speech frames (e.g., music). For example, coding scheme selector 24 may be configured to output a binary-valued coding scheme selection signal that is high for speech frames (indicating selection of a speech frame encoder 32*c*, such as a CELP encoder) and low for non-speech frames (indicating selection of a non-speech frame encoder 32*d*, such as an MDCT encoder), or vice versa. Such classification may be based on one or more characteristics of the energy and/or spectral content of the frame such as frame energy, pitch, periodicity, spectral distribution (e.g., cepstral coefficients, LPC coefficients, line spectral frequencies ("LSFs")), and/or zero-crossing rate. Coding scheme selector 24 may be implemented to calculate values of such characteristics, to receive values of such characteristics from one or more other modules of audio encoder AE24, and/or to receive values of such characteristics from one or more other modules of a device that includes audio encoder AE24 (e.g., a cellular telephone). Such classification may include comparing a value or magnitude of such a characteristic to a threshold value and/or comparing the magnitude of a change in such a characteristic (e.g., relative to the preceding frame) to a threshold value. Such classification may be based on information from one or more previous frames and/or one or more subsequent frames, which may be used to update a multi-state model such as a hidden Markov model).

Figure 6A:
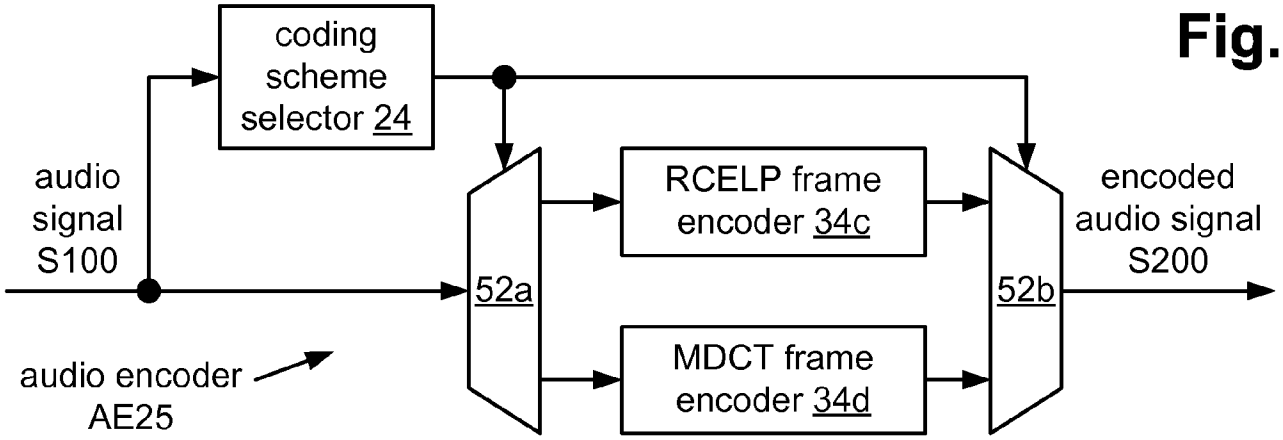
FIG. 6*a* illustrates a block diagram of an implementation AE25 of audio encoder AE24.

In this example, the coding scheme selection signal produced by coding scheme selector 24 is used to control selectors 52*a*, 52*b* such that each frame of audio signal S100 is encoded by the selected one among speech frame encoder 32*c* and non-speech frame encoder 32*d*. FIG. 6*a* illustrates a block diagram of an implementation AE25 of audio encoder AE24 that includes an RCELP implementation 34*c* of speech frame encoder 32*c* and an MDCT implementation 34*d* of non-speech frame encoder 32*d*.

Figure 6B:
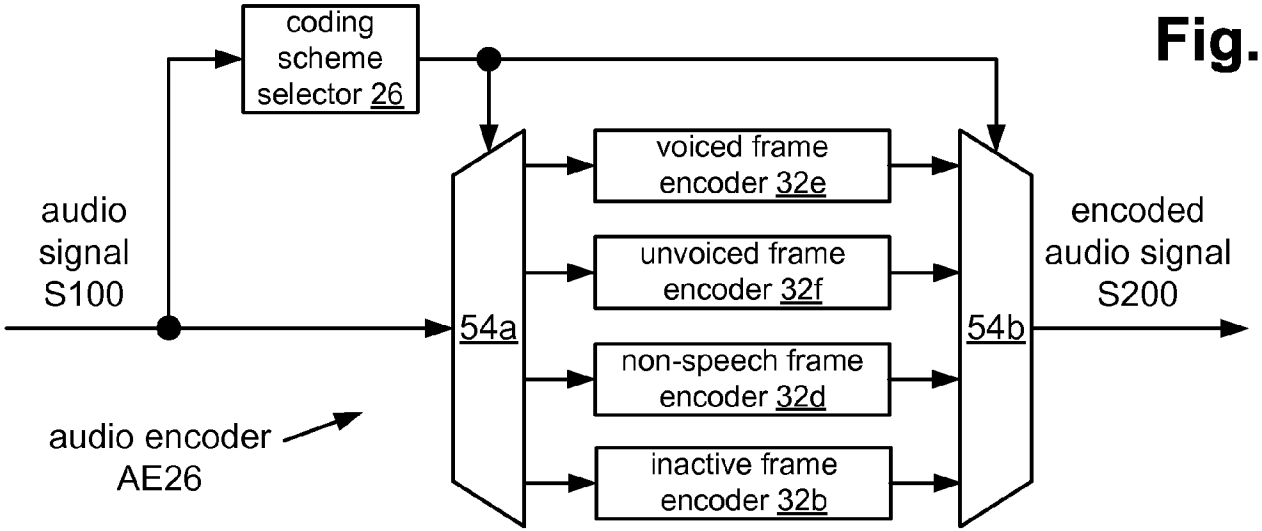
FIG. 6*b* illustrates a block diagram of an implementation AE26 of audio encoder AE20.

FIG. 6*b* illustrates a block diagram of an implementation AE26 of multi-mode audio encoder AE20 that includes implementations 32*b*, 32*d*, 32*e*, 32*f* of frame encoders 30*b*, 30*d*, 30*e*, 30*f*. In this example, an implementation 26 of coding scheme selector 20 is configured to classify frames of audio signal S100 as voiced speech, unvoiced speech, inactive speech, and non-speech. Such classification may be based on one or more characteristics of the energy and/or spectral content of the frame as mentioned above, may include comparing a value or magnitude of such a characteristic to a threshold value and/or comparing the magnitude of a change in such a characteristic (e.g., relative to the preceding frame) to a threshold value, and may be based on information from one or more previous frames and/or one or more subsequent frames. Coding scheme selector 26 may be implemented to calculate values of such characteristics, to receive values of such characteristics from one or more other modules of audio encoder AE26, and/or to receive values of such characteristics from one or more other modules of a device that includes audio encoder AE26 (e.g., a cellular telephone). In this example, the coding scheme selection signal produced by coding scheme selector 26 is used to control implementations 54*a*, 54*b* of selectors 50*a*, 50*b* such that each frame of audio signal S100 is encoded by the selected one among voiced frame encoder 32*e* (e.g., a CELP or relaxed CELP ("RCELP") encoder), unvoiced frame encoder 32*f* (e.g., a NELP encoder), non-speech frame encoder 32*d*, and inactive frame encoder 32*b* (e.g., a low-rate NELP encoder).

An encoded frame as produced by audio encoder AE10 typically contains a set of parameter values from which a corresponding frame of the audio signal may be reconstructed. This set of parameter values typically includes spectral information, such as a description of the distribution of energy within the frame over a frequency spectrum. Such a distribution of energy is also called a "frequency envelope" or "spectral envelope" of the frame. The description of a spectral envelope of a frame may have a different form and/or length depending on the particular coding scheme used to encode the corresponding frame. Audio encoder AE10 may be implemented to include a packetizer (not shown) that is configured to arrange the set of parameter values into a packet, such that the size, format, and contents of the packet correspond to the particular coding scheme selected for that frame. A corresponding implementation of audio decoder AD10 may be implemented to include a depacketizer (not shown) that is configured to separate the set of parameter values from other information in the packet such as a header and/or other routing information.

An audio encoder such as audio encoder AE10 is typically configured to calculate a description of a spectral envelope of a frame as an ordered sequence of values. In some implementations, audio encoder AE10 is configured to calculate the ordered sequence such that each value indicates an amplitude or magnitude of the signal at a corresponding frequency or over a corresponding spectral region. One example of such a description is an ordered sequence of Fourier or discrete cosine transform coefficients.

In other implementations, audio encoder AE10 is configured to calculate the description of a spectral envelope as an ordered sequence of values of parameters of a coding model, such as a set of values of coefficients of a linear prediction coding ("LPC") analysis. The LPC coefficient values indicate resonances of the audio signal, also called "formants." An ordered sequence of LPC coefficient values is typically arranged as one or more vectors, and the audio encoder may be implemented to calculate these values as filter coefficients or as reflection coefficients. The number of coefficient values in the set is also called the "order" of the LPC analysis, and examples of a typical order of an LPC analysis as performed by an audio encoder of a communications device (such as a cellular telephone) include four, six, eight, ten, 12, 16, 20, 24, 28, and 32.

A device that includes an implementation of audio encoder AE10 is typically configured to transmit the description of a spectral envelope across a transmission channel in quantized form (e.g., as one or more indices into corresponding lookup tables or "codebooks"). Accordingly, it may be desirable for audio encoder AE10 to calculate a set of LPC coefficient values in a form that may be quantized efficiently, such as a set of values of line spectral pairs ("LSPs"), LSFs, immittance spectral pairs ("ISPs"), immittance spectral frequencies ("ISFs"), cepstral coefficients, or log area ratios. Audio encoder AE10 may also be configured to perform one or more other processing operations, such as a perceptual weighting or other filtering operation, on the ordered sequence of values before conversion and/or quantization.

In some cases, a description of a spectral envelope of a frame also includes a description of temporal information of the frame (e.g., as in an ordered sequence of Fourier or discrete cosine transform coefficients). In other cases, the set of parameters of a packet may also include a description of temporal information of the frame. The form of the description of temporal information may depend on the particular coding mode used to encode the frame. For some coding modes (e.g., for a CELP or PPP coding mode, and for some MDCT coding modes), the description of temporal information may include a description of an excitation signal to be used by the audio decoder to excite an LPC model (e.g., a synthesis filter configured according to the description of the spectral envelope). A description of an excitation signal is usually based on a residual of an LPC analysis operation on the frame. A description of an excitation signal typically appears in a packet in quantized form (e.g., as one or more indices into corresponding codebooks) and may include information relating to at least one pitch component of the excitation signal. For a PPP coding mode, for example, the encoded temporal information may include a description of a prototype to be used by an audio decoder to reproduce a pitch component of the excitation signal. For an RCELP or PPP coding mode, the encoded temporal information may include one or more pitch period estimates. A description of information relating to a pitch component typically appears in a packet in quantized form (e.g., as one or more indices into corresponding codebooks).

The various elements of an implementation of audio encoder AE10 may be embodied in any combination of hardware, software, and/or firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips). The same applies for the various elements of an implementation of a corresponding audio decoder AD10.

One or more elements of the various implementations of audio encoder AE10 as described herein may also be implemented in whole or in part as one or more sets of instructions arranged to execute on one or more fixed or programmable arrays of logic elements, such as microprocessors, embedded processors, IP cores, digital signal processors, field-programmable gate arrays ("FPGAs"), application-specific standard products ("ASSPs"), and application-specific integrated circuits ("ASICs"). Any of the various elements of an implementation of audio encoder AE10 may also be embodied as one or more computers (e.g., machines including one or more arrays programmed to execute one or more sets or sequences of instructions, also called "processors"), and any two or more, or even all, of these elements may be implemented within the same such computer or computers. The same applies for the elements of the various implementations of a corresponding audio decoder AD10.

The various elements of an implementation of audio encoder AE10 may be included within a device for wired and/or wireless communications, such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as interleaving, puncturing, convolution coding, error correction coding, coding of one or more layers of network protocol (e.g., Ethernet, TCP/IP, cdma2000), modulation of one or more radio-frequency ("RF") and/or optical carriers, and/or transmission of one or more modulated carriers over a channel.

The various elements of an implementation of audio decoder AD10 may be included within a device for wired and/or wireless communications, such as a cellular telephone or other device having such communications capability. Such a device may be configured to communicate with circuit-switched and/or packet-switched networks (e.g., using one or more protocols such as VoIP). Such a device may be configured to perform operations on a signal carrying the encoded frames such as deinterleaving, de-puncturing, convolution decoding, error correction decoding, decoding of one or more layers of network protocol (e.g., Ethernet, TCP/IP, cdma2000), demodulation of one or more radio-frequency ("RF") and/or optical carriers, and/or reception of one or more modulated carriers over a channel.

It is possible for one or more elements of an implementation of audio encoder AE10 to be used to perform tasks or execute other sets of instructions that are not directly related to an operation of the apparatus, such as a task relating to another operation of a device or system in which the apparatus is embedded. It is also possible for one or more elements of an implementation of audio encoder AE10 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). The same applies for the elements of the various implementations of a corresponding audio decoder AD10. In one such example, coding scheme selector 20 and frame encoders 30*a*-30*p* are implemented as sets of instructions arranged to execute on the same processor. In another such example, coding scheme detector 60 and frame decoders 70*a*-70*p* are implemented as sets of instructions arranged to execute on the same processor. Two or more among frame encoders 30*a*-30*p* may be implemented to share one or more sets of instructions executing at different times; the same applies for frame decoders 70*a*-70*p*.

Figure 7B:
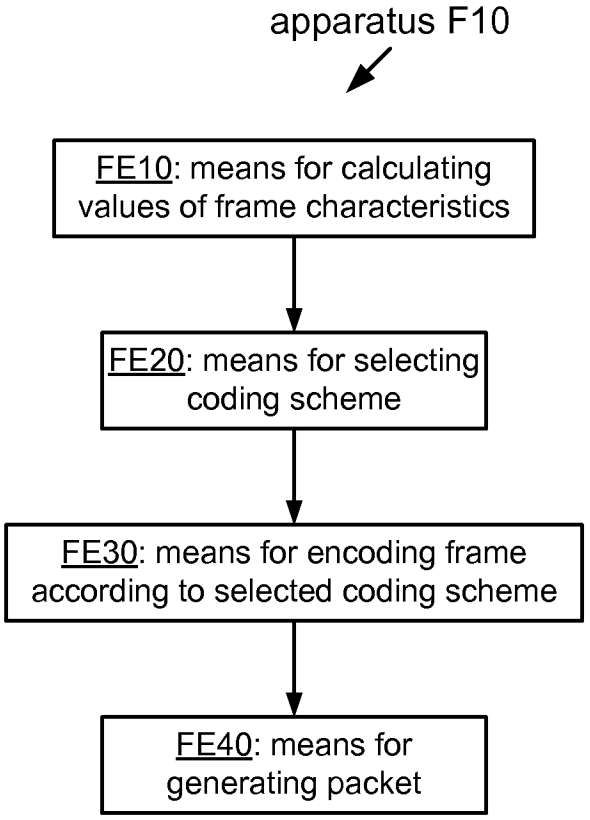
FIG. 7*b* illustrates a block diagram of an apparatus F10 configured to encode a frame of an audio signal.
Figure 7A:
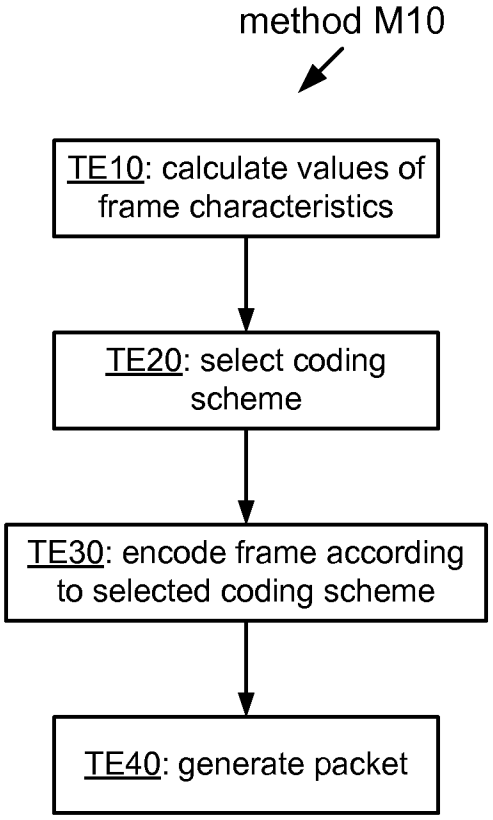
FIG. 7*a* illustrates a flowchart of a method M10 of encoding a frame of an audio signal.

FIG. 7*a* illustrates a flowchart of a method of encoding a frame of an audio signal M10. Method M10 includes a task TE10 that calculates values of frame characteristics as described above, such as energy and/or spectral characteristics. Based on the calculated values, task TE20 selects a coding scheme (e.g., as described above with reference to various implementations of coding scheme selector 20). Task TE30 encodes the frame according to the selected coding scheme (e.g., as described herein with reference to various implementations of frame encoders 30*a*-30*p*) to produce an encoded frame. An optional task TE40 generates a packet that includes the encoded frame. Method M10 may be configured (e.g., iterated) to encode each in a series of frames of the audio signal.

In a typical application of an implementation of method M10, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of method M10 may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive encoded frames.

FIG. 7*b* illustrates a block diagram of an apparatus F10 that is configured to encode a frame of an audio signal. Apparatus F10 includes means for calculating values of frame characteristics FE10, such as energy and/or spectral characteristics as described above. Apparatus F10 also includes means for selecting a coding scheme FE20 based on the calculated values (e.g., as described above with reference to various implementations of coding scheme selector 20). Apparatus F10 also includes means for encoding the frame according to the selected coding scheme FE30 (e.g., as described herein with reference to various implementations of frame encoders 30*a*-30*p*) to produce an encoded frame. Apparatus F10 also includes an optional means for generating a packet that includes the encoded frame FE40. Apparatus F10 may be configured to encode each in a series of frames of the audio signal.

In a typical implementation of a PR coding scheme such as an RCELP coding scheme or a PR implementation of a PPP coding scheme, the pitch period is estimated once every frame or subframe, using a pitch estimation operation that may be correlation-based. It may be desirable to center the pitch estimation window at the boundary of the frame or subframe. Typical divisions of a frame into subframes include three subframes per frame (e.g., 53, 53, and 54 samples for each of the nonoverlapping subframe of a 160-sample frame), four subframes per frame, and five subframes per frame (e.g., five 32-sample nonoverlapping subframes in a 160-sample frame). It may also be desirable to check for consistency among the estimated pitch periods to avoid errors such as pitch halving, pitch doubling, pitch tripling, etc. Between the pitch estimation updates, the pitch period is interpolated to produce a synthetic delay contour. Such interpolation may be performed on a sample-by-sample basis or on a less frequent (e.g., every second or third sample) or more frequent basis (e.g., at a subsample resolution). The Enhanced Variable Rate Codec ("EVRC") described in the 3GPP2 document C.S0014-C referenced above, for example, uses a synthetic delay contour that is eight-times oversampled. Typically the interpolation is a linear or bilinear interpolation, and it may be performed using one or more polyphase interpolation filters or another suitable technique. A PR coding scheme such as RCELP is typically configured to encode frames at full rate or half rate, although implementations that encode at other rates such as quarter rate are also possible.

Using a continuous pitch contour with unvoiced frames may cause undesirable artifacts such as buzzing. For unvoiced frames, therefore, it may be desirable to use a constant pitch period within each subframe, switching abruptly to another constant pitch period at the subframe boundary. Typical examples of such a technique use a pseudorandom sequence of pitch periods that range from 20 samples to 40 samples (at an 8 kHz sampling rate) which repeats every 40 milliseconds. A voice activity detection ("VAD") operation as described above may be configured to distinguish voiced frames from unvoiced frames, and such an operation is typically based on such factors as autocorrelation of speech and/or residual, zero crossing rate, and/or first reflection coefficient.

A PR coding scheme (e.g., RCELP) performs a time-warping of the speech signal. In this time-warping operation, which is also called "signal modification," different time shifts are applied to different segments of the signal such that the original time relations between features of the signal (e.g., pitch pulses) are altered. For example, it may be desirable to time-warp a signal such that its pitch-period contour matches the synthetic pitch-period contour. The value of the time shift is typically within the range of a few milliseconds positive to a few milliseconds negative. It is typical for a PR encoder (e.g., an RCELP encoder) to modify the residual rather than the speech signal, as it may be desirable to avoid changing the positions of the formants. However, it is expressly contemplated and hereby disclosed that the arrangements claimed below may also be practiced using a PR encoder (e.g., an RCELP encoder) that is configured to modify the speech signal.

It may be expected that the best results would be obtained by modifying the residual using a continuous warping. Such a warping may be performed on a sample-by-sample basis or by compressing and expanding segments of the residual (e.g., subframes or pitch periods).

Figure 8:
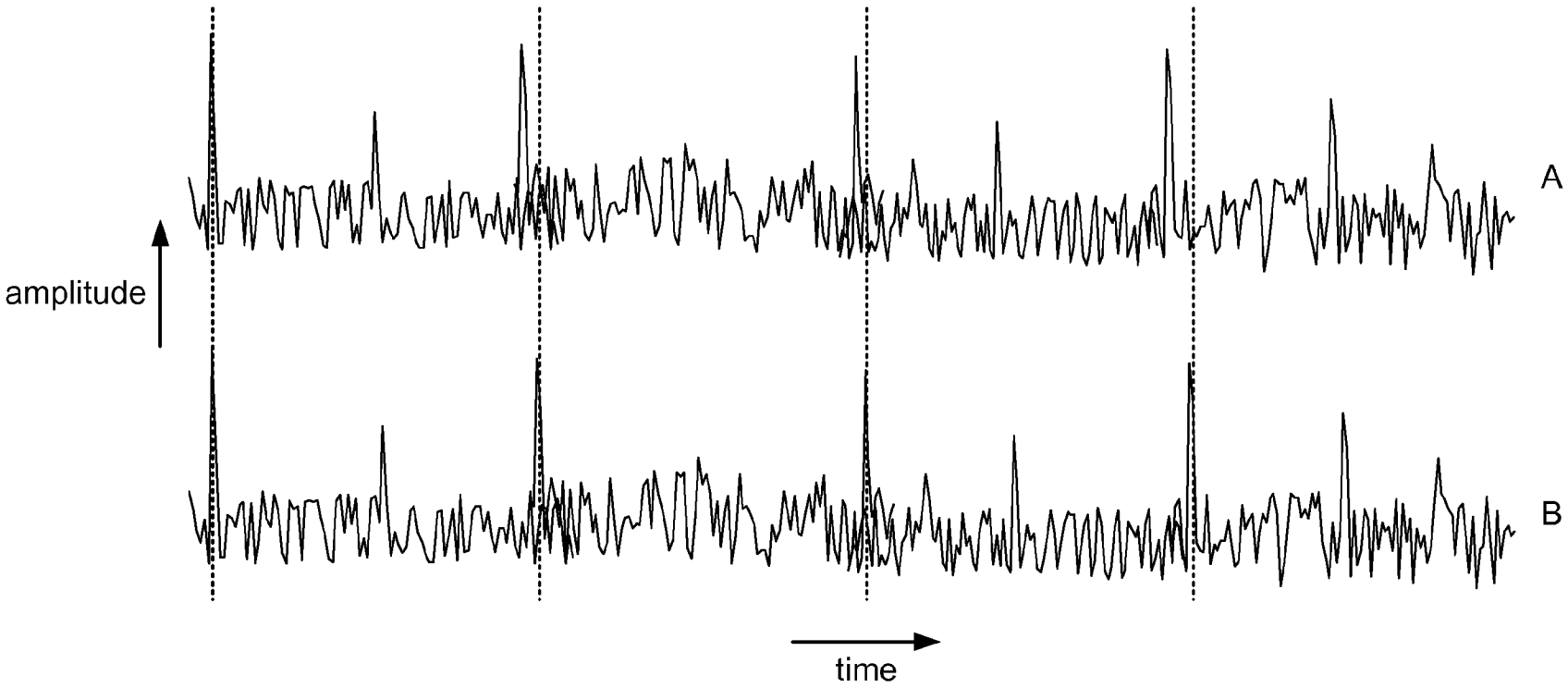
FIG. 8 illustrates an example of a residual before and after being time-warped to a delay contour.

FIG. 8 illustrates an example of a residual before (waveform A) and after being time-warped to a smooth delay contour (waveform B). In this example, the intervals between the vertical dotted lines indicate a regular pitch period.

Continuous warping may be too computationally intensive to be practical in portable, embedded, real-time, and/or battery-powered applications. Therefore, it is more typical for an RCELP or other PR encoder to perform piecewise modification of the residual by time-shifting segments of the residual such that the amount of the time-shift is constant across each segment (although it is expressly contemplated and hereby disclosed that the arrangements claimed below may also be practiced using an RCELP or other PR encoder that is configured to modify a speech signal, or to modify a residual, using continuous warping). Such an operation may be configured to modify the current residual by shifting segments so that each pitch pulse matches a corresponding pitch pulse in a target residual, where the target residual is based on the modified residual from a previous frame, subframe, shift frame, or other segment of the signal.

Figure 9:
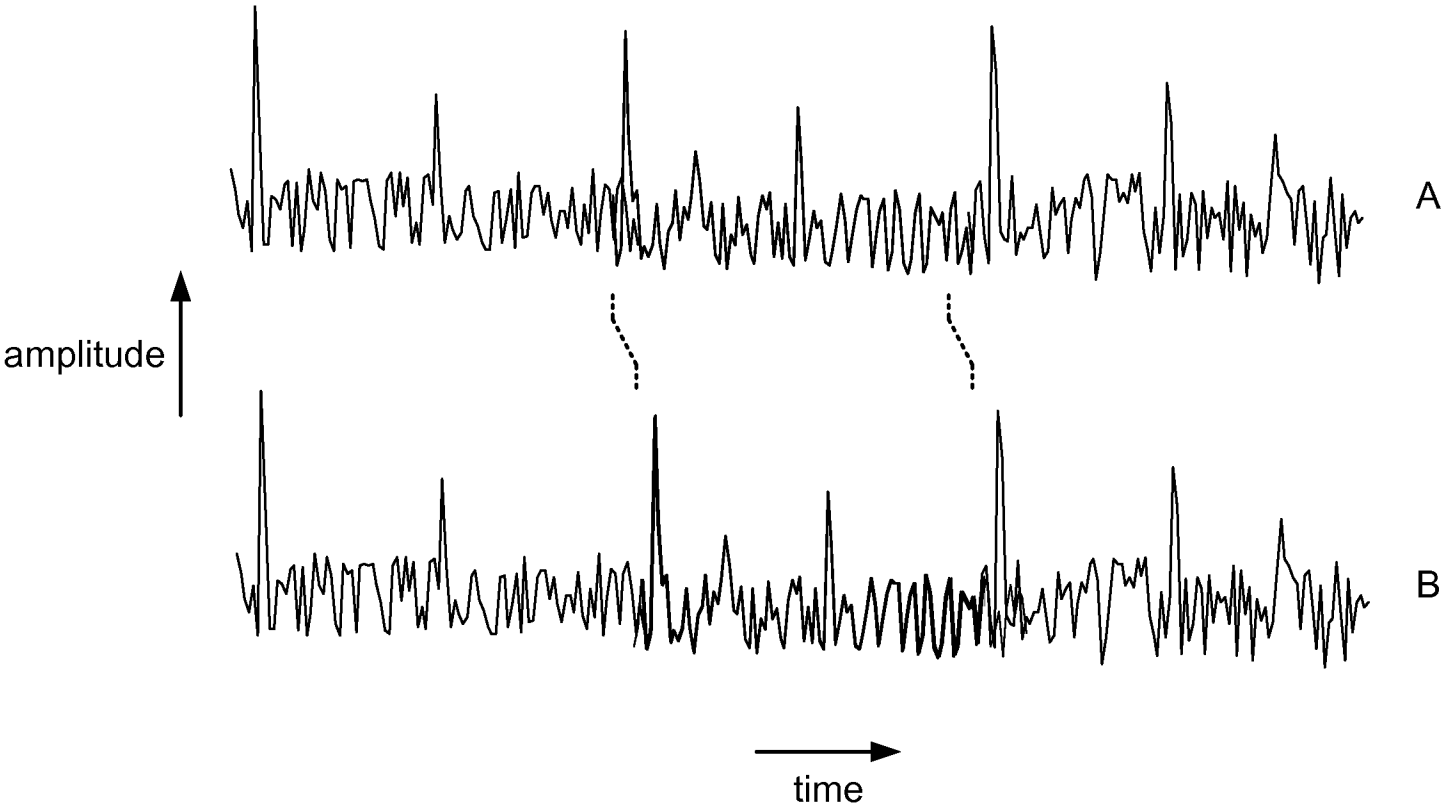
FIG. 9 illustrates an example of a residual before and after piecewise modification.

FIG. 9 illustrates an example of a residual before (waveform A) and after piecewise modification (waveform B). In this figure, the dotted lines illustrate how the segment shown in bold is shifted to the right in relation to the rest of the residual. It may be desirable for the length of each segment to be less than the pitch period (e.g., such that each shift segment contains no more than one pitch pulse). It may also be desirable to prevent segment boundaries from occurring at pitch pulses (e.g., to confine the segment boundaries to low-energy regions of the residual).

A piecewise modification procedure typically includes selecting a segment that includes a pitch pulse (also called a "shift frame"). One example of such an operation is described in section 4.11.6.2 (pp. 4-95 to 4-99) of the EVRC document C.S0014-C referenced above, which section is hereby incorporated by reference as an example. Typically the last modified sample (or the first unmodified sample) is selected as the beginning of the shift frame. In the EVRC example, the segment selection operation searches the current subframe residual for a pulse to be shifted (e.g., the first pitch pulse in a region of the subframe that has not yet been modified) and sets the end of the shift frame relative to the position of this pulse. A subframe may contain multiple shift frames, such that the shift frame selection operation (and subsequent operations of the piecewise modification procedure) may be performed several times on a single subframe.

A piecewise modification procedure typically includes an operation to match the residual to the synthetic delay contour. One example of such an operation is described in section 4.11.6.3 (pp. 4-99 to 4-101) of the EVRC document C.S0014-C referenced above, which section is hereby incorporated by reference as an example. This example generates a target residual by retrieving the modified residual of the previous subframe from a buffer and mapping it to the delay contour (e.g., as described in section 4.11.6.1 (pp. 4-95) of the EVRC document C.S0014-C referenced above, which section is hereby incorporated by reference as an example). In this example, the matching operation generates a temporary modified residual by shifting a copy of the selected shift frame, determining an optimal shift according to a correlation between the temporary modified residual and the target residual, and calculating a time shift based on the optimal shift. The time shift is typically an accumulated value, such that the operation of calculating a time shift involves updating an accumulated time shift based on the optimal shift (as described, for example, in part 4.11.6.3.4 of section 4.11.6.3 incorporated by reference above).

For each shift frame of the current residual, the piecewise modification is achieved by applying the corresponding calculated time shift to a segment of the current residual that corresponds to the shift frame. One example of such a modification operation is described in section 4.11.6.4 (pp. 4-101) of the EVRC document C.S0014-C referenced above, which section is hereby incorporated by reference as an example. Typically the time shift has a value that is fractional, such that the modification procedure is performed at a resolution higher than the sampling rate. In such case, it may be desirable to apply the time shift to the corresponding segment of the residual using an interpolation such as linear or bilinear interpolation, which may be performed using one or more polyphase interpolation filters or another suitable technique.

Figure 10:
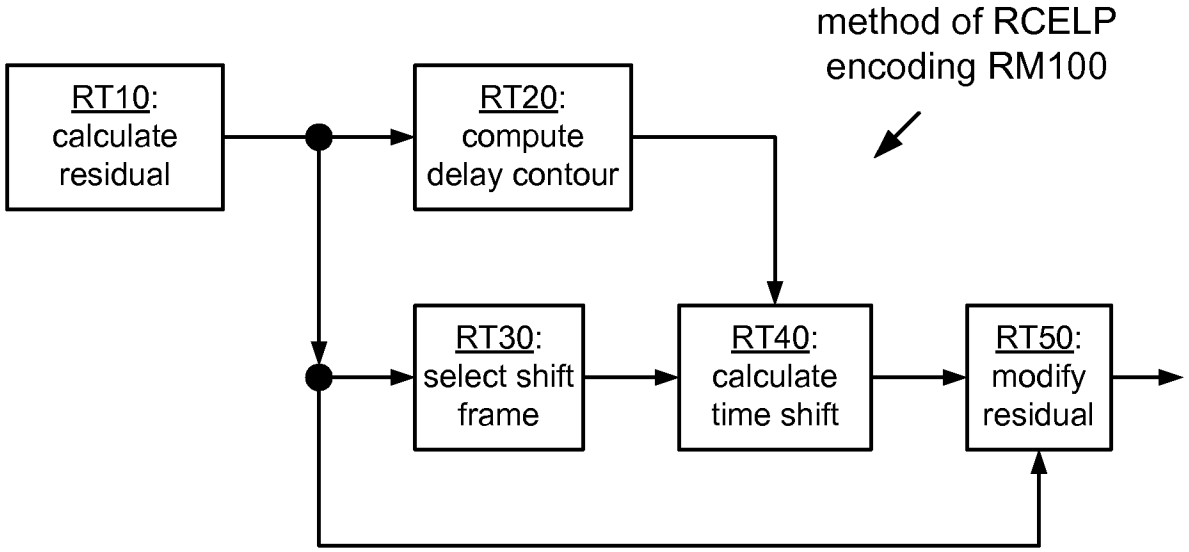
FIG. 10 illustrates a flowchart of a method of RCELP encoding RM100.

FIG. 10 illustrates a flowchart of a method of RCELP encoding RM100 according to a general configuration (e.g., an RCELP implementation of task TE30 of method M10). Method RM100 includes a task RT10 that calculates a residual of the current frame. Task RT10 is typically arranged to receive a sampled audio signal (which may be pre-processed), such as audio signal S100. Task RT10 is typically implemented to include a linear prediction coding ("LPC") analysis operation and may be configured to produce a set of LPC parameters such as line spectral pairs ("LSPs"). Task RT10 may also include other processing operations such as one or more perceptual weighting and/or other filtering operations.

Method RM100 also includes a task RT20 that calculates a synthetic delay contour of the audio signal, a task RT30 that selects a shift frame from the generated residual, a task RT40 that calculates a time shift based on information from the selected shift frame and delay contour, and a task RT50 that modifies a residual of the current frame based on the calculated time shift.

Figure 11:
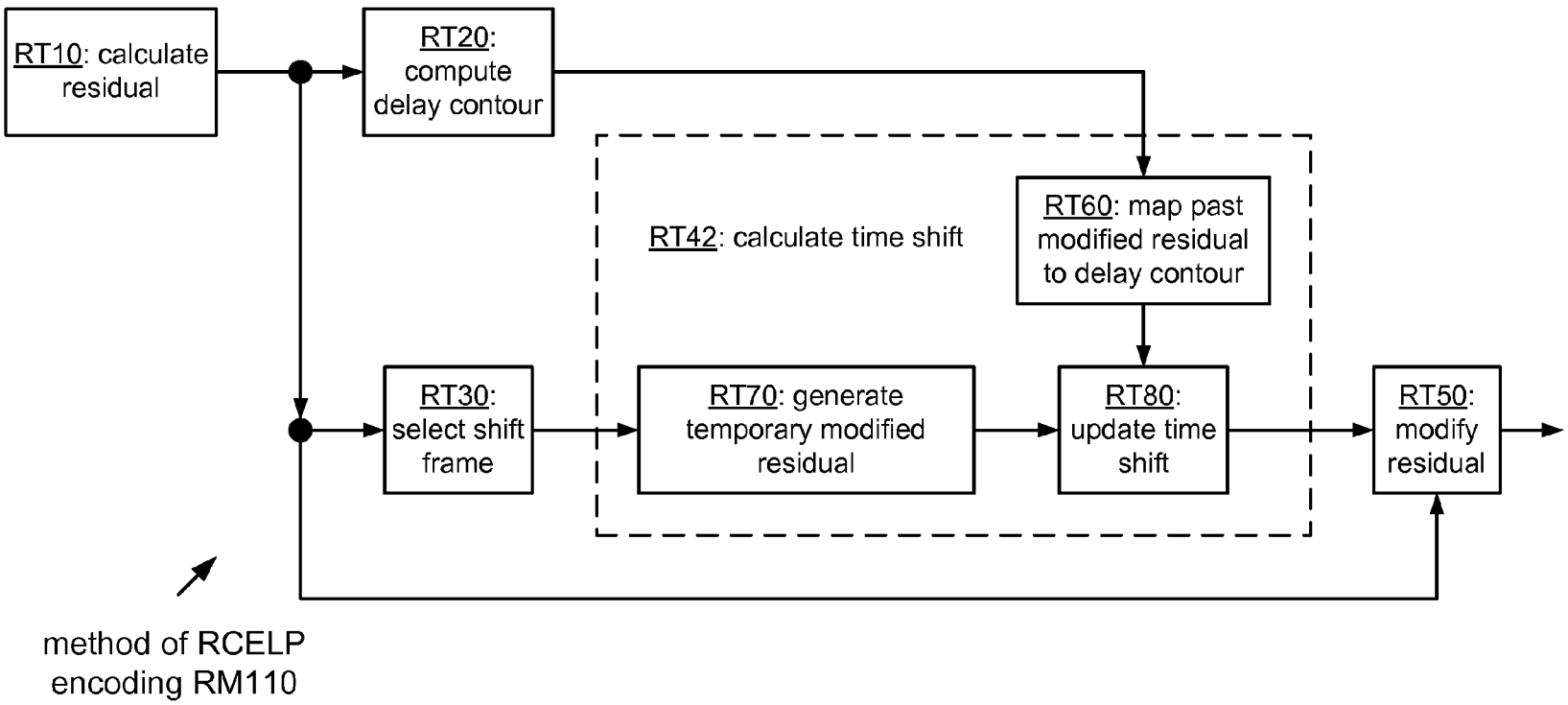
FIG. 11 illustrates a flowchart of an implementation RM110 of RCELP encoding method RM100.

FIG. 11 illustrates a flowchart of an implementation RM110 of RCELP encoding method RM100. Method RM110 includes an implementation RT42 of time shift calculation task RT40. Task RT42 includes a task RT60 that maps the modified residual of the previous subframe to the synthetic delay contour of the current subframe, a task RT70 that generates a temporary modified residual (e.g., based on the selected shift frame), and a task RT80 that updates the time shift (e.g., based on a correlation between the temporary modified residual and a corresponding segment of the mapped past modified residual). An implementation of method RM100 may be included within an implementation of method M10 (e.g., within encoding task TE30), and as noted above, an array of logic elements (e.g., logic gates) may be configured to perform one, more than one, or even all of the various tasks of the method.

Figure 12A:
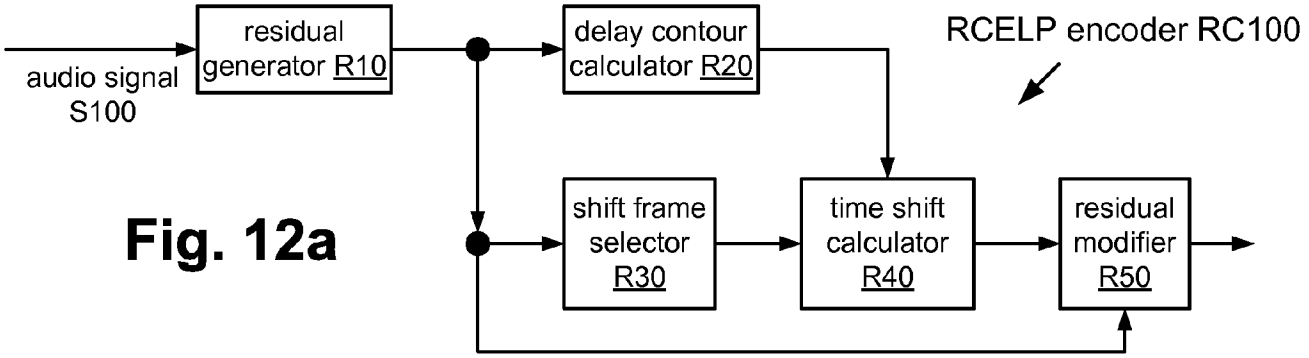
FIG. 12*a* illustrates a block diagram of an implementation RC100 of RCELP frame encoder 34*c*.

FIG. 12*a* illustrates a block diagram of an implementation RC100 of RCELP frame encoder 34*c*. Encoder RC100 includes a residual generator R10 configured to calculate a residual of the current frame (e.g., based on an LPC analysis operation) and a delay contour calculator R20 configured to calculate a synthetic delay contour of audio signal S100 (e.g., based on current and recent pitch estimates). Encoder RC100 also includes a shift frame selector R30 configured to select a shift frame of the current residual, a time shift calculator R40 configured to calculate a time shift (e.g., to update the time shift based on a temporary modified residual), and a residual modifier R50 configured to modify the residual according to the time shift (e.g., to apply the calculated time shift to a segment of the residual that corresponds to the shift frame).

Figure 12B:
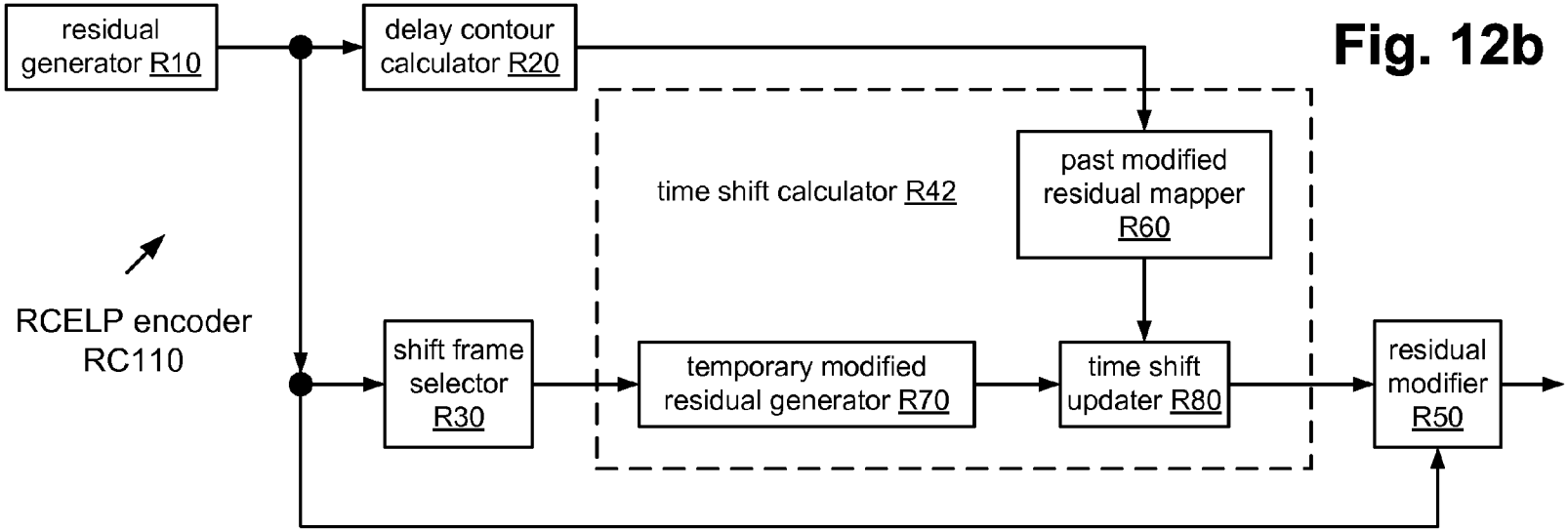
FIG. 12*b* illustrates a block diagram of an implementation RC110 of RCELP encoder RC100.

FIG. 12*b* illustrates a block diagram of an implementation RC110 of RCELP encoder RC100 that includes an implementation R42 of time shift calculator R40. Calculator R42 includes a past modified residual mapper R60 configured to map the modified residual of the previous subframe to the synthetic delay contour of the current subframe, a temporary modified residual generator R70 configured to generate a temporary modified residual based on the selected shift frame, and a time shift updater R80 configured to calculate (e.g., to update) a time shift based on a correlation between the temporary modified residual and a corresponding segment of the mapped past modified residual. Each of the elements of encoders RC100 and RC110 may be implemented by a corresponding module, such as a set of logic gates and/or instructions for execution by one or more processors. A multi-mode encoder such as audio encoder AE20 may include an instance of encoder RC100 or an implementation thereof, and in such case one or more of the elements of the RCELP frame encoder (e.g., residual generator R10) may be shared with frame encoders that are configured to perform other coding modes.

Figure 13:
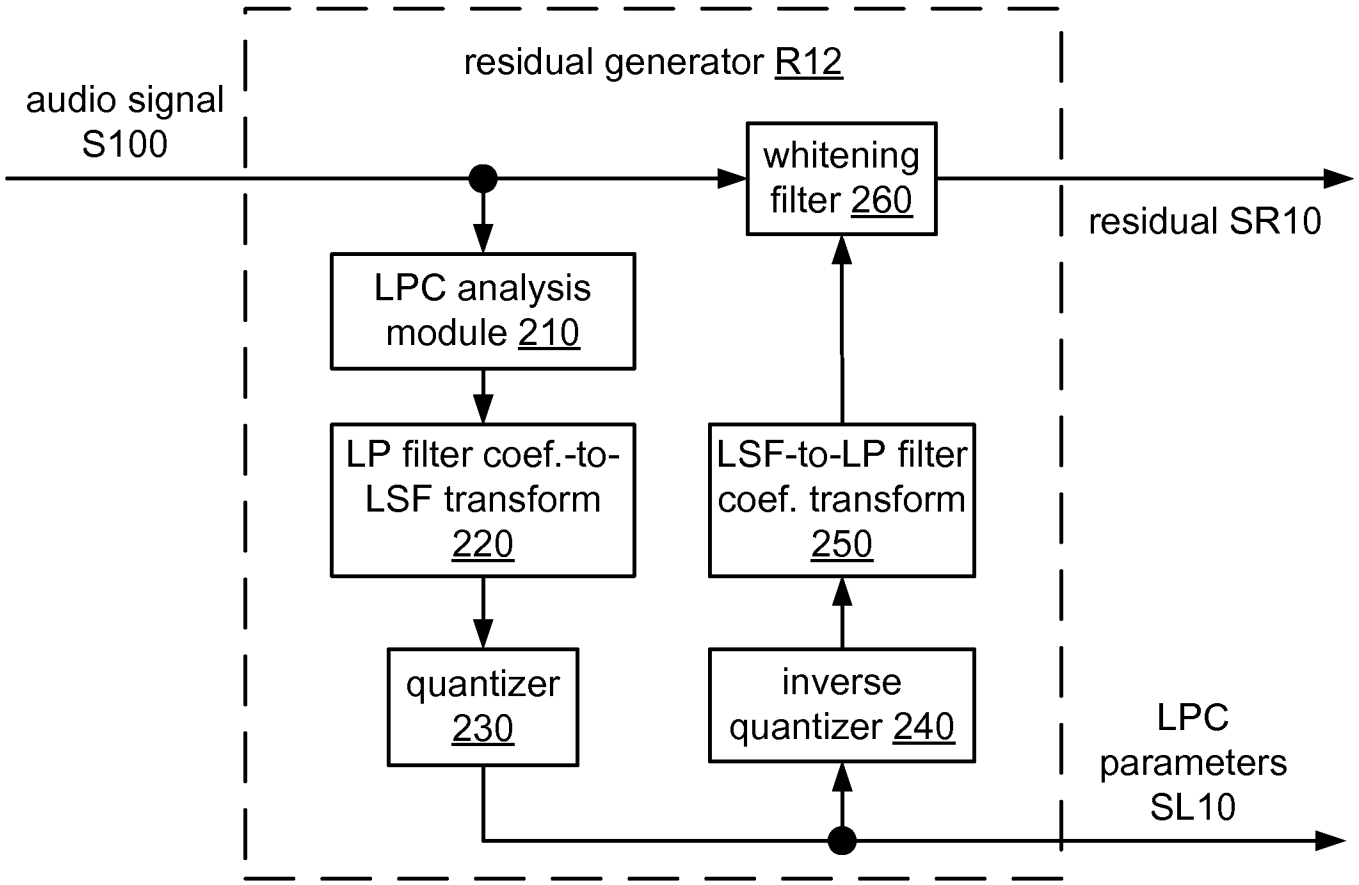
FIG. 13 illustrates a block diagram of an implementation R12 of residual generator R10.

FIG. 13 illustrates a block diagram of an implementation R12 of residual generator R10. Generator R12 includes an LPC analysis module 210 configured to calculate a set of LPC coefficient values based on a current frame of audio signal S100. Transform block 220 is configured to convert the set of LPC coefficient values to a set of LSFs, and quantizer 230 is configured to quantize the LSFs (e.g., as one or more codebook indices) to produce LPC parameters SL10. Inverse quantizer 240 is configured to obtain a set of decoded LSFs from the quantized LPC parameters SL10, and inverse transform block 250 is configured to obtain a set of decoded LPC coefficient values from the set of decoded LSFs. A whitening filter 260 (also called an analysis filter) that is configured according to the set of decoded LPC coefficient values processes audio signal S100 to produce an LPC residual SR10. Residual generator R10 may also be implemented according to any other design deemed suitable for the particular application.

When the value of the time shift changes from one shift frame to the next, a gap or overlap may occur at the boundary between the shift frames, and it may be desirable for residual modifier R50 or task RT50 to repeat or omit part of the signal in this region as appropriate. It may also be desirable to implement encoder RC100 or method RM100 to store the modified residual to a buffer (e.g., as a source for generating a target residual to be used in performing a piecewise modification procedure on the residual of the subsequent frame). Such a buffer may be arranged to provide input to time shift calculator R40 (e.g., to past modified residual mapper R60) or to time shift calculation task RT40 (e.g., to mapping task RT60).

Figure 12C:
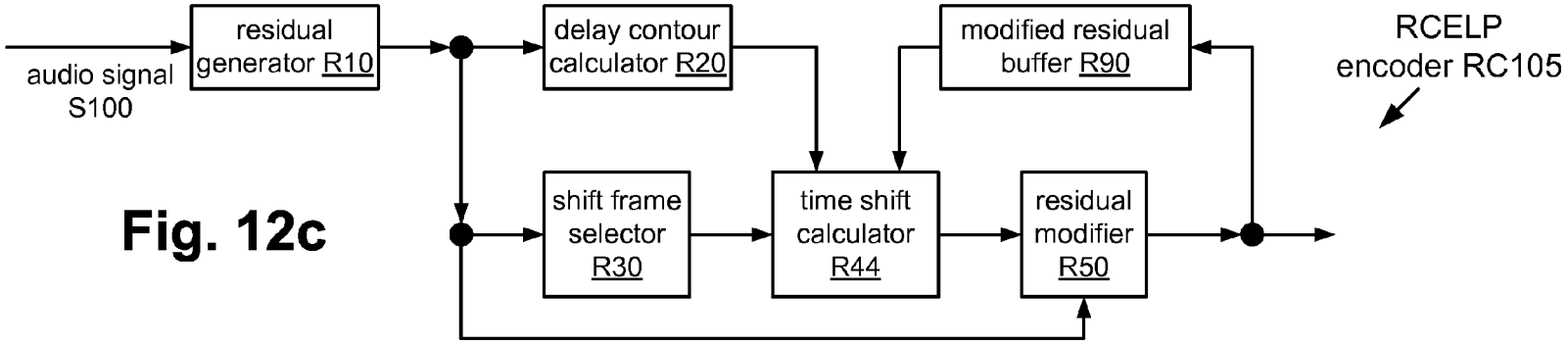
FIG. 12*c* illustrates a block diagram of an implementation RC105 of RCELP encoder RC100.
Figure 12D:
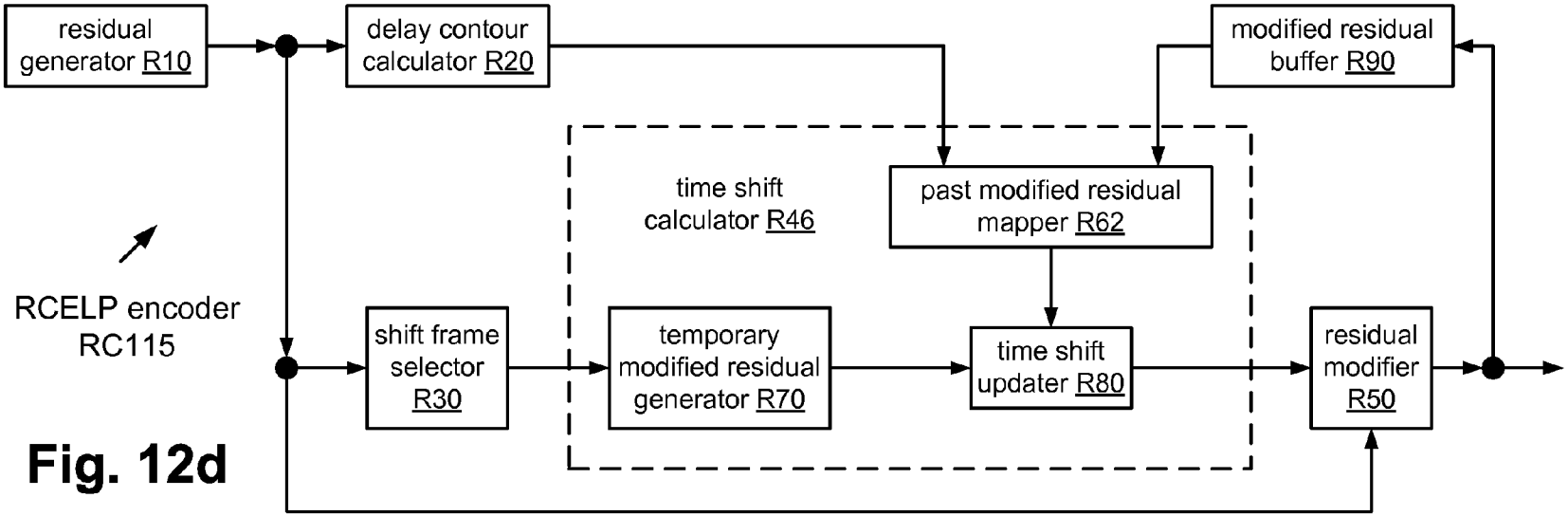
FIG. 12*d* illustrates a block diagram of an implementation RC115 of RCELP encoder RC110.

FIG. 12*c* illustrates a block diagram of an implementation RC105 of RCELP encoder RC100 that includes such a modified residual buffer R90 and an implementation R44 of time shift calculator R40 that is configured to calculate the time shift based on information from buffer R90. FIG. 12*d* illustrates a block diagram of an implementation RC115 of RCELP encoder RC105 and RCELP encoder RC110 that includes an instance of buffer R90 and an implementation R62 of past modified residual mapper R60 that is configured to receive the past modified residual from buffer R90.

Figure 14:
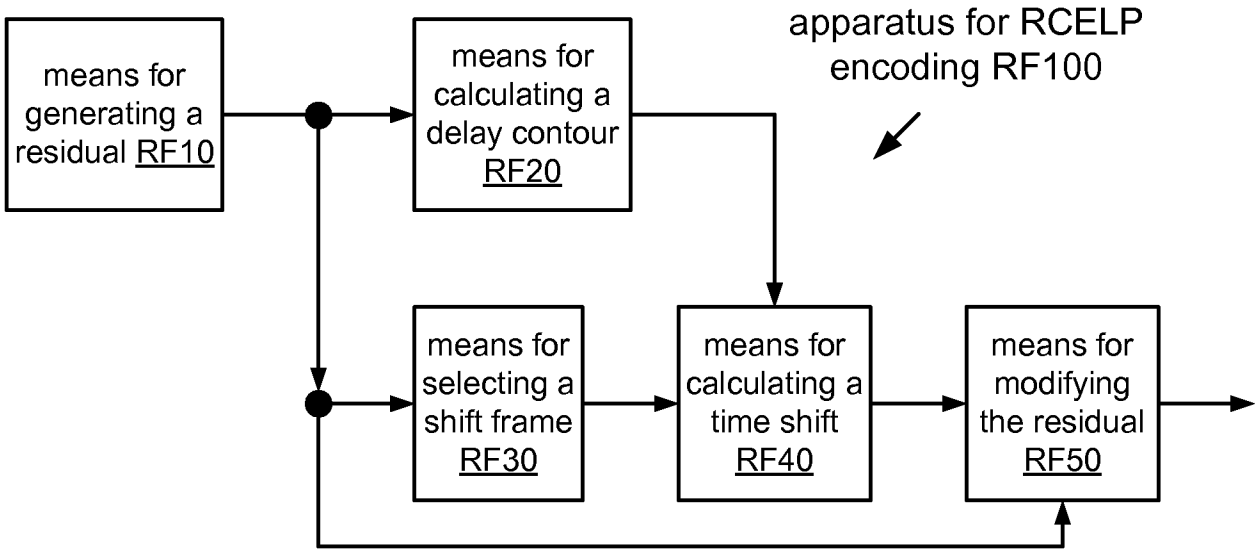
FIG. 14 illustrates a block diagram of an apparatus for RCELP encoding RF100.

FIG. 14 illustrates a block diagram of an apparatus RF100 for RCELP encoding of a frame of an audio signal (e.g., an RCELP implementation of means FE30 of apparatus F10). Apparatus RF100 includes means for generating a residual RF10 (e.g., an LPC residual) and means for calculating a delay contour RF20 (e.g., by performing linear or bilinear interpolation between a current and a previous pitch estimate). Apparatus RF100 also includes means for selecting a shift frame RF30 (e.g., by locating the next pitch pulse), means for calculating a time shift RF40 (e.g., by updating a time shift according to a correlation between a temporary modified residual and a mapped past modified residual), and means for modifying the residual RF50 (e.g., by time-shifting a segment of the residual that corresponds to the shift frame).

Figure 15:
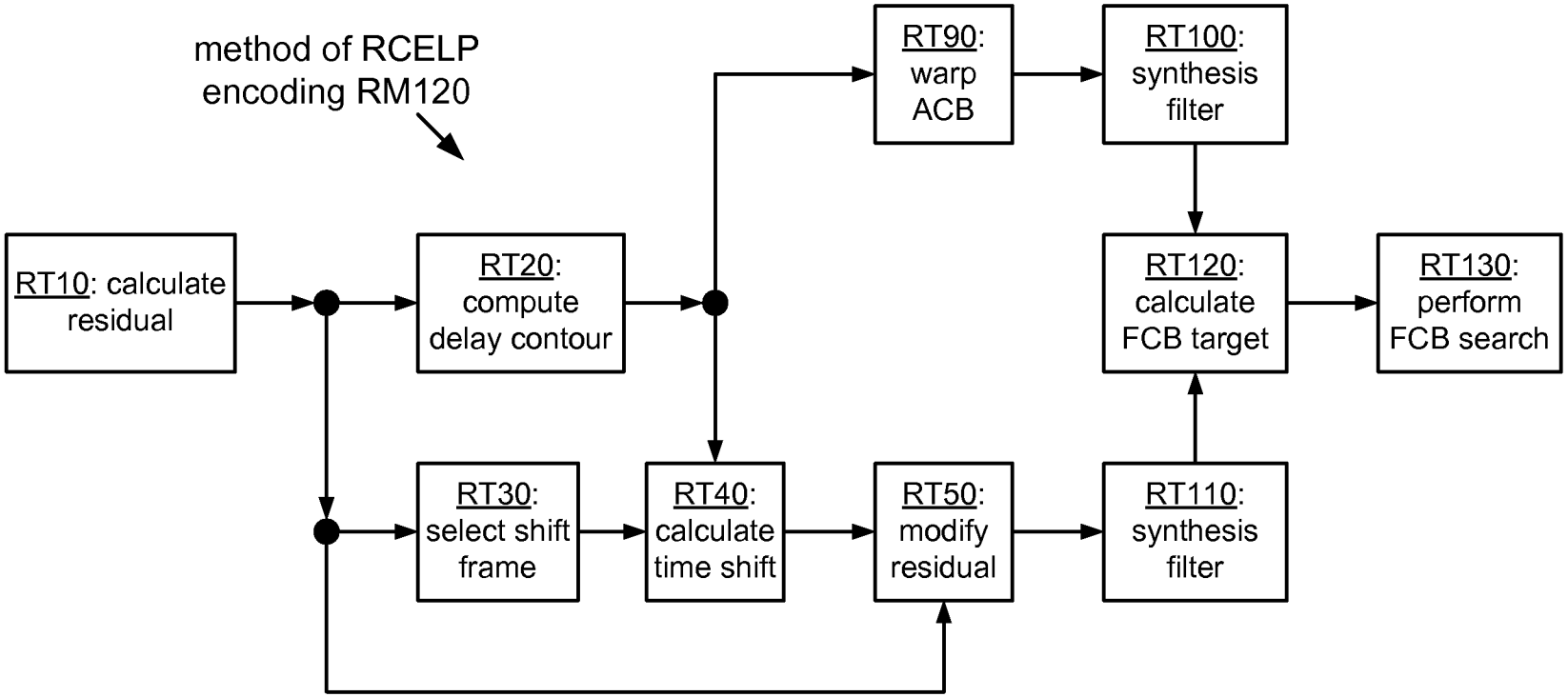
FIG. 15 illustrates a flowchart of an implementation RM120 of RCELP encoding method RM100.

The modified residual is typically used to calculate a fixed codebook contribution to the excitation signal for the current frame. FIG. 15 illustrates a flowchart of an implementation RM120 of RCELP encoding method RM100 that includes additional tasks to support such an operation. Task RT90 warps the adaptive codebook ("ACB"), which holds a copy of the decoded excitation signal from the previous frame, by mapping it to the delay contour. Task RT100 applies an LPC synthesis filter based on the current LPC coefficient values to the warped ACB to obtain an ACB contribution in the perceptual domain, and task RT110 applies an LPC synthesis filter based on the current LPC coefficient values to the current modified residual to obtain a current modified residual in the perceptual domain. It may be desirable for task RT100 and/or task RT110 to apply an LPC synthesis filter that is based on a set of weighted LPC coefficient values, as described, for example, in section 4.11.4.5 (pp. 4-84 to 4-86) of the 3GPP2 EVRC document C.S0014-C referenced above. Task RT120 calculates a difference between the two perceptual domain signals to obtain a target for the fixed codebook ("FCB") search, and task RT130 performs the FCB search to obtain the FCB contribution to the excitation signal. As noted above, an array of logic elements (e.g., logic gates) may be configured to perform one, more than one, or even all of the various tasks of this implementation of method RM100.

A modern multi-mode coding system that includes an RCELP coding scheme (e.g., a coding system including an implementation of audio encoder AE25) will typically also include one or more non-RCELP coding schemes such as noise-excited linear prediction ("NELP"), which is typically used for unvoiced frames (e.g., spoken fricatives) and frames that contain only background noise. Other examples of non-RCELP coding schemes include prototype waveform interpolation ("PWI") and its variants such as prototype pitch period ("PPP"), which are typically used for highly voiced frames. When an RCELP coding scheme is used to encode a frame of an audio signal, and a non-RCELP coding scheme is used to encode an adjacent frame of the audio signal, it is possible that a discontinuity may arise in the synthesis waveform.

It may be desirable to encode a frame using samples from an adjacent frame. Encoding across frame boundaries in such manner tends to reduce the perceptual effects of artifacts that may arise between frames due to factors such as quantization error, truncation, rounding, discarding unnecessary coefficients, and the like. One example of such a coding scheme is a modified discrete cosine transform ("MDCT") coding scheme.

An MDCT coding scheme is a non-PR coding scheme that is commonly used to encode music and other non-speech sounds. For example, the Advanced Audio Codec ("AAC"), as specified in the International Organization for Standardization (ISO)/International Electrotechnical Commission (IEC) document 14496-3:1999, also known as MPEG-4 Part 3, is an MDCT coding scheme. Section 4.13 (pages 4-145 to 4-151) of the 3GPP2 EVRC document C.S0014-C referenced above describes another MDCT coding scheme, and this section is hereby incorporated by reference as an example. An MDCT coding scheme encodes the audio signal in a frequency domain as a mixture of sinusoids, rather than as a signal whose structure is based on a pitch period, and is more appropriate for encoding singing, music, and other mixtures of sinusoids.

An MDCT coding scheme uses an encoding window that extends over (i.e., overlaps) two or more consecutive frames. For a frame length of M, the MDCT produces M coefficients based on an input of 2M samples. One feature of an MDCT coding scheme, therefore, is that it allows the transform window to extend over one or more frame boundaries without increasing the number of transform coefficients needed to represent the encoded frame. When such an overlapping coding scheme is used to encode a frame that is adjacent to a frame encoded using a PR coding scheme, however, a discontinuity may arise in the corresponding decoded frame.

Calculation of the M MDCT coefficients may be expressed as:

$$X(k) = \sum_{n=0}^{2M-1} x(n)h_k(n) \quad \text{(EQ. 1)}$$

where $$h_k(n) = w(n)\sqrt{\frac{2}{M}}\cos\left[\frac{(2n+M+1)(2k+1)\pi}{4M}\right] \quad \text{(EQ. 2)}$$

for k=0, 1, . . . , M−1. The function w(n) is typically selected to be a window that satisfies the condition $w^2(n)+w^2(n+M)=1$ (also called the Princen-Bradley condition).

The corresponding inverse MDCT operation may be expressed as:

$$\hat{x}(n) = \sum_{k=0}^{M-1} \hat{X}(k)h_k(n) \quad \text{(EQ. 3)}$$

for n=0, 1, . . . , 2M−1, where $\hat{X}(k)$ are the M received MDCT coefficients and $\hat{x}(n)$ are the 2M decoded samples.

Figure 16:
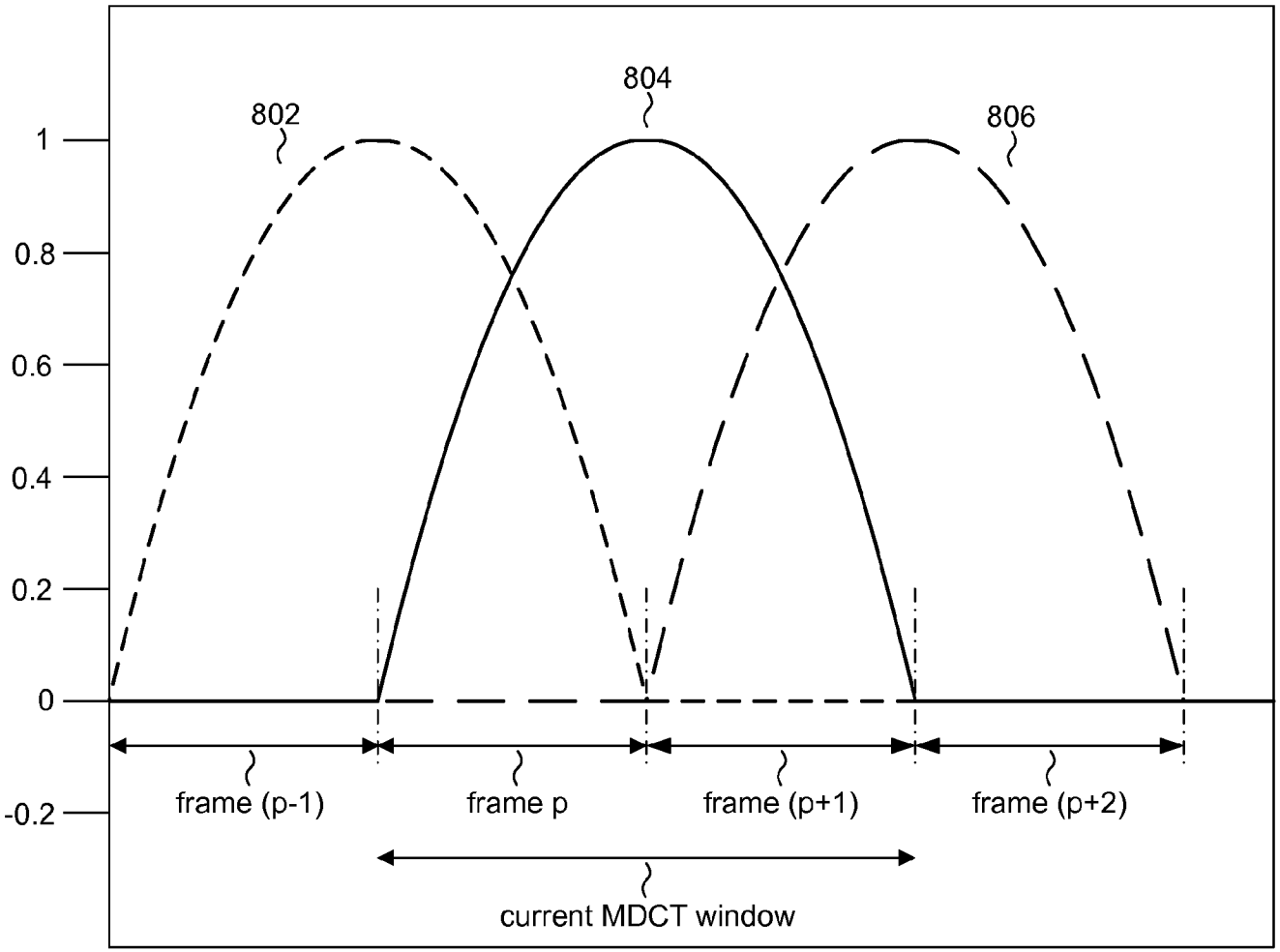
FIG. 16 illustrates three examples of a typical sinusoidal window shape for an MDCT coding scheme.

FIG. 16 illustrates three examples of a typical sinusoidal window shape for an MDCT coding scheme. This window shape, which satisfies the Princen-Bradley condition, may be expressed as $$w(n) = \sin\left(\frac{n\pi}{2M}\right) \quad \text{(EQ. 4)}$$

for 0≤n<2M, where n=0 indicates the first sample of the current frame.

Figure 25A:
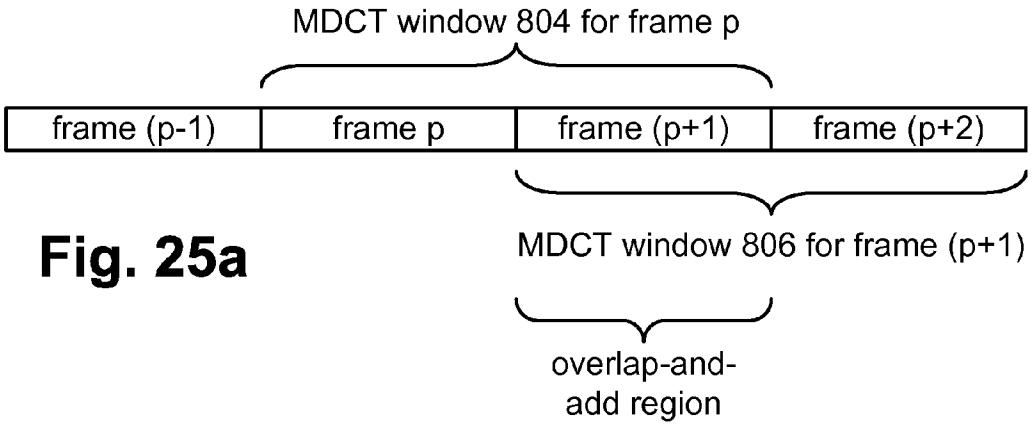
FIG. 25*a* illustrates an example of an overlap-and-add region that results from applying MDCT windows to consecutive frames of an audio signal.

As shown in the figure, the MDCT window 804 used to encode the current frame (frame p) has non-zero values over frame p and frame (p+1), and is otherwise zero-valued. The MDCT window 802 used to encode the previous frame (frame (p−1)) has non-zero values over frame (p−1) and frame p, and is otherwise zero-valued, and the MDCT window 806 used to encode the following frame (frame (p+1)) is analogously arranged. At the decoder, the decoded sequences are overlapped in the same manner as the input sequences and added. FIG. 25*a* illustrates one example of an overlap-and-add region that results from applying windows 804 and 806 as shown in FIG. 16. The overlap-and-add operation cancels errors introduced by the transform and allows perfect reconstruction (when w(n) satisfies the Princen-Bradley condition and in the absence of quantization error). Even though the MDCT uses an overlapping window function, it is a critically sampled filter bank because after the overlap-and-add, the number of input samples per frame is the same as the number of MDCT coefficients per frame.

Figure 17A:
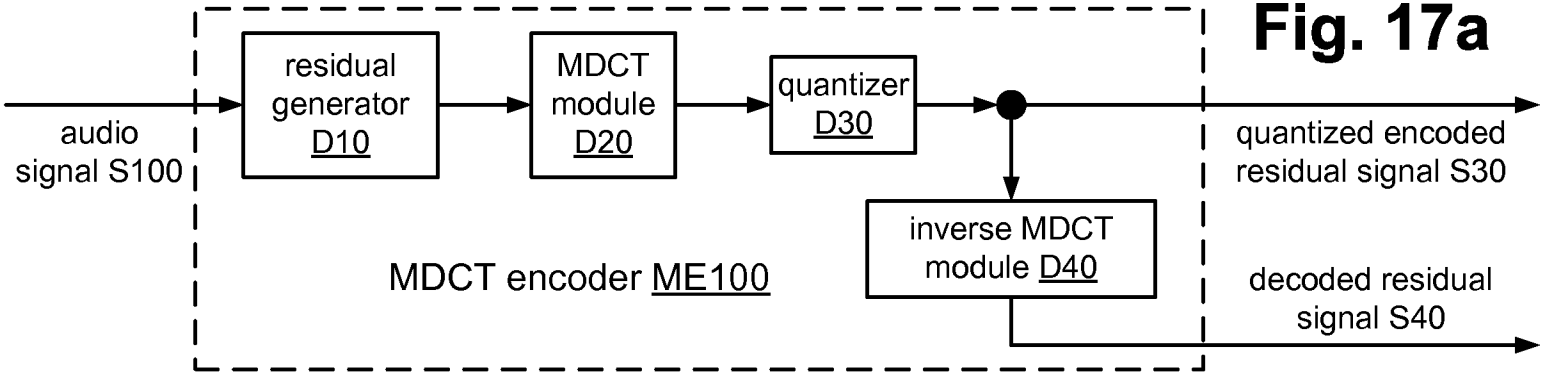
FIG. 17*a* illustrates a block diagram of an implementation ME100 of MDCT encoder 34*d*.

FIG. 17*a* illustrates a block diagram of an implementation ME100 of MDCT frame encoder 34*d*. Residual generator D10 may be configured to generate the residual using quantized LPC parameters (e.g., quantized LSPs, as described in part 4.13.2 of section 4.13 of the 3GPP2 EVRC document C.S0014-C incorporated by reference above). Alternatively, residual generator D10 may be configured to generate the residual using unquantized LPC parameters. In a multi-mode coder that includes implementations of RCELP encoder RC100 and MDCT encoder ME100, residual generator R10 and residual generator D10 may be implemented as the same structure.

Encoder ME100 also includes an MDCT module D20 that is configured to calculate MDCT coefficients (e.g., according to an expression for X(k) as set forth above in EQ. 1). Encoder ME100 also includes a quantizer D30 that is configured to process the MDCT coefficients to produce a quantized encoded residual signal S30. Quantizer D30 may be configured to perform factorial coding of MDCT coefficients using precise function computations. Alternatively, quantizer D30 may be configured to perform factorial coding of MDCT coefficients using approximate function computations as described, for example, in "Low Complexity Factorial Pulse Coding of MDCT Coefficients Using Approximation of Combinatorial Functions," U. Mittel et al., IEEE ICASSP 2007, pp. 1-289 to 1-292, and in part 4.13.5 of section 4.13 of the 3GPP2 EVRC document C.S0014-C incorporated by reference above. As shown in FIG. 17*a*, MDCT encoder ME100 may also include an optional inverse MDCT ("IMDCT") module D40 that is configured to calculate decoded samples based on the quantized signal (e.g., according to an expression for $\hat{x}(n)$ as set forth above in EQ. 3).

Figure 17B:
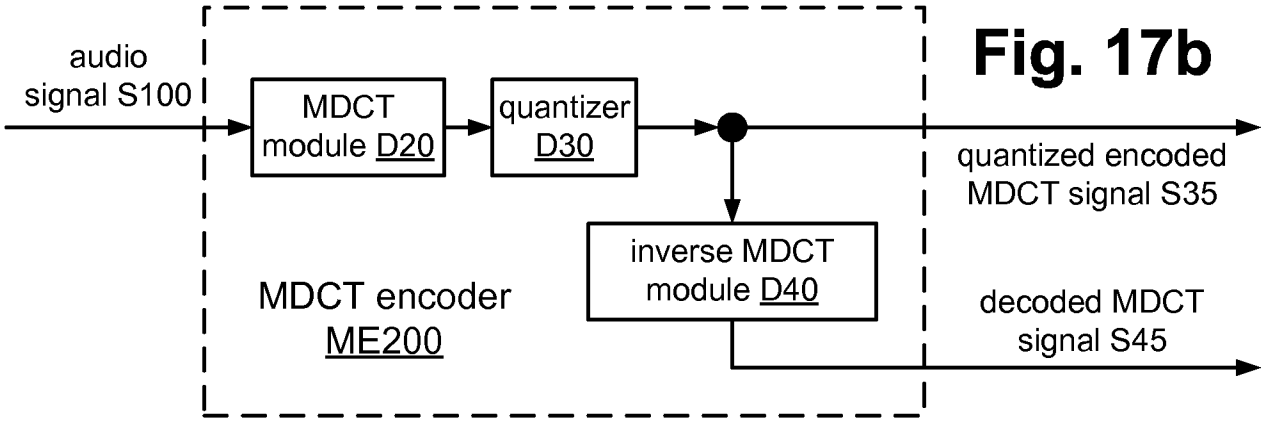
FIG. 17*b* illustrates a block diagram of an implementation ME200 of MDCT encoder 34*d*.

In some cases, it may be desirable to perform the MDCT operation on audio signal S100 rather than on a residual of audio signal S100. Although LPC analysis is well-suited for encoding resonances of human speech, it may not be as efficient for encoding features of non-speech signals such as music. FIG. 17*b* illustrates a block diagram of an implementation ME200 of MDCT frame encoder 34*d* in which MDCT module D20 is configured to receive frames of audio signal S100 as input.

The standard MDCT overlap scheme as shown in FIG. 16 requires 2M samples to be available before the transform can be performed. Such a scheme effectively forces a delay constraint of 2M samples on the coding system (i.e., M samples of the current frame plus M samples of lookahead). Other coding modes of a multi-mode coder, such as CELP, RCELP, NELP, PWI, and/or PPP, are typically configured to operate on a shorter delay constraint (e.g., M samples of the current frame plus M/2, M/3, or M/4 samples of lookahead). In modern multi-mode coders (e.g., EVRC, SMV, AMR), switching between coding modes is performed automatically and may even occur several times in a single second. It may be desirable for the coding modes of such a coder to operate at the same delay, especially for circuit-switched applications that may require a transmitter that includes the encoders to produce packets at a particular rate.

Figure 18:
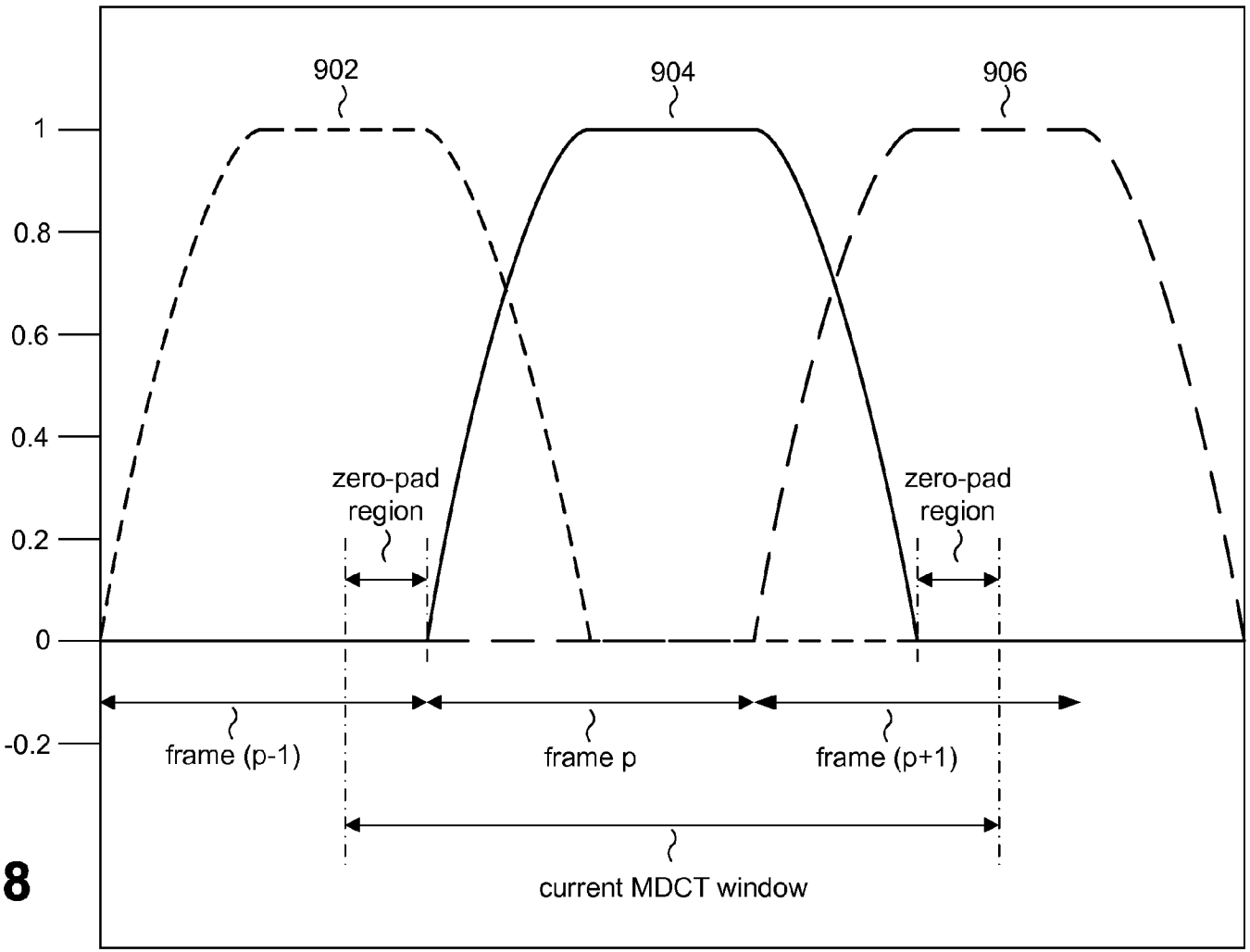
FIG. 18 illustrates one example of a windowing technique that is different than the windowing technique illustrated in FIG. 16.

FIG. 18 illustrates one example of a window function w(n) that may be applied by MDCT module D20 (e.g., in place of the function w(n) as illustrated in FIG. 16) to allow a lookahead interval that is shorter than M. In the particular example shown in FIG. 18, the lookahead interval is M/2 samples long, but such a technique may be implemented to allow an arbitrary lookahead of L samples, where L has any value from 0 to M. In this technique (examples of which are described in part 4.13.4 (p. 4-147) of section 4.13 of the 3GPP2 EVRC document C.S0014-C incorporated by reference above and in U.S. Publication No. 2008/0027719, entitled "SYSTEMS AND METHODS FOR MODIFYING A WINDOW WITH A FRAME ASSOCIATED WITH AN AUDIO SIGNAL," the MDCT window begins and ends with zero-pad regions of length (M−L)/2, and w(n) satisfies the Princen-Bradley condition. One implementation of such a window function may be expressed as follows:

$$w(n) = \begin{cases} 0, & 0 \le n < \frac{M-L}{2} \\ \sin\left[\frac{\pi}{2L}\left(n - \frac{M-L}{2}\right)\right], & \frac{M-L}{2} \le n < \frac{M+L}{2} \\ 1, & \frac{M+L}{2} \le n < \frac{3M-L}{2} \\ \sin\left[\frac{\pi}{2L}\left(3L + n - \frac{3M-L}{2}\right)\right], & \frac{3M-L}{2} \le n < \frac{3M+L}{2} \\ 0, & \frac{3M+L}{2} \le n < 2M \end{cases} \quad \text{(EQ. 5)}$$

$$\text{where } n = \frac{3M-L}{2}$$

is the first sample of the current frame p and $$n = \frac{M-L}{2}$$

is the first sample of the next frame (p+1). A signal encoded according to such a technique retains the perfect reconstruction property (in the absence of quantization and numerical errors). It is noted that for the case L=M, this window function is the same as the one illustrated in FIG. 16, and for the case L=0, w(n)=1 for $$\frac{M}{2} \le n < \frac{3M}{2}$$

and is zero elsewhere such that there is no overlap.

In a multi-mode coder that includes PR and non-PR coding schemes, it may be desirable to ensure that the synthesis waveform is continuous across the frame boundary at which the current coding mode switches from a PR coding mode to a non-PR coding mode (or vice versa). A coding mode selector may switch from one coding scheme to another several times in one second, and it is desirable to provide for a perceptually smooth transition between those schemes. Unfortunately, a pitch period that spans the boundary between a regularized frame and an unregularized frame may be unusually large or small, such that a switch between PR and non-PR coding schemes may cause an audible click or other discontinuity in the decoded signal. Additionally, as noted above, a non-PR coding scheme may encode a frame of an audio signal using an overlap-and-add window that extends over consecutive frames, and it may be desirable to avoid a change in the time shift at the boundary between those consecutive frames. It may be desirable in these cases to modify the unregularized frame according to the time shift applied by the PR coding scheme.

Figure 19C:
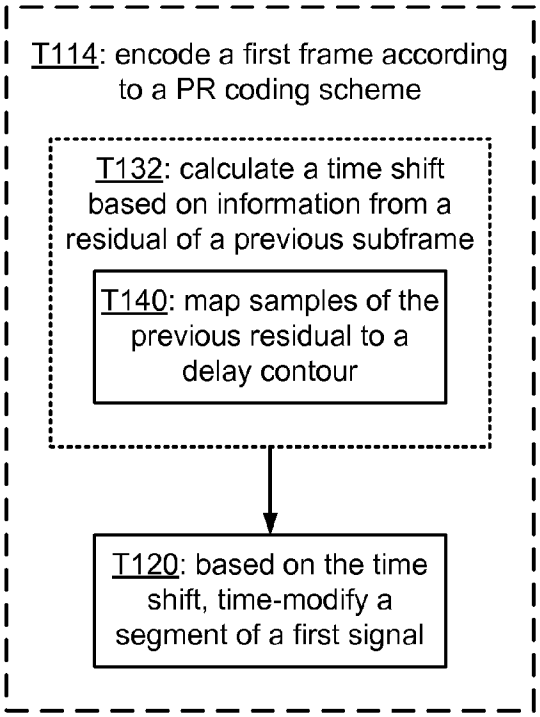
FIG. 19*c* illustrates a flowchart of an implementation T114 of task T112.
Figure 19B:
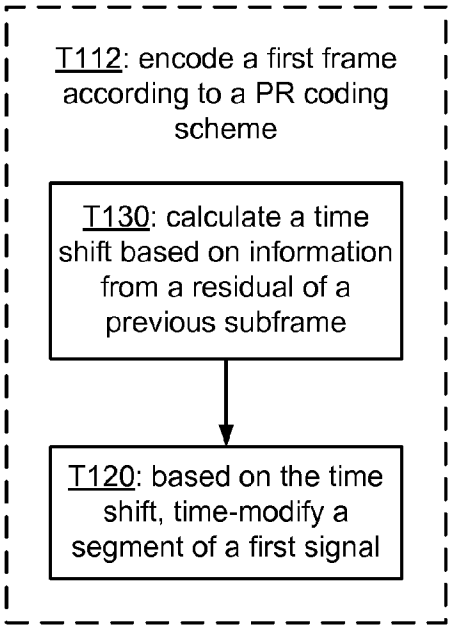
FIG. 19*b* illustrates a flowchart of an implementation T112 of task T110.
Figure 19A:
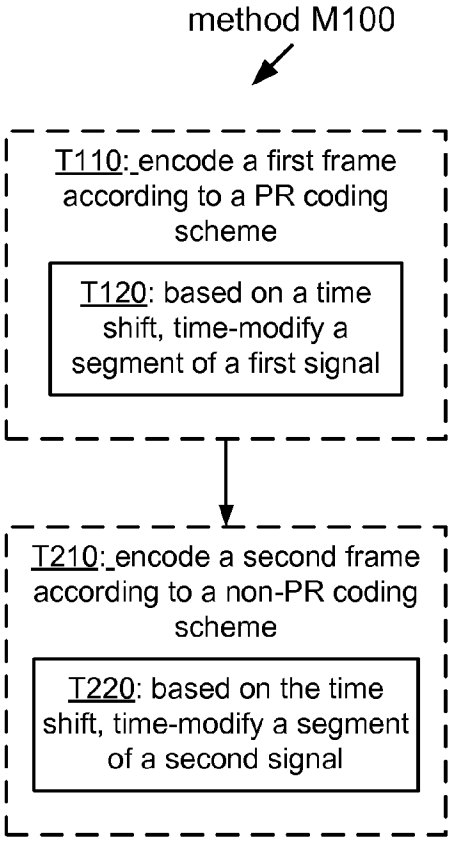
FIG. 19*a* illustrates a flowchart of a method M100 of processing frames of an audio signal according to a general configuration.

FIG. 19*a* illustrates a flowchart of a method M100 of processing frames of an audio signal according to a general configuration. Method M100 includes a task T110 that encodes a first frame according to a PR coding scheme (e.g., an RCELP coding scheme). Method M100 also includes a task T210 that encodes a second frame of the audio signal according to a non-PR coding scheme (e.g., an MDCT coding scheme). As noted above, one or both of the first and second frames may be perceptually weighted and/or otherwise processed before and/or after such encoding.

Task T110 includes a subtask T120 that time-modifies a segment of a first signal according to a time shift T, where the first signal is based on the first frame (e.g., the first signal is the first frame or a residual of the first frame). Time-modifying may be performed by time-shifting or by time-warping. In one implementation, task T120 time-shifts the segment by moving the entire segment forward or backward in time (i.e., relative to another segment of the frame or audio signal) according to the value of T. Such an operation may include interpolating sample values in order to perform a fractional time shift. In another implementation, task T120 time-warps the segment based on the time shift T. Such an operation may include moving one sample of the segment (e.g., the first sample) according to the value of T and moving another sample of the segment (e.g., the last sample) by a value having a magnitude less than the magnitude of T.

Task T210 includes a subtask T220 that time-modifies a segment of a second signal according to the time shift T, where the second signal is based on the second frame (e.g., the second signal is the second frame or a residual of the second frame). In one implementation, task T220 time-shifts the segment by moving the entire segment forward or backward in time (i.e., relative to another segment of the frame or audio signal) according to the value of T. Such an operation may include interpolating sample values in order to perform a fractional time shift. In another implementation, task T220 time-warps the segment based on the time shift T. Such an operation may include mapping the segment to a delay contour. For example, such an operation may include moving one sample of the segment (e.g., the first sample) according to the value of T and moving another sample of the segment (e.g., the last sample) by a value having a magnitude less than the magnitude of T. For example, task T120 may time-warp a frame or other segment by mapping it to a corresponding time interval that has been shortened by the value of the time shift T (e.g., lengthened in the case of a negative value of T), in which case the value of T may be reset to zero at the end of the warped segment.

The segment that task T220 time-modifies may include the entire second signal, or the segment may be a shorter portion of that signal such as a subframe of the residual (e.g., the initial subframe). Typically task T220 time-modifies a segment of an unquantized residual signal (e.g., after inverse-LPC filtering of audio signal S100) such as the output of residual generator D10 as shown in FIG. 17*a*. However, task T220 may also be implemented to time-modify a segment of a decoded residual (e.g., after MDCT-IMDCT processing), such as signal S40 as shown in FIG. 17*a*, or a segment of audio signal S100.

It may be desirable for the time shift T to be the last time shift that was used to modify the first signal. For example, time shift T may be the time shift that was applied to the last time-shifted segment of the residual of the first frame and/or the value resulting from the most recent update of an accumulated time shift. An implementation of RCELP encoder RC100 may be configured to perform task T110, in which case time shift T may be the last time shift value calculated by block R40 or block R80 during encoding of the first frame.

FIG. 19*b* illustrates a flowchart of an implementation T112 of task T110. Task T112 includes a subtask T130 that calculates the time shift based on information from a residual of a previous subframe, such as the modified residual of the most recent subframe. As discussed above, it may be desirable for an RCELP coding scheme to generate a target residual that is based on the modified residual of the previous subframe and to calculate a time shift according to a match between the selected shift frame and a corresponding segment of the target residual.

FIG. 19*c* illustrates a flowchart of an implementation T114 of task T112 that includes an implementation T132 of task T130. Task T132 includes a task T140 that maps samples of the previous residual to a delay contour. As discussed above, it may be desirable for an RCELP coding scheme to generate a target residual by mapping the modified residual of the previous subframe to the synthetic delay contour of the current subframe.

It may be desirable to configure task T210 to time-shift the second signal and also any portion of a subsequent frame that is used as a lookahead for encoding the second frame. For example, it may be desirable for task T210 to apply the time shift T to the residual of the second (non-PR) frame and also to any portion of a residual of a subsequent frame that is used as a lookahead for encoding the second frame (e.g., as described above with reference to the MDCT and overlapping windows). It may also be desirable to configure task T210 to apply the time shift T to the residuals of any subsequent consecutive frames that are encoded using a non-PR coding scheme (e.g., an MDCT coding scheme) and to any lookahead segments corresponding to such frames.

Figure 25B:
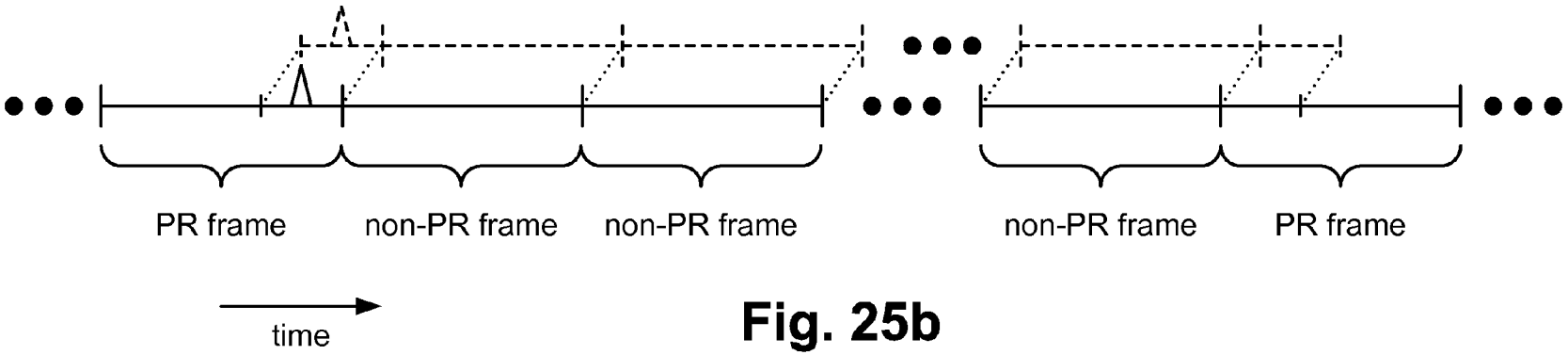
FIG. 25*b* illustrates an example of applying a time shift to a sequence of non-PR frames.

FIG. 25*b* illustrates an example in which each in a sequence of non-PR frames between two PR frames is shifted by the time shift that was applied to the last shift frame of the first PR frame. In this figure, the solid lines indicate the positions of the original frames over time, the dashed lines indicate the shifted positions of the frames, and the dotted lines show a correspondence between original and shifted boundaries. The longer vertical lines indicate frame boundaries, the first short vertical line indicates the start of the last shift frame of the first PR frame (where the peak indicates the pitch pulse of the shift frame), and the last short vertical line indicates the end of the lookahead segment for the final non-PR frame of the sequence. In one example, the PR frames are RCELP frames, and the non-PR frames are MDCT frames. In another example, the PR frames are RCELP frames, some of the non-PR frames are MDCT frames, and others of the non-PR frames are NELP or PWI frames.

Method M100 may be suitable for a case in which no pitch estimate is available for the current non-PR frame. However, it may be desirable to perform method M100 even if a pitch estimate is available for the current non-PR frame. In a non-PR coding scheme that involves an overlap and add between consecutive frames (such as with an MDCT window), it may be desirable to shift the consecutive frames, any corresponding lookaheads, and any overlap regions between the frames by the same shift value. Such consistency may help to avoid degradation in the quality of the reconstructed audio signal. For example, it may be desirable to use the same time shift value for both of the frames that contribute to an overlap region such as an MDCT window.

Figure 20A:
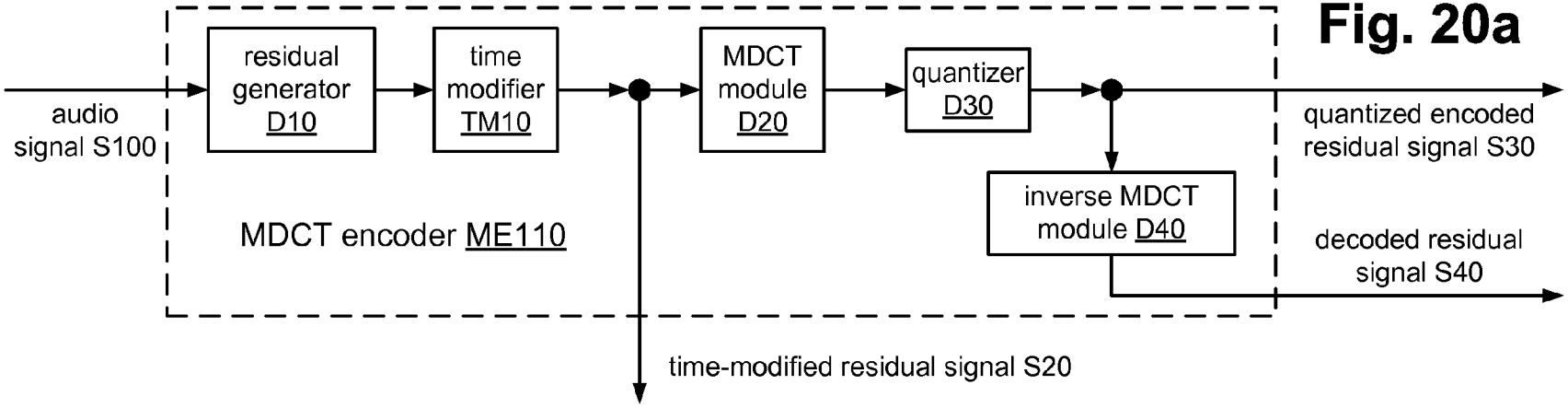
FIG. 20*a* illustrates a block diagram of an implementation ME110 of MDCT encoder ME100.

FIG. 20*a* illustrates a block diagram of an implementation ME110 of MDCT encoder ME100. Encoder ME110 includes a time modifier TM10 that is arranged to time-modify a segment of a residual signal generated by residual generator D10 to produce a time-modified residual signal S20. In one implementation, time modifier TM10 is configured to time-shift the segment by moving the entire segment forward or backward according to the value of T. Such an operation may include interpolating sample values in order to perform a fractional time shift. In another implementation, time modifier TM10 is configured to time-warp the segment based on the time shift T. Such an operation may include mapping the segment to a delay contour. For example, such an operation may include moving one sample of the segment (e.g., the first sample) according to the value of T and moving another sample (e.g., the last sample) by a value having a magnitude less than the magnitude of T. For example, task T120 may time-warp a frame or other segment by mapping it to a corresponding time interval that has been shortened by the value of the time shift T (e.g., lengthened in the case of a negative value of T), in which case the value of T may be reset to zero at the end of the warped segment. As noted above, time shift T may be the time shift that was applied most recently to a time-shifted segment by a PR coding scheme and/or the value resulting from the most recent update of an accumulated time shift by a PR coding scheme. In an implementation of audio encoder AE10 that includes implementations of RCELP encoder RC105 and MDCT encoder ME110, encoder ME110 may also be configured to store time-modified residual signal S20 to buffer R90.

Figure 20B:
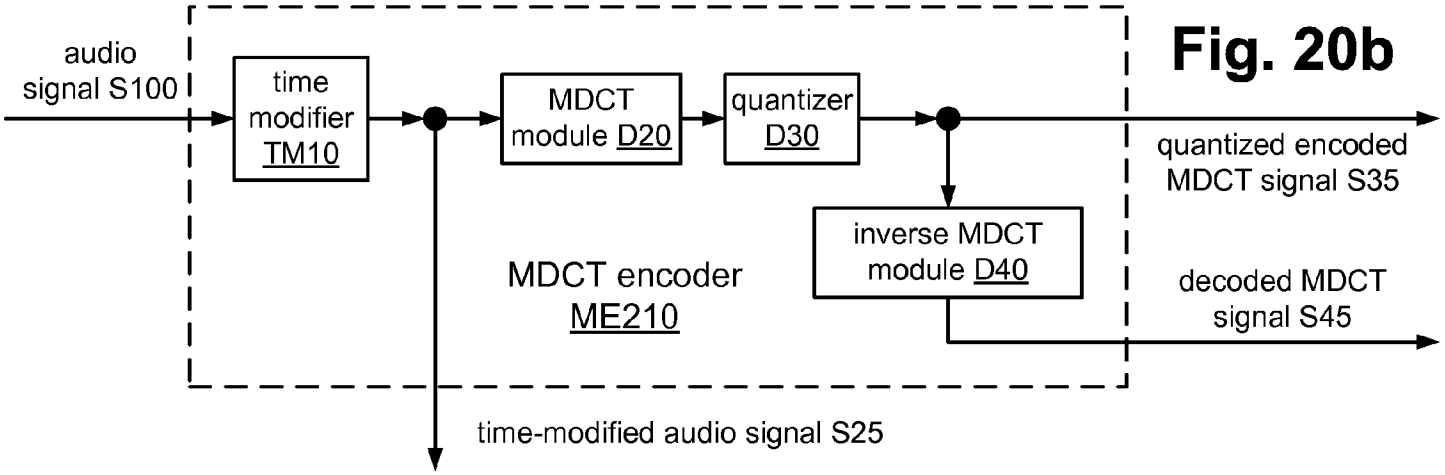
FIG. 20*b* illustrates a block diagram of an implementation ME210 of MDCT encoder ME200.

FIG. 20*b* illustrates a block diagram of an implementation ME210 of MDCT encoder ME200. Encoder ME200 includes an instance of time modifier TM10 that is arranged to time-modify a segment of audio signal S100 to produce a time-modified audio signal S25. As noted above, audio signal S100 may be a perceptually weighted and/or otherwise filtered digital signal. In an implementation of audio encoder AE10 that includes implementations of RCELP encoder RC105 and MDCT encoder ME210, encoder ME210 may also be configured to store time-modified residual signal S20 to buffer R90.

Figure 21A:
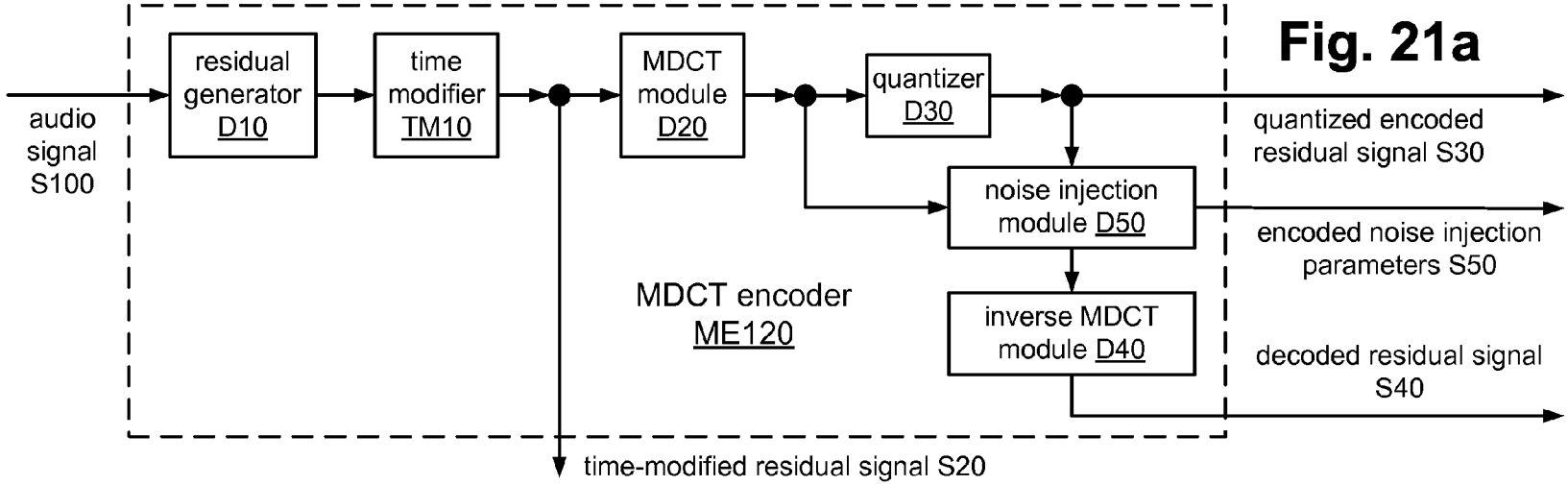
FIG. 21*a* illustrates a block diagram of an implementation ME120 of MDCT encoder ME100.

FIG. 21*a* illustrates a block diagram of an implementation ME120 of MDCT encoder ME110 that includes a noise injection module D50. Noise injection module D50 is configured to substitute noise for zero-valued elements of quantized encoded residual signal S30 within a predetermined frequency range (e.g., according to a technique as described in part 4.13.7 (p. 4-150) of section 4.13 of the 3GPP2 EVRC document C.S0014-C incorporated by reference above). Such an operation may improve audio quality by reducing the perception of tonal artifacts that may occur during undermodeling of the residual line spectrum.

Figure 21B:
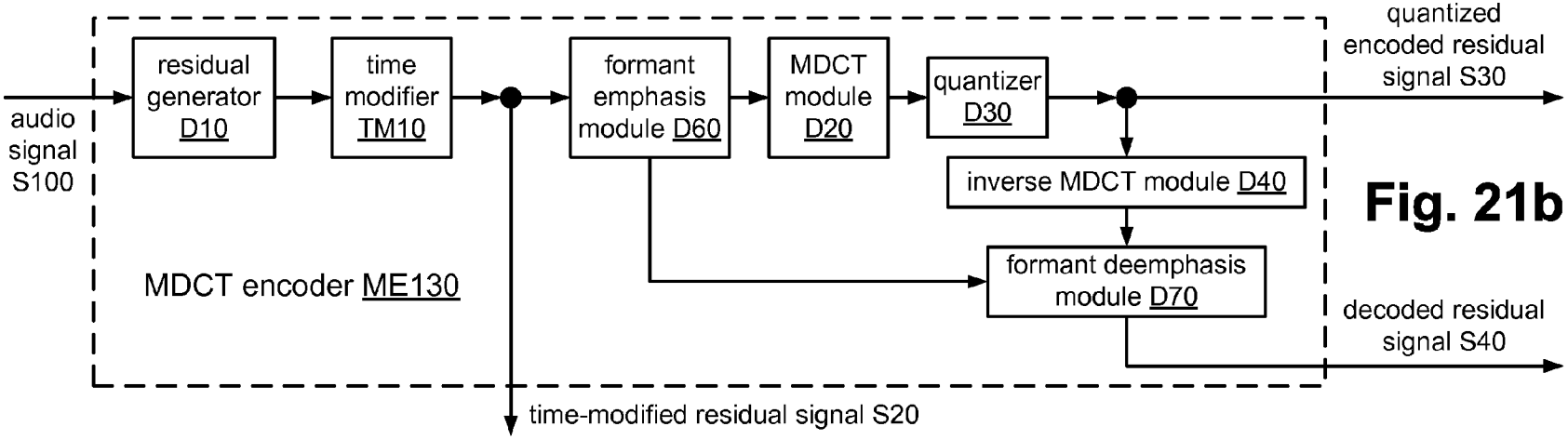
FIG. 21*b* illustrates a block diagram of an implementation ME130 of MDCT encoder ME100.

FIG. 21*b* illustrates a block diagram of an implementation ME130 of MDCT encoder ME110. Encoder ME130 includes a formant emphasis module D60 configured to perform perceptual weighting of low-frequency formant regions of residual signal S20 (e.g., according to a technique as described in part 4.13.3 (p. 4-147) of section 4.13 of the 3GPP2 EVRC document C.S0014-C incorporated by reference above) and a formant deemphasis module D70 configured to remove the perceptual weighting (e.g., according to a technique as described in part 4.13.9 (p. 4-151) of section 4.13 of the 3GPP2 EVRC document C.S0014-C).

Figure 22:
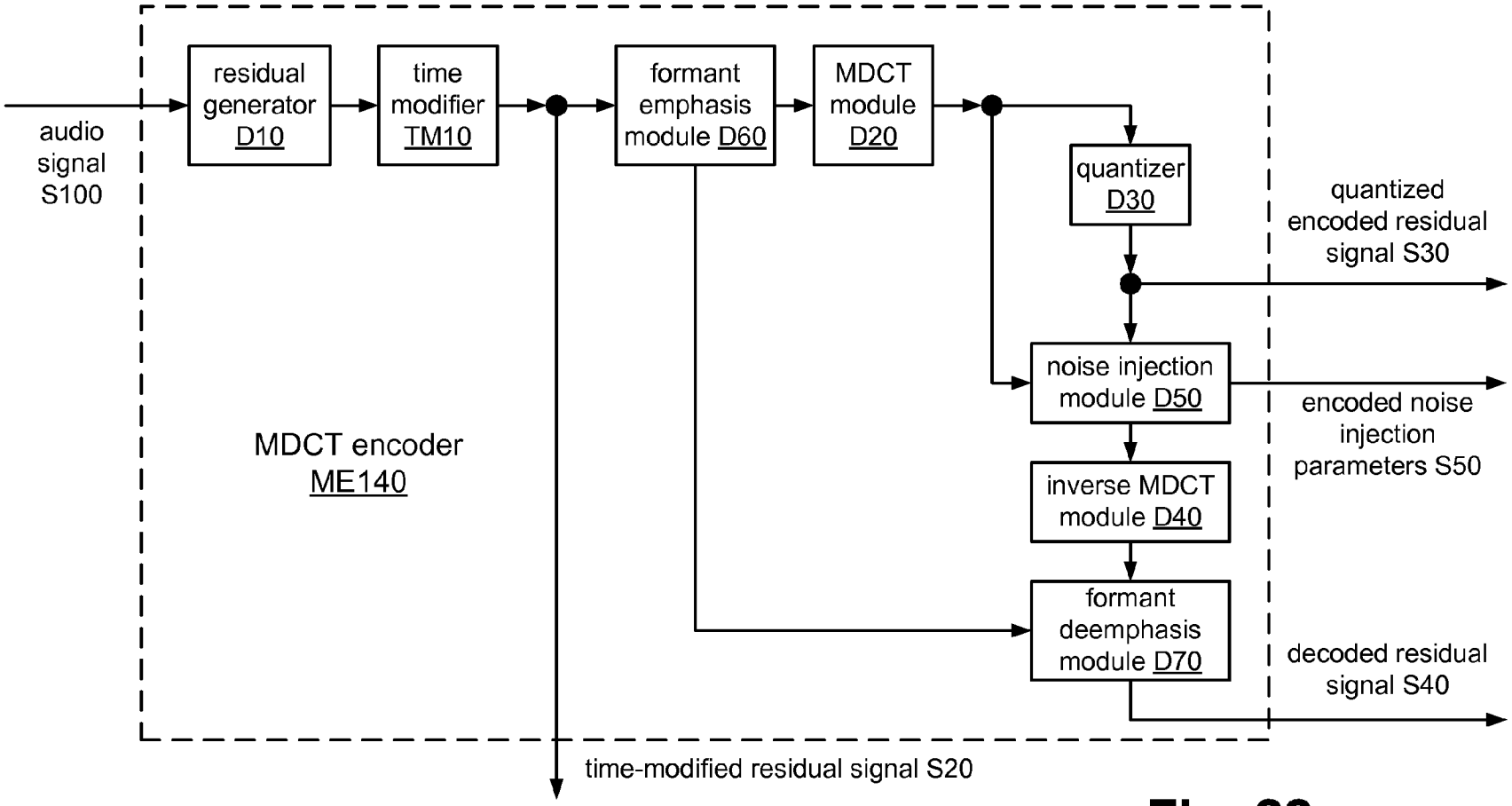
FIG. 22 illustrates a block diagram of an implementation ME140 of MDCT encoders ME120 and ME130.

FIG. 22 illustrates a block diagram of an implementation ME140 of MDCT encoders ME120 and ME130. Other implementations of MDCT encoder MD110 may be configured to include one or more additional operations in the processing path between residual generator D10 and decoded residual signal S40.

Figure 23B:
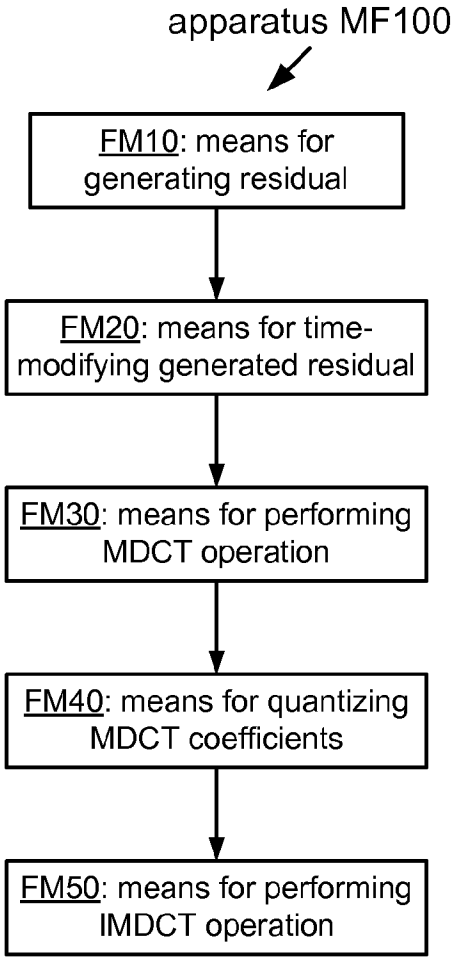
FIG. 23*b* illustrates a block diagram of an apparatus for MDCT encoding MF100.
Figure 23A:
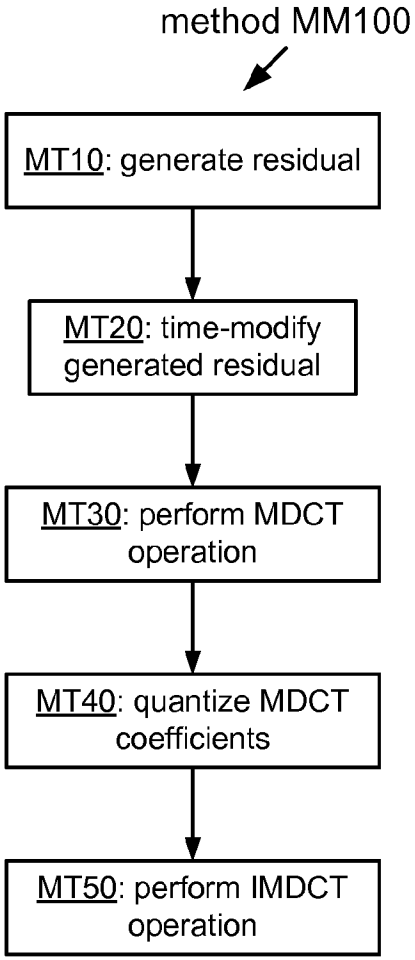
FIG. 23*a* illustrates a flowchart of a method of MDCT encoding MM100.

FIG. 23*a* illustrates a flowchart of a method of MDCT encoding a frame of an audio signal MM100 according to a general configuration (e.g., an MDCT implementation of task TE30 of method M10). Method MM100 includes a task MT10 that generates a residual of the frame. Task MT10 is typically arranged to receive a frame of a sampled audio signal (which may be pre-processed), such as audio signal S100. Task MT10 is typically implemented to include a linear prediction coding ("LPC") analysis operation and may be configured to produce a set of LPC parameters such as line spectral pairs ("LSPs"). Task MT10 may also include other processing operations such as one or more perceptual weighting and/or other filtering operations.

Method MM100 includes a task MT20 that time-modifies the generated residual. In one implementation, task MT20 time-modifies the residual by time-shifting a segment of the residual, moving the entire segment forward or backward according to the value of T. Such an operation may include interpolating sample values in order to perform a fractional time shift. In another implementation, task MT20 time-modifies the residual by time-warping a segment of the residual based on the time shift T. Such an operation may include mapping the segment to a delay contour. For example, such an operation may include moving one sample of the segment (e.g., the first sample) according to the value of T and moving another sample (e.g., the last sample) by a value having a magnitude less than T. Time shift T may be the time shift that was applied most recently to a time-shifted segment by a PR coding scheme and/or the value resulting from the most recent update of an accumulated time shift by a PR coding scheme. In an implementation of encoding method M10 that includes implementations of RCELP encoding method RM100 and MDCT encoding method MM100, task MT20 may also be configured to store time-modified residual signal S20 to a modified residual buffer (e.g., for possible use by method RM100 to generate a target residual for the next frame).

Method MM100 includes a task MT30 that performs an MDCT operation on the time-modified residual (e.g., according to an expression for X(k) as set forth above) to produce a set of MDCT coefficients. Task MT30 may apply a window function w(n) as described herein (e.g., as shown in FIG. 16 or 18) or may use another window function or algorithm to perform the MDCT operation. Method MM40 includes a task MT40 that quantizes the MDCT coefficients using factorial coding, combinatorial approximation, truncation, rounding, and/or any other quantization operation deemed suitable for the particular application. In this example, method MM100 also includes an optional task MT50 that is configured to perform an IMDCT operation on the quantized coefficients to obtain a set of decoded samples (e.g., according to an expression for $\hat{x}(n)$ as set forth above).

An implementation of method MM100 may be included within an implementation of method M10 (e.g., within encoding task TE30), and as noted above, an array of logic elements (e.g., logic gates) may be configured to perform one, more than one, or even all of the various tasks of the method. For a case in which method M10 includes implementations of both of method MM100 and method RM100, residual calculation task RT10 and residual generation task MT10 may share operations in common (e.g., may differ only in the order of the LPC operation) or may even be implemented as the same task.

FIG. 23*b* illustrates a block diagram of an apparatus MF100 for MDCT encoding of a frame of an audio signal (e.g., an MDCT implementation of means FE30 of apparatus F10). Apparatus MF100 includes means for generating a residual of the frame FM10 (e.g., by performing an implementation of task MT10 as described above). Apparatus MF100 includes means for time-modifying the generated residual FM20 (e.g., by performing an implementation of task MT20 as described above). In an implementation of encoding apparatus F10 that includes implementations of RCELP encoding apparatus RF100 and MDCT encoding apparatus MF100, means FM20 may also be configured to store time-modified residual signal S20 to a modified residual buffer (e.g., for possible use by apparatus RF100 to generate a target residual for the next frame). Apparatus MF100 also includes means for performing an MDCT operation on the time-modified residual FM30 to obtain a set of MDCT coefficients (e.g., by performing an implementation of task MT30 as described above) and means for quantizing the MDCT coefficients FM40 (e.g., by performing an implementation of task MT40 as described above). Apparatus MF100 also includes optional means for performing an IMDCT operation on the quantized coefficients FM50 (e.g., by performing task MT50 as described above).

FIG. 24*a* illustrates a flowchart of a method M200 of processing frames of an audio signal according to another general configuration. Task T510 of method M200 encodes a first frame according to a non-PR coding scheme (e.g., an MDCT coding scheme). Task T610 of method M200 encodes a second frame of the audio signal according to a PR coding scheme (e.g., an RCELP coding scheme).

Task T510 includes a subtask T520 that time-modifies a segment of a first signal according to a first time shift T, where the first signal is based on the first frame (e.g., the first signal is the first (non-PR) frame or a residual of the first frame). In one example, the time shift T is a value (e.g., the last updated value) of an accumulated time shift as calculated during RCELP encoding of a frame that preceded the first frame in the audio signal. The segment that task T520 time-modifies may include the entire first signal, or the segment may be a shorter portion of that signal such as a subframe of the residual (e.g., the final subframe). Typically task T520 time-modifies an unquantized residual signal (e.g., after-inverse LPC filtering of audio signal S100) such as the output of residual generator D10 as shown in FIG. 17*a*. However, task T520 may also be implemented to time-modify a segment of a decoded residual (e.g., after MDCT-IMDCT processing), such as signal S40 as shown in FIG. 17*a*, or a segment of audio signal S100.

In one implementation, task T520 time-shifts the segment by moving the entire segment forward or backward in time (i.e., relative to another segment of the frame or audio signal) according to the value of T. Such an operation may include interpolating sample values in order to perform a fractional time shift. In another implementation, task T520 time-warps the segment based on the time shift T. Such an operation may include mapping the segment to a delay contour. For example, such an operation may include moving one sample of the segment (e.g., the first sample) according to the value of T and moving another sample of the segment (e.g., the last sample) by a value having a magnitude less than the magnitude of T.

Task T520 may be configured to store the time-modified signal to a buffer (e.g., to a modified residual buffer) for possible use by task T620 described below (e.g., to generate a target residual for the next frame). Task T520 may also be configured to update other state memory of a PR encoding task. One such implementation of task T520 stores a decoded quantized residual signal, such as decoded residual signal S40, to an adaptive codebook ("ACB") memory and a zero-input-response filter state of a PR encoding task (e.g., RCELP encoding method RM120).

Task T610 includes a subtask T620 that time-warps a second signal based on information from the time-modified segment, where the second signal is based on the second frame (e.g., the second signal is the second PR frame or a residual of the second frame). For example, the PR coding scheme may be an RCELP coding scheme configured to encode the second frame as described above by using the residual of the first frame, including the time-modified (e.g., time-shifted) segment, in place of a past modified residual.

In one implementation, task T620 applies a second time shift to the segment by moving the entire segment forward or backward in time (i.e., relative to another segment of the frame or audio signal). Such an operation may include interpolating sample values in order to perform a fractional time shift. In another implementation, task T620 time-warps the segment, which may include mapping the segment to a delay contour. For example, such an operation may include moving one sample of the segment (e.g., the first sample) according to a time shift and moving another sample of the segment (e.g., the last sample) by a lesser time shift.

FIG. 24*b* illustrates a flowchart of an implementation T622 of task T620. Task T622 includes a subtask T630 that calculates the second time shift based on information from the time-modified segment. Task T622 also includes a subtask T640 that applies the second time shift to a segment of the second signal (in this example, to a residual of the second frame).

FIG. 24*c* illustrates a flowchart of an implementation T624 of task T620. Task T624 includes a subtask T650 that maps samples of the time-modified segment to a delay contour of the audio signal. As discussed above, it may be desirable for an RCELP coding scheme to generate a target residual by mapping the modified residual of the previous subframe to the synthetic delay contour of the current subframe. In this case, an RCELP coding scheme may be configured to perform task T650 by generating a target residual that is based on the residual of the first (non-RCELP) frame, including the time-modified segment.

For example, such an RCELP coding scheme may be configured to generate a target residual by mapping the residual of the first (non-RCELP) frame, including the time-modified segment, to the synthetic delay contour of the current frame. The RCELP coding scheme may also be configured to calculate a time shift based on the target residual, and to use the calculated time shift to time-warp a residual of the second frame, as discussed above. FIG. 24*d* illustrates a flowchart of an implementation T626 of tasks T622 and T624 that includes task T650, an implementation T632 of task T630 that calculates the second time shift based on information from the mapped samples of the time-modified segment, and task T640.

As noted above, it may be desirable to transmit and receive an audio signal having a frequency range that exceeds the PSTN frequency range of about 300-3400 Hz. One approach to coding such a signal is a "full-band" technique, which encodes the entire extended frequency range as a single frequency band (e.g., by scaling a coding system for the PSTN range to cover the extended frequency range). Another approach is to extrapolate information from the PSTN signal into the extended frequency range (e.g., to extrapolate an excitation signal for a highband range above the PSTN range, based on information from the PSTN-range audio signal). A further approach is a "split-band" technique, which separately encodes information of the audio signal that is outside the PSTN range (e.g., information for a highband frequency range such as 3500-7000 or 3500-8000 Hz). Descriptions of split-band PR coding techniques may be found in documents such as U.S. Publication Nos. 2008/0052065, entitled, "TIME-WARPING FRAMES OF WIDEBAND VOCODER," and 2006/0282263, entitled "SYSTEMS, METHODS, AND APPARATUS FOR HIGH-BAND TIME WARPING." It may be desirable to extend a split-band coding technique to include implementations of method M100 and/or M200 on both of the narrowband and highband portions of an audio signal.

Method M100 and/or M200 may be performed within an implementation of method M10. For example, tasks T110 and T210 (similarly, tasks T510 and T610) may be performed by successive iterations of task TE30 as method M10 executes to process successive frames of audio signal S100. Method M100 and/or M200 may also be performed by an implementation of apparatus F10 and/or apparatus AE10 (e.g., apparatus AE20 or AE25). As noted above, such an apparatus may be included in a portable communications device such as a cellular telephone. Such methods and/or apparatus may also be implemented in infrastructure equipment such as media gateways.

The foregoing presentation of the described configurations is provided to enable any person skilled in the art to make or use the methods and other structures disclosed herein. The flowcharts, block diagrams, state diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

In addition to the EVRC and SMV codecs referenced above, examples of codecs that may be used with, or adapted for use with, speech encoders, methods of speech encoding, speech decoders, and/or methods of speech decoding as described herein include the Adaptive Multi Rate ("AMR") speech codec, as described in the document ETSI TS 126 092 V6.0.0 (European Telecommunications Standards Institute ("ETSI"), Sophia Antipolis Cedex, FR, December 2004); and the AMR Wideband speech codec, as described in the document ETSI TS 126 192 V6.0.0 (ETSI, December 2004).

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and operations described in connection with the configurations disclosed herein may be implemented as electronic hardware, computer software, or combinations of both. Such logical blocks, modules, circuits, and operations may be implemented or performed with a general purpose processor, a digital signal processor ("DSP"), an ASIC or ASSP, an FPGA or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The tasks of the methods and algorithms described herein may be embodied directly in hardware, in a software module executed by a processor, or in a combination of the two. A software module may reside in random-access memory ("RAM"), read-only memory ("ROM"), nonvolatile RAM ("NVRAM") such as flash RAM, erasable programmable ROM ("EPROM"), electrically erasable programmable ROM ("EEPROM"), registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Each of the configurations described herein may be implemented at least in part as a hard-wired circuit, as a circuit configuration fabricated into an application-specific integrated circuit, or as a firmware program loaded into nonvolatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM, ROM, and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

The implementations of methods M10, RM100, MM100, M100, and M200 disclosed herein may also be tangibly embodied (for example, in one or more data storage media as listed above) as one or more sets of instructions readable and/or executable by a machine including an array of logic elements (e.g., a processor, microprocessor, microcontroller, or other finite state machine). Thus, the present disclosure is not intended to be limited to the configurations shown above but rather is to be accorded the widest scope consistent with the principles and novel features disclosed in any fashion herein, including in the attached claims as filed, which form a part of the original disclosure.

The elements of the various implementations of the apparatus described herein (e.g., AE10, AD10, RC100, RF100, ME100, ME200, MF100) may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

Figure 26:
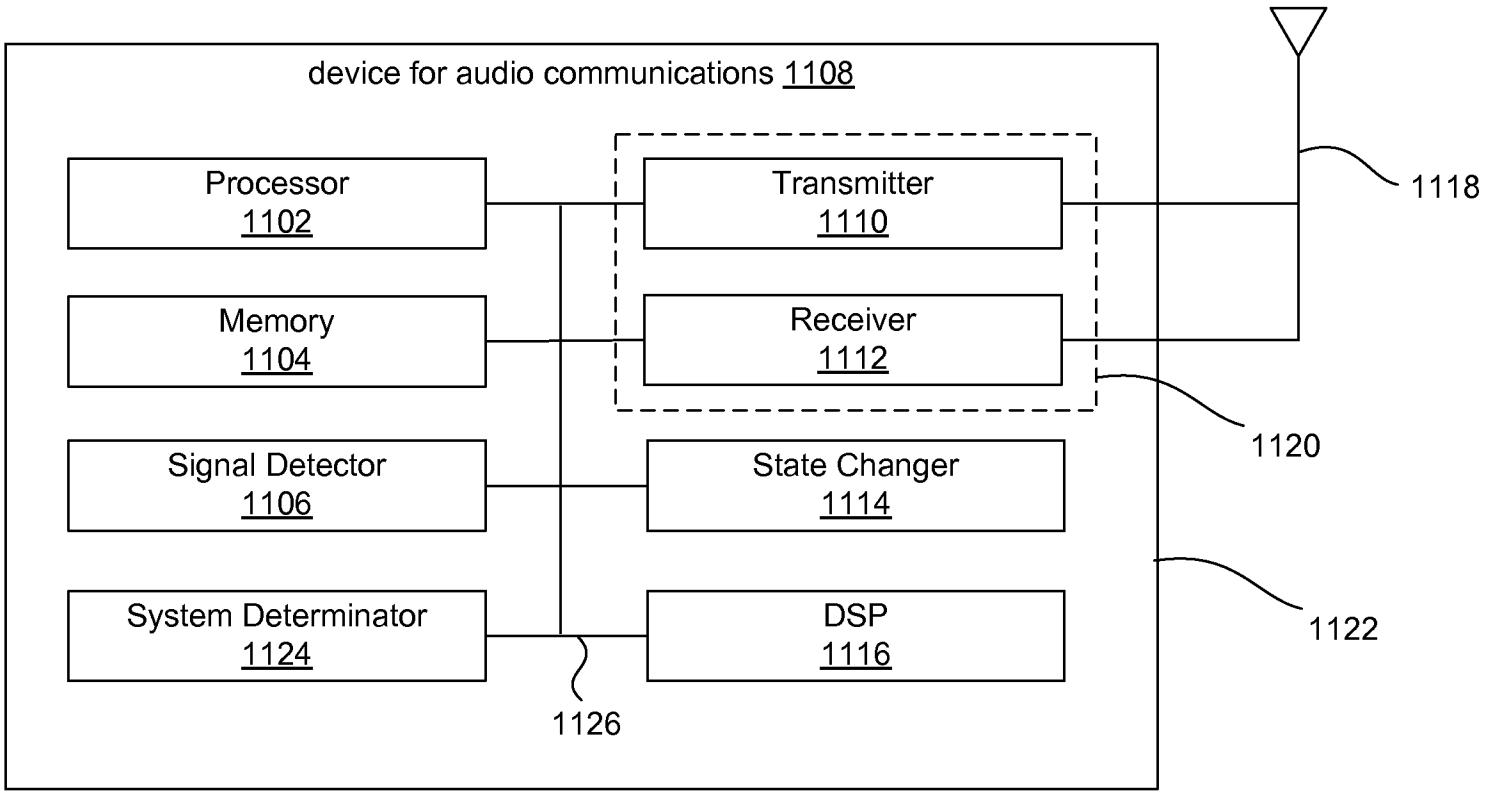
FIG. 26 illustrates a block diagram of a device for audio communications 1108.

FIG. 26 illustrates a block diagram of one example of a device for audio communications 1108 that may be used as an access terminal with the systems and methods described herein. Device 1108 includes a processor 1102 configured to control operation of device 1108. Processor 1102 may be configured to control device 1108 to perform an implementation of method M100 or M200. Device 1108 also includes memory 1104 that is configured to provide instructions and data to processor 1102 and may include ROM, RAM, and/or NVRAM. Device 1108 also includes a housing 1122 that contains a transceiver 1120. Transceiver 1120 includes a transmitter 1110 and a receiver 1112 that support transmission and reception of data between device 1108 and a remote location. An antenna 1118 of device 1108 is attached to housing 1122 and electrically coupled to transceiver 1120.

Device 1108 includes a signal detector 1106 configured to detect and quantify levels of signals received by transceiver 1120. For example, signal detector 1106 may be configured to calculate values of parameters such as total energy, pilot energy per pseudonoise chip (also expressed as Eb/No), and/or power spectral density. Device 1108 includes a bus system 1126 configured to couple the various components of device 1108 together. In addition to a data bus, bus system 1126 may include a power bus, a control signal bus, and/or a status signal bus. Device 1108 also includes a DSP 1116 configured to process signals received by and/or to be transmitted by transceiver 1120.

In this example, device 1108 is configured to operate in any one of several different states and includes a state changer 1114 configured to control a state of device 1108 based on a current state of the device and on signals received by transceiver 1120 and detected by signal detector 1106. In this example, device 1108 also includes a system determinator 1124 configured to determine that the current service provider is inadequate and to control device 1108 to transfer to a different service provider.

What is claimed is:

1. A method of processing frames of an audio signal, said method comprising:

classifying each of a first frame of the audio signal and a second frame of the audio signal as a frame type from a set of frame types comprising a voiced speech frame, an unvoiced speech frame, a transitional frame, a generic audio frame, and an inactive frame containing only one or more of background noise and silence;

encoding the first frame of the audio signal according to a relaxed code excited linear prediction (RCELP) coding scheme to produce a first encoded frame;

encoding the second frame of the audio signal according to a non-pitch-regularizing (non-PR) coding scheme to produce a second encoded frame, wherein the second frame is a generic audio frame, and wherein the second frame follows and is consecutive to the first frame in the audio signal, and wherein said encoding the first frame includes time-modifying, based on a time shift, a segment of a first signal that is based on the first frame, said time-modifying including one among (A) time-shifting the segment of the first frame according to the time shift and (B) time-warping the segment of the first signal based on the time shift, and wherein said time-modifying a segment of a first signal includes changing a position of a pitch pulse of the segment relative to another pitch pulse of the first signal, and wherein said encoding the second frame includes time-modifying, based on the time shift, a segment of a second signal that is based on the second frame, wherein the time shift is applied to at least one sample of the segment of the second signal by a same shift value as at least one sample of the segment of the first signal, said time-modifying including one among (A) time-shifting the segment of the second frame according to the time shift and (B) time-warping the segment of the second signal based on the time shift; and transmitting the first encoded frame and the second encoded frame to a decoder that synthesizes the first encoded frame and the second encoded frame and outputs a synthesized audio signal.

2. The method of claim 1, wherein said first encoded frame is based on the time-modified segment of the first signal, and wherein said second encoded frame is based on the time-modified segment of the second signal.

3. The method of claim 1, wherein the first signal is a residual of the first frame, and wherein the second signal is a residual of the second frame.

4. The method of claim 1, wherein the first and second signals are weighted audio signals.

5. The method of claim 1, wherein said encoding the first frame includes calculating the time shift based on information from a residual of a third frame that precedes the first frame in the audio signal.

6. The method of claim 5, wherein said calculating the time shift includes mapping samples of the residual of the third frame to a delay contour of the audio signal.

7. The method of claim 6, wherein said encoding the first frame includes computing the delay contour based on information relating to a pitch period of the audio signal.

8. The method of claim 1, wherein the non-PR coding scheme is one among (A) a noise-excited linear prediction coding scheme, (B) a modified discrete cosine transform coding scheme, and (C) a prototype waveform interpolation coding scheme.

9. The method of claim 1, wherein the non-PR coding scheme is a modified discrete cosine transform coding scheme.

10. The method according to claim 1, wherein said encoding the second frame includes:

performing a modified discrete cosine transform (MDCT) operation on a residual of the second frame to obtain an encoded residual; and performing an inverse MDCT operation on a signal that is based on the encoded residual to obtain a decoded residual, wherein the second signal is based on the decoded residual.

11. The method according to claim 1, wherein said encoding the second frame includes:

generating a residual of the second frame, wherein the second signal is the generated residual;

subsequent to said time-modifying a segment of the second signal, performing a modified discrete cosine transform operation on the generated residual, including the time-modified segment, to obtain an encoded residual; and producing the second encoded frame based on the encoded residual.

12. The method of claim 1, wherein said method comprises time-shifting, according to the time shift, a segment of a residual of a frame that follows the second frame in the audio signal.

13. The method of claim 1, wherein said method includes time-modifying, based on the time shift, a segment of a third signal that is based on a third frame of the audio signal which follows the second frame, and wherein said encoding the second frame includes performing a modified discrete cosine transform (MDCT) operation over a window that includes samples of the time-modified segments of the second and third signals.

14. The method of claim 13, wherein the second signal has a length of M samples and the third signal has a length of M samples, and wherein said performing an MDCT operation includes producing a set of M MDCT coefficients that is based on (A) M samples of the second signal, including the time-modified segment, and (B) not more than 3M/4 samples of the third signal.

15. The method of claim 13, wherein the second signal has a length of M samples and the third signal has a length of M samples, and wherein said performing an MDCT operation includes producing a set of M MDCT coefficients that is based on a sequence of 2M samples which (A) includes M samples of the second signal, including the time-modified segment, (B) begins with a sequence of at least M/8 samples of zero value, and (C) ends with a sequence of at least M/8 samples of zero value.

16. An apparatus for processing frames of an audio signal, said apparatus comprising:

means for classifying each of a first frame of the audio signal and a second frame of the audio signal as a frame type from a set of frame types comprising a voiced speech frame, an unvoiced speech frame, a transitional frame, a generic audio frame, and an inactive frame containing only one or more of background noise and silence;

means for encoding the first frame of the audio signal according to a relaxed code excited linear prediction (RCELP) coding scheme to produce a first encoded frame;

means for encoding the second frame of the audio signal according to a non-pitch-regularizing (non-PR) coding scheme to produce a second encoded frame, wherein the second frame is a generic audio frame, and wherein the second frame follows and is consecutive to the first frame in the audio signal, and wherein said means for encoding the first frame includes means for time-modifying, based on a time shift, a segment of a first signal that is based on the first frame, said means for time-modifying being configured to perform one among (A) time-shifting the segment of the first frame according to the time shift and (B) time-warping the segment of the first signal based on the time shift, and wherein said means for time-modifying a segment of a first signal is configured to change a position of a pitch pulse of the segment relative to another pitch pulse of the first signal, and wherein said means for encoding the second frame includes means for time-modifying, based on the time shift, a segment of a second signal that is based on the second frame, wherein the time shift is applied to at least one sample of the segment of the second signal by a same shift value as at least one sample of the segment of the first signal, said means for time-modifying being configured to perform one among (A) time-shifting the segment of the second frame according to the time shift and (B) time-warping the segment of the second signal based on the time shift; and means for transmitting the first encoded frame and the second encoded frame to a means for decoding having means for synthesizing the first encoded frame and the second encoded frame and means for outputting a synthesized audio signal.

17. The apparatus of claim 16, wherein the first signal is a residual of the first frame, and wherein the second signal is a residual of the second frame.

18. The apparatus of claim 16, wherein the first and second signals are weighted audio signals.

19. The apparatus of claim 16, wherein said means for encoding the first frame includes means for calculating the time shift based on information from a residual of a third frame that precedes the first frame in the audio signal.

20. The apparatus of claim 16, wherein said means for encoding the second frame includes:

means for generating a residual of the second frame, wherein the second signal is the generated residual; and means for performing a modified discrete cosine transform operation on the generated residual, including the time-modified segment, to obtain an encoded residual, wherein said means for encoding the second frame is configured to produce the second encoded frame based on the encoded residual.

21. The apparatus of claim 16, wherein said means for time-modifying a segment of the second signal is configured to time-shift, according to the time shift, a segment of a residual of a frame that follows the second frame in the audio signal.

22. The apparatus of claim 16, wherein said means for time-modifying a segment of a second signal is configured to time-modify, based on the time shift, a segment of a third signal that is based on a third frame of the audio signal which follows the second frame, and wherein said means for encoding the second frame includes means for performing a modified discrete cosine transform (MDCT) operation over a window that includes samples of the time-modified segments of the second and third signals.

23. The apparatus of claim 22, wherein the second signal has a length of M samples and the third signal has a length of M samples, and wherein said means for performing an MDCT operation is configured to produce a set of M MDCT coefficients that is based on (A) M samples of the second signal, including the time-modified segment, and (B) not more than 3M/4 samples of the third signal.

24. An apparatus for processing frames of an audio signal, said apparatus comprising:

a processor comprising a first frame encoder and a second frame encoder, wherein the processor is configured to classify each of a first frame of the audio signal and a second frame of the audio signal as a frame type from a set of frame types comprising a voiced speech frame, an unvoiced speech frame, a transitional frame, a generic audio frame, and an inactive frame containing only one or more of background noise and silence;

the first frame encoder configured to encode the first frame of the audio signal according to a relaxed code excited linear prediction (RCELP) coding scheme to produce a first encoded frame;

the second frame encoder configured to encode the second frame of the audio signal according to a non-pitch-regularizing (non-PR) coding scheme to produce a second encoded frame, wherein the second frame is a generic audio frame, and wherein the second frame follows and is consecutive to the first frame in the audio signal, and wherein said first frame encoder includes a first time modifier configured to time-modify, based on a time shift, a segment of a first signal that is based on the first frame, said first time modifier being configured to perform one among (A) time-shifting the segment of the first frame according to the time shift and (B) time-warping the segment of the first signal based on the time shift, and wherein said first time modifier is configured to change a position of a pitch pulse of the segment relative to another pitch pulse of the first signal, and wherein said second frame encoder includes a second time modifier configured to time-modify, based on the time shift, a segment of a second signal that is based on the second frame, wherein the time shift is applied to at least one sample of the segment of the second signal by a same shift value as at least one sample of the segment of the first signal, said second time modifier being configured to perform one among (A) time-shifting the segment of the second frame according to the time shift and (B) time-warping the segment of the second signal based on the time shift; and a transmitter configured to transmit the first encoded frame and the second encoded frame to a decoder that is configured to synthesize the first encoded frame and the second encoded frame and output a synthesized audio signal.

25. The apparatus of claim 24, wherein the first signal is a residual of the first frame, and wherein the second signal is a residual of the second frame.

26. The apparatus of claim 24, wherein the first and second signals are weighted audio signals.

27. The apparatus of claim 24, wherein said first frame encoder includes a time shift calculator configured to calculate the time shift based on information from a residual of a third frame that precedes the first frame in the audio signal.

28. The apparatus of claim 24, wherein said second frame encoder includes:

a residual generator configured to generate a residual of the second frame, wherein the second signal is the generated residual; and a modified discrete cosine transform (MDCT) module configured to perform an MDCT operation on the generated residual, including the time-modified segment, to obtain an encoded residual, wherein said second frame encoder is configured to produce the second encoded frame based on the encoded residual.

29. The apparatus of claim 24, wherein said second time modifier is configured to time-shift, according to the time shift, a segment of a residual of a frame that follows the second frame in the audio signal.

30. The apparatus of claim 24, wherein said second time modifier is configured to time-modify, based on the time shift, a segment of a third signal that is based on a third frame of the audio signal which follows the second frame, and wherein said second frame encoder includes a modified discrete cosine transform (MDCT) module configured to perform an MDCT operation over a window that includes samples of the time-modified segments of the second and third signals.

31. The apparatus of claim 30, wherein the second signal has a length of M samples and the third signal has a length of M samples, and wherein said MDCT module is configured to produce a set of M MDCT coefficients that is based on (A) M samples of the second signal, including the time-modified segment, and (B) not more than 3M/4 samples of the third signal.

32. A non-transitory computer-readable medium comprising instructions which when executed by a processor cause the processor to:

classify each of a first frame of an audio signal and a second frame of the audio signal as a frame type from a set of frame types comprising a voiced speech frame, an unvoiced speech frame, a transitional frame, a generic audio frame, and an inactive frame containing only one or more of background noise and silence;

encode the first frame of the audio signal according to a relaxed code excited linear prediction (RCELP) coding scheme to produce a first encoded frame;

encode the second frame of the audio signal according to a non-pitch-regularizing (non-PR) coding scheme to produce a second encoded frame, wherein the second frame is a generic audio frame, and wherein the second frame follows and is consecutive to the first frame in the audio signal, and wherein said instructions which when executed cause the processor to encode the first frame include instructions to time-modify, based on a time shift, a segment of a first signal that is based on the first frame, said instructions to time-modify including one among (A) instructions to time-shift the segment of the first frame according to the time shift and (B) instructions to time-warp the segment of the first signal based on the time shift, and wherein said instructions to time-modify a segment of a first signal include instructions to change a position of a pitch pulse of the segment relative to another pitch pulse of the first signal, and wherein said instructions which when executed cause the processor to encode the second frame include instructions to time-modify, based on the time shift, a segment of a second signal that is based on the second frame, wherein the time shift is applied to at least one sample of the segment of the second signal by a same shift value as at least one sample of the segment of the first signal, said instructions to time-modify including one among (A) instructions to time-shift the segment of the second frame according to the time shift and (B) instructions to time-warp the segment of the second signal based on the time shift; and transmit the first encoded frame and the second encoded frame to a decoder that synthesizes the first encoded frame and the second encoded frame and outputs a synthesized audio signal.

33. A method of processing frames of an audio signal, said method comprising:

classifying each of a first frame of the audio signal and a second frame of the audio signal as a frame type from a set of frame types comprising a voiced speech frame, an unvoiced speech frame, a transitional frame, a generic audio frame, and an inactive frame containing only one or more of background noise and silence;

encoding the first frame of the audio signal according to a first coding scheme to produce a first encoded frame, wherein the first frame is a generic audio frame;

encoding the second frame of the audio signal according to a relaxed code excited linear prediction (RCELP) coding scheme to produce a second encoded frame, wherein the second frame follows and is consecutive to the first frame in the audio signal, and wherein the first coding scheme is a non-pitch-regularizing (non-PR) coding scheme, and wherein said encoding the first frame includes time-modifying, based on a first time shift, a segment of a first signal that is based on the first frame, wherein the first time shift is applied to at least one sample of the segment of the first signal by a same shift value as at least one sample of a segment of a signal of a preceding frame, said time-modifying including one among (A) time-shifting the segment of the first signal according to the first time shift and (B) time-warping the segment of the first signal based on the first time shift; and wherein said encoding the second frame includes time-modifying, based on a second time shift, a segment of a second signal that is based on the second frame, said time-modifying including one among (A) time-shifting the segment of the second signal according to the second time shift and (B) time-warping the segment of the second signal based on the second time shift, wherein said time-modifying a segment of a second signal includes changing a position of a pitch pulse of the segment relative to another pitch pulse of the second signal, and wherein the second time shift is based on information from the time-modified segment of the first signal; and transmitting the first encoded frame and the second encoded frame to a decoder that synthesizes the first encoded frame and the second encoded frame and outputs a synthesized audio signal.

34. The method of claim 33, wherein said first encoded frame is based on the time-modified segment of the first signal, and wherein said second encoded frame is based on the time-modified segment of the second signal.

35. The method of claim 33, wherein the first signal is a residual of the first frame, and wherein the second signal is a residual of the second frame.

36. The method of claim 33, wherein the first and second signals are weighted audio signals.

37. The method according to claim 33, wherein said time-modifying a segment of the second signal includes calculating the second time shift based on information from the time-modified segment of the first signal, and wherein said calculating the second time shift includes mapping the time-modified segment of the first signal to a delay contour that is based on information from the second frame.

38. The method according to claim 37, wherein said second time shift is based on a correlation between samples of the mapped segment and samples of a temporary modified residual, and wherein the temporary modified residual is based on (A) samples of a residual of the second frame and (B) the first time shift.

39. The method according to claim 33, wherein the second signal is a residual of the second frame, and wherein said time-modifying a segment of the second signal includes time-shifting a first segment of the residual according to the second time shift, and wherein said method comprises:

calculating a third time shift that is different than the second time shift, based on information from the time-modified segment of the first signal; and time-shifting a second segment of the residual according to the third time shift.

40. The method according to claim 33, wherein the second signal is a residual of the second frame, and wherein said time-modifying a segment of the second signal includes time-shifting a first segment of the residual according to the second time shift, and wherein said method comprises:

calculating a third time shift that is different than the second time shift, based on information from the time-modified first segment of the residual; and time-shifting a second segment of the residual according to the third time shift.

41. The method according to claim 33, wherein said time-modifying a segment of the second signal includes mapping samples of the time-modified segment of the first signal to a delay contour that is based on information from the second frame.

42. The method according to claim 33, wherein said method comprises:

storing a sequence based on the time-modified segment of the first signal to an adaptive codebook buffer; and subsequent to said storing, mapping samples of the adaptive codebook buffer to a delay contour that is based on information from the second frame.

43. The method according to claim 33, wherein the second signal is a residual of the second frame, and wherein said time-modifying a segment of the second signal includes time-warping the residual of the second frame, and wherein said method comprises time-warping a residual of a third frame of the audio signal based on information from the time-warped residual of the second frame, wherein the third frame is consecutive to the second frame in the audio signal.

44. The method according to claim 33, wherein the second signal is a residual of the second frame, and wherein said time-modifying a segment of the second signal includes calculating the second time shift based on (A) information from the time-modified segment of the first signal and (B) information from the residual of the second frame.

45. The method of claim 33, wherein the non-PR coding scheme is one among (A) a noise-excited linear prediction coding scheme, (B) a modified discrete cosine transform coding scheme, and (C) a prototype waveform interpolation coding scheme.

46. The method of claim 33, wherein the non-PR coding scheme is a modified discrete cosine transform coding scheme.

47. The method according to claim 33, wherein said encoding the first frame includes:

performing a modified discrete cosine transform (MDCT) operation on a residual of the first frame to obtain an encoded residual; and performing an inverse MDCT operation on a signal that is based on the encoded residual to obtain a decoded residual, wherein the first signal is based on the decoded residual.

48. The method according to claim 33, wherein said encoding the first frame includes:

generating a residual of the first frame, wherein the first signal is the generated residual;

subsequent to said time-modifying a segment of the first signal, performing a modified discrete cosine transform operation on the generated residual, including the time-modified segment, to obtain an encoded residual; and producing the first encoded frame based on the encoded residual.

49. The method according to claim 33, wherein the first signal has a length of M samples and the second signal has a length of M samples, and wherein said encoding the first frame includes producing a set of M modified discrete cosine transform (MDCT) coefficients that is based on M samples of the first signal, including the time-modified segment, and not more than 3M/4 samples of the second signal.

50. The method according to claim 33, wherein the first signal has a length of M samples and the second signal has a length of M samples, and wherein said encoding the first frame includes producing a set of M modified discrete cosine transform (MDCT) coefficients that is based on a sequence of 2M samples which (A) includes M samples of the first signal, including the time-modified segment, (B) begins with a sequence of at least M/8 samples of zero value, and (C) ends with a sequence of at least M/8 samples of zero value.

51. An apparatus for processing frames of an audio signal, said apparatus comprising:

means for classifying each of a first frame of the audio signal and a second frame of the audio signal as a frame type from a set of frame types comprising a voiced speech frame, an unvoiced speech frame, a transitional frame, a generic audio frame, and an inactive frame containing only one or more of background noise and silence;

means for encoding the first frame of the audio signal according to a first coding scheme to produce a first encoded frame, wherein the first frame is a generic audio frame;

means for encoding the second frame of the audio signal according to a relaxed code excited linear prediction (RCELP) coding scheme to produce a second encoded frame, wherein the second frame follows and is consecutive to the first frame in the audio signal, and wherein the first coding scheme is a non-pitch-regularizing (non-PR) coding scheme, and wherein said means for encoding the first frame includes means for time-modifying, based on a first time shift, a segment of a first signal that is based on the first frame, wherein the first time shift is applied to at least one sample of the segment of the first signal by a same shift value as at least one sample of a segment of a signal of a preceding frame, said means for time-modifying being configured to perform one among (A) time-shifting the segment of the first signal according to the first time shift and (B) time-warping the segment of the first signal based on the first time shift; and wherein said means for encoding the second frame includes means for time-modifying, based on a second time shift, a segment of a second signal that is based on the second frame, said means for time-modifying being configured to perform one among (A) time-shifting the segment of the second signal according to the second time shift and (B) time-warping the segment of the second signal based on the second time shift, wherein said means for time-modifying a segment of a second signal is configured to change a position of a pitch pulse of the segment relative to another pitch pulse of the second signal, and wherein the second time shift is based on information from the time-modified segment of the first signal; and means for transmitting the first encoded frame and the second encoded frame to a means for decoding having means for synthesizing the first encoded frame and the second encoded frame and means for outputting a synthesized audio signal.

52. The apparatus of claim 51, wherein the first signal is a residual of the first frame, and wherein the second signal is a residual of the second frame.

53. The apparatus of claim 51, wherein the first and second signals are weighted audio signals.

54. The apparatus according to claim 51, wherein said means for time-modifying a segment of the second signal includes means for calculating the second time shift based on information from the time-modified segment of the first signal, and wherein said means for calculating the second time shift includes means for mapping the time-modified segment of the first signal to a delay contour that is based on information from the second frame.

55. The apparatus according to claim 54, wherein said second time shift is based on a correlation between samples of the mapped segment and samples of a temporary modified residual, and wherein the temporary modified residual is based on (A) samples of a residual of the second frame and (B) the first time shift.

56. The apparatus according to claim 51, wherein the second signal is a residual of the second frame, and wherein said means for time-modifying a segment of the second signal is configured to time-shift a first segment of the residual according to the second time shift, and wherein said apparatus comprises:

means for calculating a third time shift that is different than the second time shift, based on information from the time-modified first segment of the residual; and means for time-shifting a second segment of the residual according to the third time shift.

57. The apparatus according to claim 51, wherein the second signal is a residual of the second frame, and wherein said means for time-modifying a segment of the second signal includes means for calculating the second time shift based on (A) information from the time-modified segment of the first signal and (B) information from the residual of the second frame.

58. The apparatus according to claim 51, wherein said means for encoding the first frame includes:

means for generating a residual of the first frame, wherein the first signal is the generated residual; and means for performing a modified discrete cosine transform operation on the generated residual, including the time-modified segment, to obtain an encoded residual, and wherein said means for encoding the first frame is configured to produce the first encoded frame based on the encoded residual.

59. The apparatus according to claim 51, wherein the first signal has a length of M samples and the second signal has a length of M samples, and wherein said means for encoding the first frame includes means for producing a set of M modified discrete cosine transform (MDCT) coefficients that is based on M samples of the first signal, including the time-modified segment, and not more than 3M/4 samples of the second signal.

60. The apparatus according to claim 51, wherein the first signal has a length of M samples and the second signal has a length of M samples, and wherein said means for encoding the first frame includes means for producing a set of M modified discrete cosine transform (MDCT) coefficients that is based on a sequence of 2M samples which (A) includes M samples of the first signal, including the time-modified segment, (B) begins with a sequence of at least M/8 samples of zero value, and (C) ends with a sequence of at least M/8 samples of zero value.

61. An apparatus for processing frames of an audio signal, said apparatus comprising:

a processor comprising a first frame encoder and a second frame encoder, wherein the processor is configured to classify each of a first frame of the audio signal and a second frame of the audio signal as a frame type from a set of frame types comprising a voiced speech frame, an unvoiced speech frame, a transitional frame, a generic audio frame, and an inactive frame containing only one or more of background noise and silence;

the first frame encoder configured to encode the first frame of the audio signal according to a first coding scheme to produce a first encoded frame, wherein the first frame is a generic audio frame;

the second frame encoder configured to encode the second frame of the audio signal according to a relaxed code excited linear prediction (RCELP) coding scheme to produce a second encoded frame, wherein the second frame follows and is consecutive to the first frame in the audio signal, and wherein the first coding scheme is a non-pitch-regularizing (non-PR) coding scheme, and wherein said first frame encoder includes a first time modifier configured to time-modify, based on a first time shift, a segment of a first signal that is based on the first frame, wherein the first time shift is applied to at least one sample of the segment of the first signal by a same shift value as at least one sample of a segment of a signal of a preceding frame, said first time modifier being configured to perform one among (A) time-shifting the segment of the first signal according to the first time shift and (B) time-warping the segment of the first signal based on the first time shift; and wherein said second frame encoder includes a second time modifier configured to time-modify, based on a second time shift, a segment of a second signal that is based on the second frame, said second time modifier being configured to perform one among (A) time-shifting the segment of the second signal according to the second time shift and (B) time-warping the segment of the second signal based on the second time shift, wherein said second time modifier is configured to change a position of a pitch pulse of the segment of a second signal relative to another pitch pulse of the second signal, and wherein the second time shift is based on information from the time-modified segment of the first signal; and a transmitter configured to transmit the first encoded frame and the second encoded frame to a decoder that is configured to synthesize the first encoded frame and the second encoded frame and output a synthesized audio signal.

62. The apparatus of claim 61, wherein the first signal is a residual of the first frame, and wherein the second signal is a residual of the second frame.

63. The apparatus of claim 61, wherein the first and second signals are weighted audio signals.

64. The apparatus according to claim 61, wherein said second time modifier includes a time shift calculator configured to calculate the second time shift based on information from the time-modified segment of the first signal, and wherein said time shift calculator includes a mapper configured to map the time-modified segment of the first signal to a delay contour that is based on information from the second frame.

65. The apparatus according to claim 64, wherein said second time shift is based on a correlation between samples of the mapped segment and samples of a temporary modified residual, and wherein the temporary modified residual is based on (A) samples of a residual of the second frame and (B) the first time shift.

66. The apparatus according to claim 61, wherein the second signal is a residual of the second frame, and wherein said second time modifier is configured to time-shift a first segment of the residual according to the second time shift, and wherein said apparatus further comprises a time shift calculator, wherein said time shift calculator is configured to calculate a third time shift that is different than the second time shift, based on information from the time-modified first segment of the residual, and wherein said apparatus further comprises a second time shifter, wherein said second time shifter is configured to time-shift a second segment of the residual according to the third time shift.

67. The apparatus according to claim 61, wherein the second signal is a residual of the second frame, and wherein said second time modifier includes a time shift calculator configured to calculate the second time shift based on (A) information from the time-modified segment of the first signal and (B) information from the residual of the second frame.

68. The apparatus according to claim 61, wherein said first frame encoder includes:

a residual generator configured to generate a residual of the first frame, wherein the first signal is the generated residual; and a modified discrete cosine transform (MDCT) module configured to perform an MDCT operation on the generated residual, including the time-modified segment, to obtain an encoded residual, and wherein said first frame encoder is configured to produce the first encoded frame based on the encoded residual.

69. The apparatus according to claim 61, wherein the first signal has a length of M samples and the second signal has a length of M samples, and wherein said first frame encoder includes a modified discrete cosine transform (MDCT) module configured to produce a set of M MDCT coefficients that is based on M samples of the first signal, including the time-modified segment, and not more than 3M/4 samples of the second signal.

70. The apparatus according to claim 61, wherein the first signal has a length of M samples and the second signal has a length of M samples, and wherein said first frame encoder includes a modified discrete cosine transform (MDCT) module configured to produce a set of M MDCT coefficients that is based on a sequence of 2M samples which (A) includes M samples of the first signal, including the time-modified segment, (B) begins with a sequence of at least M/8 samples of zero value, and (C) ends with a sequence of at least M/8 samples of zero value.

71. A non-transitory computer-readable medium comprising instructions which when executed by a processor cause the processor to:

classify each of a first frame of an audio signal and a second frame of the audio signal as a frame type from a set of frame types comprising a voiced speech frame, an unvoiced speech frame, a transitional frame, a generic audio frame, and an inactive frame containing only one or more of background noise and silence;

encode the first frame of the audio signal according to a first coding scheme to produce a first encoded frame, wherein the first frame is a generic audio frame;

encode the second frame of the audio signal according to a relaxed code excited linear prediction (RCELP) coding scheme to produce a second encoded frame, wherein the second frame follows and is consecutive to the first frame in the audio signal, and wherein the first coding scheme is a non-pitch-regularizing (non-PR) coding scheme, and wherein said instructions which when executed by a processor cause the processor to encode the first frame include instructions to time-modify, based on a first time shift, a segment of a first signal that is based on the first frame, wherein the first time shift is applied to at least one sample of the segment of the first signal by a same shift value as at least one sample of a segment of a signal of a preceding frame, said instructions to time-modify including one among (A) instructions to time-shift the segment of the first signal according to the first time shift and (B) instructions to time-warp the segment of the first signal based on the first time shift; and wherein said instructions which when executed by a processor cause the processor to encode the second frame include instructions to time-modify, based on a second time shift, a segment of a second signal that is based on the second frame, said instructions to time-modify including one among (A) instructions to time-shift the segment of the second signal according to the second time shift and (B) instructions to time-warp the segment of the second signal based on the second time shift, wherein said instructions to time-modify a segment of a second signal include instructions to change a position of a pitch pulse of the segment relative to another pitch pulse of the second signal, and wherein the second time shift is based on information from the time-modified segment of the first signal; and transmit the first encoded frame and the second encoded frame to a decoder that synthesizes the first encoded frame and the second encoded frame and outputs a synthesized audio signal.

72. The method of claim 1, wherein the second frame comprises music.

73. The method of claim 1, wherein the time shift is computed based on the first frame and used to time-modify the first frame entirely.

* * * * *